US005851749A

United States Patent [19]

Okawa et al.

[11] Patent Number: 5,851,749

[45] **Date of Patent: *Dec. 22, 1998**

[54] COLOR-DEVELOPING AGENT, SILVER HALIDE PHOTOGRAPHIC LIGHT-SENSITIVE MATERIAL AND IMAGE-FORMING METHOD

[75] Inventors: Atsuhiro Okawa; Toshiyuki Makuta; Toshiki Taguchi, all of Minami-ashigara, Japan

[73] Assignee: Fuji Photo Film Co., Ltd., Kanagawa-ken, Japan

[ * ] Notice: The term of this patent shall not extend beyond the expiration date of Pat. No. 5,756,275.

[21] Appl. No.: 757,730

[22] Filed: Nov. 26, 1996

[30] Foreign Application Priority Data

Nov. 30, 1995 [JP] Japan ..... 7-334183

[51] Int. Cl.[6] ..... G03C 1/42

[52] U.S. Cl. ..... 430/566; 430/264; 430/348; 430/349; 430/351; 430/448; 430/467

[58] Field of Search ..... 430/264, 467, 430/566, 348, 349, 351, 448

[56] References Cited

U.S. PATENT DOCUMENTS 4,481,268 11/1984 Bailey et al. ..... 430/17
4,740,453 4/1988 Nakamura et al. ..... 430/566

FOREIGN PATENT DOCUMENTS 0 545 491 A1 6/1993 European Pat. Off. .
0 565 165 A1 10/1993 European Pat. Off. .
0 593 110 A1 4/1994 European Pat. Off. .

*Primary Examiner*—Hoa Van Le
*Attorney, Agent, or Firm*—Birch, Stewart, Kolasch & Birch, LLP

[57] ABSTRACT

There is disclosed novel color-developing agents of the formula (I). There is also disclosed silver halide photographic light-sensitive materials and image-forming methods, using the color-developing agent. The color-developing agent is excellent in color-forming property, and the image obtained from the color-developing agent is good in stability of hue and image.

Formula (I)

wherein $Z^1$ represents an acyl group, a carbamoyl group, an alkoxycarbonyl group, an aryloxycarbonyl group, a sulfonyl group, or a carbonimidoyl group, $Q^1$ represents a group of atoms required to form a 5- or 6-membered aromatic ring together with the C, $Q^2$ represents a heterocyclic residue, $Y^1$ represents a group capable of substitution onto the aromatic ring, m is 1 or 2, and n is an integer of 0 to 3.

26 Claims, No Drawings

COLOR-DEVELOPING AGENT, SILVER HALIDE PHOTOGRAPHIC LIGHT-SENSITIVE MATERIAL AND IMAGE-FORMING METHOD

FIELD OF THE INVENTION

The present invention relates to a silver halide photographic light-sensitive material that uses a novel color-developing agent, and to a novel image-forming method. The present invention particularly relates to a silver halide photographic light-sensitive material which shows good color-forming property in development, and to an image-forming method.

BACKGROUND OF THE INVENTION

In color photographic light-sensitive materials, when the photographic material is exposed to light image-wise and then color-developed, the oxidized color developing agent and couplers are reacted, and an image is formed. In this system, color reproduction by the subtractive color process is used, and, to reproduce blue, green, and red colors, dye images are formed that are yellow, magenta, and cyan in color, respectively complementary to blue, green, and red.

Color development is accomplished by immersing the light-exposed color photographic material in an aqueous alkali solution in which a color-developing agent is dissolved (a developing solution). However, the color-developing agent in an aqueous alkali solution is unstable and liable to deteriorate with a lapse of time, and there is the problem that the developing solution must be replenished frequently in order to retain stable developing performance. Further, used developing solutions containing a color-developing agent are required to be discarded, and this, together with the above frequent replenishment, creates a serious problem regarding the treatment of used developing solutions that are discharged in large volume. Thus, low-replenishment and reduced discharge of developing solutions are strongly demanded.

One effective measure proposed for realizing low-replenishment and reduced discharge of developing solutions is a method wherein an aromatic primary amine developing agent or its precursor is built in a hydrophilic colloid layer of a color photographic material. Examples of the developing agents that can be built in include compounds described, for example, in British Patent No. 803, 783, U.S. Pat. Nos. 3,342,597, 3,719,492, and 4,060,418, British Patent No. 1,069,061, West German Patent No. 1,159,758, JP-B ("JP-B" means examined Japanese patent publication) Nos. 14,671/1983 and 14,672/1983, and JP-A ("JP-A" means unexamined published Japanese patent application) Nos. 76,543/1982 and 81,643/1984. However, color photographic materials having these aromatic primary amine developing agents or their precursors built therein have a defect that satisfactory color formation is not attained when they are chromogenically developed.

Another effective measure proposed is a method wherein a sulfonylhydrazine-type developing agent is built in a hydrophilic colloid layer of a color photographic material, and examples of the color-developing agent that can be built in include compounds described, for example, in U.S. Pat. No. 4,481,268 and European Patent Nos. 545,491A1 and 565,165A1. However, even the developing agent mentioned therein cannot attain satisfactory color formation when color-developed; and further, when, for this sulfonylhydrazine developing agent, use is made of a coupler having a substituent at a position where coupling with the oxidation product of the developing agent will take place, there is the problem that color formation hardly takes place. In comparison with unsubstituted couplers, couplers having such a substituent have the advantages that stain due to couplers can be reduced, and the activity of the couplers can be easily adjusted by the substituent. Accordingly, there is strong need for a developing agent that, even when built-in, can provide satisfactory color formation when developed, and that also can show good color-formation property in developing an image, even when a coupler having a substituent at the coupling position is used. Further, the hue of the sulfonylhydrazine developing agents described in the foregoing patents are in the short-wavelength range and is not satisfactory in reactivity with couplers.

SUMMARY OF THE INVENTION

An object of the present invention is to provide a silver halide photographic light-sensitive material that, by using a novel color-developing agent, can give satisfactory color formation when the photographic material is developed, and that can give an image good in color-formation property and good in stability of the hue and image, even when a coupler having the coupling position substituted is used.

Another object of the present invention is to provide an image-forming method that, by using a novel color-developing agent, can give satisfactory color formation when the photographic material is developed, and that can give an image good in color-formation property and good in stability of the hue and image, even when a coupler having the coupling position substituted is used.

Other and further objects, features, and advantages of the invention will appear more apparent from the following description.

DETAILED DESCRIPTION OF THE INVENTION

The objects of the present invention can be attained by the following constitution:

(1) A color-developing agent represented by the following formula (I).

(2) An image-forming method, comprising developing a silver halide photographic light-sensitive material, which has been exposed to light image-wise, in the presence of a color-developing agent (which may, for example, be contained in the light-sensitive material or in a processing solution) represented by the following formula (I).

(3) A silver halide photographic light-sensitive material, comprising a compound represented by the following formula (I) that is contained in at least one hydrophilic colloid layer provided on a base. The light-sensitive material preferably contains a coupler.

(4) An image-forming method, comprising, after the exposure to light, carrying out development by heating the light-sensitive material stated in the above (3) at 50° to 200° C.

(5) An image-forming method, comprising carrying out development of the light-sensitive material stated in the above (3) in a solution.

(6) An image-forming method, comprising processing a light-sensitive material, after exposure of the light-sensitive material to light, with a processing solution containing a color-developing agent represented by the following formula (I).

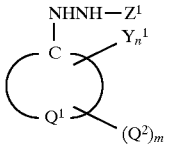

Formula (I)

wherein $Z^1$ represents an acyl group, a carbamoyl group, an alkoxycarbonyl group, an aryloxycarbonyl group, or an $R^1SO_2$— group, in which $R^1$ represents an alkyl group, an alkenyl group, an alkynyl group, an aryl group, or a heterocyclic group, or $Z^1$ represents a group represented by the following formula (II), $Q^1$ represents a group of nonmetal atoms required to form a 5- or 6-membered aromatic ring together with the C, $Q^2$ represents a heterocyclic residue, $Y^1$ represents a group capable of being substituted on the aromatic ring, m is 1 or 2, and n is an integer of 0 to 3;

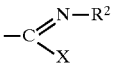

Formula (II)

wherein X represents an —$OR^3$ group or an —$NR^4R^5$ group; $R^2$, $R^4$, and $R^5$ each represent a hydrogen atom, an alkyl group, an alkenyl group, an alkynyl group, an aryl group, or a heterocyclic group; $R^3$ has the same meaning as defined in $R^1$; and $R^2$ and $R^3$, $R^2$ and $R^4$, or $R^4$ and $R^5$ may bond together to form a ring.

Preferred embodiments are the following:

(1) The color-developing agent represented by the above formula (I), wherein $Q^2$ represents an aromatic heterocyclic residue, $R^2$, $R^4$, and $R^5$ each represent a hydrogen atom, an alkyl group, an aryl group, or a heterocyclic group; and $R^3$ represents an alkyl group, an aryl group, or a heterocyclic group.

(2) The color-developing agent stated in the above (1), wherein $Z^1$ represents an $R^1SO_2$— group (3) A diffusion transfer-type silver halide color photographic light-sensitive material, containing a color-developing agent represented by the above formula (I).

(4) An image-forming method, comprising subjecting the light-sensitive material stated in the above (3) to a heat development.

(5) An embodiment, wherein when the light-sensitive material according to the present invention is processed with a processing solution, the processing solution does not contain the color-developing agent of the present invention.

The compounds represented by formula (I) or (III) used in the present invention are described below in detail.

In formula (I), $Z^1$ represents an acyl group, a carbamoyl group, an alkoxycarbonyl group, an aryloxycarbonyl group, an $R^1SO_2$— group, or a group represented by the above formula (II), in which $R^1$ represents an alkyl group, an alkenyl group, an alkynyl group, an aryl group, or a heterocyclic group.

The acyl group represented by $Z^1$ preferably has 1 to 50 carbon atoms, and more preferably 2 to 40 carbon atoms. Specific examples include an acetyl group, a 2-methylpropanoyl group, a cyclohexylcarbonyl group, an n-octanoyl group, a 2-hexyldecanoyl group, a dodecanoyl group, a chloroacetyl group, a trifluoroacetyl group, a benzoyl group, a 4-dodecyloxybenzoyl group, a 2-hydroxymethylbenzoyl group, and a 3-(N-hydroxy-N-methylaminocarbonyl)propanoyl group.

With respect to the case wherein $Z^1$ represents a carbamoyl group, a description is made in detail in formula (III):

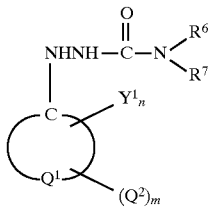

Formula (III)

$R^6$ and $R^7$ each represent a hydrogen atom or a substituent. Examples of the substituent include a straight-chain alkyl group, a branched-chain alkyl group, or a cycloalkyl group, having 1 to 50 carbon atoms (e.g. trifluoromethyl, methyl, ethyl, propyl, heptafluoropropyl, isopropyl, butyl, t-butyl, t-pentyl, cyclopentyl, cyclohexyl, octyl, 2-ethylhexyl, and dodecyl); a straight-chain alkenyl group, a branched-chain alkenyl group, or a cycloalkenyl group, having 2 to 50 carbon atoms (e.g. vinyl, 1-methylvinyl, and cyclohexen-1-yl); an alkynyl group having 2 to 50 carbon atoms in all (e.g. ethynyl and 1-propynyl), an aryl group having 6 to 50 carbon atoms (e.g. phenyl, naphthyl, and anthryl), an acyloxy group having 1 to 50 carbon atoms (e.g. acetoxy, tetradecanoyloxy, and benzoyloxy), a carbamoyloxy group having 1 to 50 carbon atoms (e.g. N,N-dimethylcarbamoyloxy), a carbonamido group having 1 to 50 carbon atoms (e.g. formamido, N-methylacetamido, acetamido, N-methylformamido, and benzamido), a sulfonamido group having 1 to 50 carbon atoms (e.g. methanesulfonamido, dodecansulfonamido, benzenesulfonamido, and p-toluenesulfonamido), a carbamoyl group having 1 to 50 carbon atoms (e.g. N-methylcarbamoyl, N,N-diethylcarbamoyl, and N-mesylcarbamoyl), a sulfamoyl group having 0 to 50 carbon atoms (e.g. N-butylsulfamoyl, N,N-diethylsulfamoyl, and N-methyl-N-(4-methoxyphenyl) sulfamoyl), an alkoxy group having 1 to 50 carbon atoms (e.g. methoxy, propoxy, isopropoxy, octyloxy, t-octyloxy, dodecyloxy, and 2-(2,4-di-t-pentylphenoxy)ethoxy), an aryloxy group having 6 to 50 carbon atoms (e.g. phenoxy, 4-methoxyphenoxy, and naphthoxy), an aryloxycarbonyl group having 7 to 50 carbon atoms (e.g. phenoxycarbonyl and naphthoxycarbonyl), an alkoxycarbonyl group having 2 to 50 carbon atoms (e.g. methoxycarbonyl and t-butoxycarbonyl), an N-acylsulfamoyl group having 1 to 50 carbon atoms (e.g. N-tetradecanoylsulfamoyl and N-benzoylsulfamoyl), an alkylsulfonyl group having 1 to 50 carbon atoms (e.g. methanesulfonyl, octylsulfonyl, 2-methoxyethylsulfonyl, and 2-hexyldecylsulfonyl), an arylsulfonyl group having 6 to 50 carbon atoms (e.g. benzenesulfonyl, p-toluenesulfonyl, and 4-phenylsulfonylphenylsulfonyl), an alkoxycarbonylamino group having 2 to 50 carbon atoms (e.g. ethoxycarbonylamino), an aryloxycarbonylamino group having 7 to 50 carbon atoms (e.g. phenoxycarbonylamino and naphthoxycarbonylamino), an amino group having 0 to 50 carbon atoms (e.g. amino, methylamino, diethylamino, diisopropylamino, anilino, and morpholino), a cyano group, a nitro group, a carboxyl group, a hydroxy group, a sulfo group, a mercapto group, an alkylsulfinyl group having 1 to 50 carbon atoms (e.g. methanesulfinyl and octanesulfinyl), an arylsulfinyl group having 6 to 50 carbon atoms (e.g. benzenesulfinyl, 4-chlorophenylsulfinyl, and p-toluenesulfinyl), an alkylthio group having 1 to 50 carbon atoms (e.g. methylthio, octylthio, and cyclohexylthio), an arylthio group having 6 to 50 carbon atoms (e.g. phenylthio and naphthylthio), a ureido group having 1 to 50 carbon atoms (e.g. 3-methylureido, 3,3-dimethylureido, and 1,3-diphenylureido), a heterocyclic group having 2 to 50 carbon atoms (e.g. a 3-membered to 12-membered monocyclic or condensed ring having at least one hetero atom, such as nitrogen, oxygen, and sulfur, for example, 2-furyl, 2-pyranyl, 2-pyridyl, 2-thienyl, 2-imidazolyl, morpholino, 2-quinolyl, 2-benzimidazolyl, 2-benzothiazolyl, and 2-benzoxazolyl), an acyl group having 1 to 50 carbon atoms (e.g. acetyl, benzoyl, and trifluoroacetyl), a sulfamoylamino group having 0 to 50 carbon atoms (e.g. N-butylsulfamoylamino and N-phenylsulfamoylamino), a silyl group having 3 to 50 carbon atoms (e.g. trimethylsilyl, dimethyl-t-butylsilyl, and triphenylsilyl), and a halogen atom (e.g. a fluorine atom, a chlorine atom, and a bromine atom). The above substituents may have a substituent, and examples of such a substituent include those mentioned above.

The number of carbon atoms of the substituent is preferably 50 or less, more preferably 42 or less, and most preferably 34 or less; and preferably the number is at least 1.

$R^6$ and $R^7$ each preferably represent a hydrogen atom, a substituted or unsubstituted alkyl group having 1 to 50 carbon atoms, a substituted or unsubstituted aryl group having 6 to 50 carbon atoms, or a substituted or unsubstituted heterocyclic group having 1 to 50 carbon atoms, and more preferably at least one of $R^6$ and $R^7$ represents a hydrogen atom.

The alkoxycarbonyl group and the aryloxycarbonyl group represented by $Z^1$ each preferably have 2 to 50 carbon atoms, and more preferably 2 to 40 carbon atoms. Specific examples include a methoxycarbonyl group, an ethoxycarbonyl group, an isobutyloxycarbonyl group, a cyclohexyloxycarbonyl group, a dodecyloxycarbonyl group, a benzyloxycarbonyl group, a phenoxycarbonyl group, a 4-octyloxyphenoxycarbonyl group, a 2-hydroxymethylphenoxycarbonyl group, and a 2-dodecyloxyphenoxycarbonyl group.

In the $R^1SO_2$— group represented by $Z^1$, $R^1$ represents an alkyl group, an alkenyl group, an alkynyl group, an aryl group, or a heterocyclic group. Specifically, $R^1$ represents a straight-chain or branched, chain-like or cyclic alkyl group having a total carbon number of 1 to 50 (e.g. methyl, ethyl, propyl, isopropyl, butyl, t-butyl, t-amyl, cyclopentyl, cyclohexyl, octyl, 2-ethylhexyl, and dodecyl); a straight-chain or branched, chain-like or cyclic alkenyl group having a total carbon number of 2 to 50 (e.g. vinyl, 1-methylvinyl, and cyclohexen-1-yl); an alkynyl group having a total carbon number of 2 to 50 (e.g. ethynyl and 1-propynyl); an aryl group having a total carbon number of 6 to 50 (e.g. phenyl, toluyl, xyloyl, naphthyl, and anthralyl); or a heterocyclic group having a total carbon number of 4 to 50 (the hetero atom being preferably nitrogen, oxygen, and sulfur, e.g. 2-furyl, 2-pyranyl, 2-thienyl, 2-pyridyl, 2-imidazolyl, 1-piperidinyl, 4-morpholyl, and 2-quinolyl).

$R^1$ may be substituted, and examples of the substituents that substitute $R^1$ include a straight-chain or branched, chain-like or cyclic alkyl group having 1 to 50 carbon atoms (e.g. methyl, ethyl, propyl, isopropyl, butyl, t-butyl, t-amyl, cyclopentyl, cyclohexyl, octyl, 2-ethylhexyl, dodecyl, trifluoromethyl, and heptafluoropropyl); a straight-chain or branched, chain-like or cyclic alkenyl group having 2 to 50 carbon atoms (e.g. vinyl, 1-methylvinyl, and cyclohexen-1-yl); an alkynyl group having a total carbon number of 2 to 50 (e.g. ethynyl and 1-propynyl), an aryl group having 6 to 50 carbon atoms (e.g. phenyl, naphthyl, and anthryl), an acyloxy group having 1 to 50 carbon atoms (e.g. acetoxy, tetradecanoyloxy, and benzoyloxy), a carbamoyloxy group having 1 to 50 carbon atoms (e.g. N,N-dimethylcarbamoyloxy), a carbonamido group having 1 to 50 carbon atoms (e.g. formamido, N-methylformamido, acetamido, N-methylacetamido, and benzamido), a sulfonamido group having 1 to 50 carbon atoms (e.g. methanesulfonamido, dodecanesulfonamido, benzenesulfonamido, and p-toluenesulfonamido), a carbamoyl group having 1 to 50 carbon atoms (e.g. N-methylcarbamoyl, N,N-diethylcarbamoyl, and N-mesylcarbamoyl), a sulfamoyl group having 0 to 50 carbon atoms (e.g. N-butylsulfamoyl and N,N-diethylsulfamoyl), an alkoxy group having 1 to 50 carbon atoms (e.g. methoxy, propoxy, isopropoxy, octyloxy, t-octyloxy, and dodecyloxy), an aryloxy group having 6 to 50 carbon atoms (e.g. phenoxy, 4-methoxyphenoxy, and naphthoxy), an aryloxycarbonyl group having 7 to 50 carbon atoms (e.g. phenoxycarbonyl and napthoxycarbonyl), an alkoxycarbonyl group having 2 to 50 carbon atoms (e.g. methoxycarbonyl and t-butoxycarbonyl), an N-acylsulfamoyl group having 1 to 50 carbon atoms (e.g. N-tetradecanoylsulfamoyl and N-benzoylsulfamoyl), an alkylsulfonyl group having 1 to 20 carbon atoms (e.g. methanesulfonyl and octanesulfonyl), an arylsulfonyl group having 6 to 50 carbon atoms (e.g. benzenesulfonyl and p-toluenesulfonyl), an alkoxycarbonylamino group having 2 to 50 carbon atoms (e.g. ethoxycarbonylamino), an aryloxycarbonylamino group having 7 to 50 carbon atoms (e.g. phenoxycarbonylamino and naphthoxycarbonylamino), an amino group having 0 to 50 carbon atoms (e.g. amino, methylamino, diethylamino, diisopropylamino, and anilino), a cyano group, a nitro group, a carboxy group, a hydroxy group, a sulfo group, a mercapto group, an alkylsulfinyl group having 1 to 50 carbon atoms (e.g. methanesulfinyl and octanesulfinyl), an arylsulfinyl group having 6 to 50 carbon atoms (e.g. benzenesulfinyl and p-toluenesulfinyl), an alkylthio group having 1 to 50 carbon atoms (e.g. methylthio and octylthio), an arylthio group having 6 to 50 carbon atoms (e.g. phenylthio and naphthylthio), a ureido group having 1 to 50 carbon atoms (e.g. 3-methylureido, 3,3-dimethylureido, and 1,3-diphenylureido), a heterocyclic group having 2 to 50 carbon atoms (a 3- to 12-membered monocyclic or condensed ring heterocyclic group having at least one hetero atom, such as a nitrogen atom, an oxygen atom, and a sulfur atom, e.g. 2-furyl, 2-pyranyl, 2-thienyl, 2-pyridyl, 2-imidazolyl, 4-morpholino, and 2-quinolyl), an acyl group having 1 to 50 carbon atoms (e.g. acetyl and benzoyl), a sulfamoylamino group having 1 to 50 carbon atoms (e.g. N-butylsulfamoylamino and N-phenylsulfamoylamino), a silyl group having 3 to 50 carbon atoms (e.g. trimethylsilyl, dimethyl-t-butylsilyl, and triphenylsilyl), and a halogen atom (e.g. a fluorine atom, a chlorine atom, and a bromine atom). These substituents may be further substituted, and examples of the substituents include those examples given above.

Preferable examples of $R^1$ are a substituted or unsubstituted alkyl group having a total carbon atom of 1 to 50, and a substituted or unsubstituted aryl group having a total carbon atom of 6 to 50, and more preferably a substituted or unsubstituted alkyl group having a total carbon atom of 1 to 36, and a substituted or unsubstituted aryl group having a total carbon atom of 6 to 42.

Specific examples of $R^2$, $R^4$, and $R^5$ in formula (II), which formula is represented by $Z^1$, are a hydrogen atom and the examples given for $R^1$ described above. The above-mentioned preferable examples of $R^1$ are also preferable in the case of $R^2$, $R^4$, and $R^5$. More preferably, $R^2$, $R^4$, and $R^5$ are each a hydrogen atom, an alkyl group, an aryl group, or a heterocyclic group, and particularly preferably a hydrogen atom, an alkyl group, or an aryl group. Further, the alkyl group, the aryl group, and the heterocyclic group include ones that are further substituted.

$R^3$ is preferably one of the above-mentioned preferable groups of $R^1$, more preferably an alkyl group, an aryl group, or a heterocyclic residue, and particularly preferably an alkyl group or an aryl group. Further, the $R^3$ group may be substituted.

Other groups in the above formulae (I) and (III) will be described.

$Q^1$ represents a group of nonmetal atoms required to form a 5- to 6-membered aromatic ring together with the C. To that ring, another ring may be fused. Preferably, this ring includes oxygen atoms (preferably 0 to 1 in number), nitrogen atoms (preferably 0 to 4 in number), and/or sulfur atoms (preferably 0 to 1 in number), together with carbon atoms in the mother nucleus. Specifically the aromatic ring formed with $Q^1$ and the C includes, in addition to a hydrocarbon group, such as a phenyl group and a naphthyl group, a heterocyclic group, such as furan, pyran, pyridine, thiophene, imidazole, quinoline, benzimidazole, benzothiazole, benzoxazole, pyrimidine, pyrazine, 1,2,4-thiadiazole, pyrrole, oxazole, thiazole, quinazoline, isothiazole, pyridazine, indole, pyrazole, triazole, and quinoxaline.

In formulae (I) and (III), $Q^2$ represents a heterocyclic residue. Preferably $Q^2$ represents a group of nonmetallic atoms required to form a 5- to 7-membered heterocyclic ring together with carbon atoms. More preferably this heterocyclic ring includes oxygen atoms (preferably 0 to 1 in number), nitrogen atoms (preferably 0 to 6, and more preferably 0 to 4, in number), and/or sulfur atoms (preferably 0 to 2, and more preferably 0 to 1, in number), together with carbon atoms in the mother nucleus. Particularly preferably, this ring is an aromatic heterocyclic residue. Examples thereof include a 1,2,3-benzotriazol-2-yl group, a benzothiazol-2-yl group, a benzoxazol-2-yl group, a 1-methylimidazol-2-yl group, a 1-ethylbenzimidazol-2-yl group, a 3-pyrazolyl group, a benzimidazol-2-yl group, a 2-thiazolyl group, a 1,2,4-thiadiazol-5-yl group, and a 1,3,4-thiadiazol-2-yl group. These residues may be further substituted, and examples of the substituents include those exemplified for $R^1$ given above.

The substituent $Y^1$ includes those exemplified for $R^1$ given above, and the substituent is preferably an electron-attracting group, wherein the $\sigma$ value of $Y^1$ is preferably positive value and more preferably 0.2 or more, while the $\sigma$ value of $Y^1$ is preferably 1.0 or below. The substituent $Y^1$ is more preferably an aryl group, an aryloxycarbonyl group, an alkoxycarbonyl group, a sulfamoyl group, an alkylsulfonyl group, an arylsulfonyl group, a cyano group, a nitro group, an acyl group, a halogen atom, or a perfluoroalkyl group, having an electron-attracting group, with particularly preferably the aryloxycarbonyl group, the alkoxycarbonyl group, the sulfamoyl group, the alkylsulfonyl group, the arylsulfonyl group, a cyano group, a halogen atom, or the perfluoroalkyl group.

The substituent $Y^1$ has preferably 50 or less carbon atoms in total, more preferably 30 or less.

m is 1 or 2, and preferably 1. n is an integer of 0 to 3, and preferably 1 or 2.

Preferable examples of the ring formed by $R^2$ and $R^3$, $R^2$ and $R^4$, or $R^4$ and $R^5$, bonded together, are represented by following formulae.

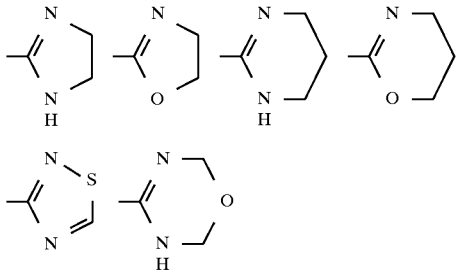

Specific examples of the novel color-developing agent of the present invention are given below, but the present invention is not limited to them.

D-1

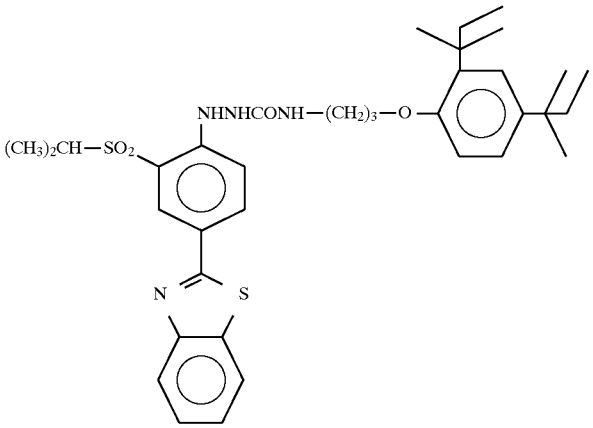

-continued
D-2
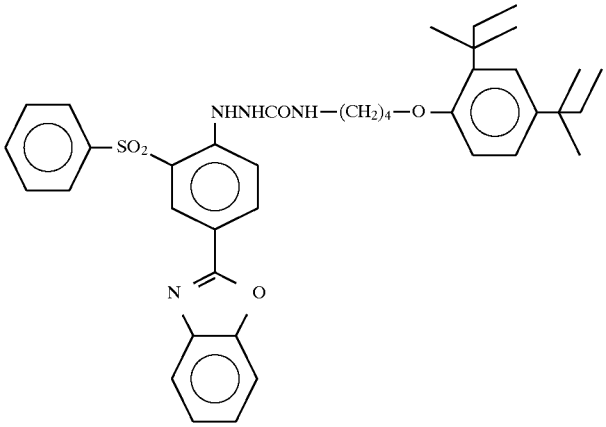
D-3
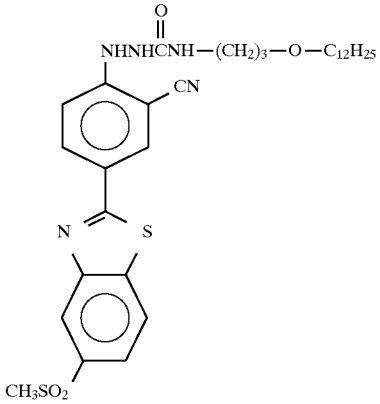
D-4
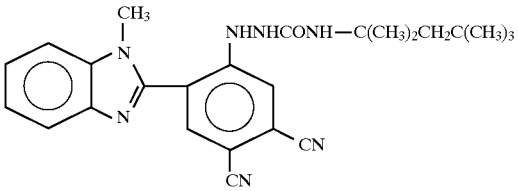
D-5
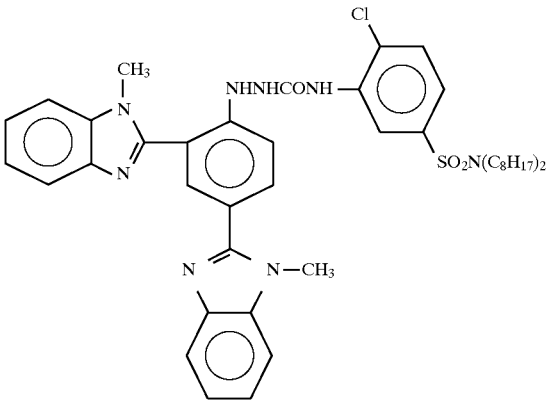

-continued
D-6
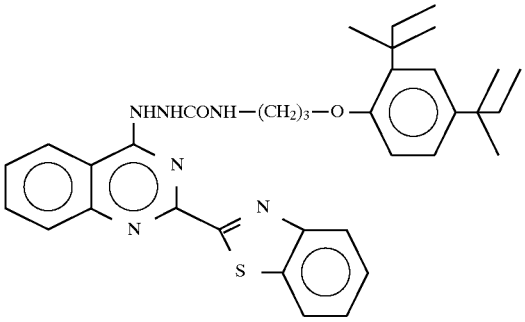
D-7
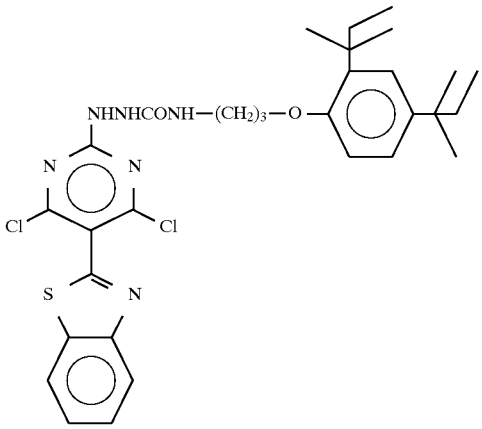
D-8
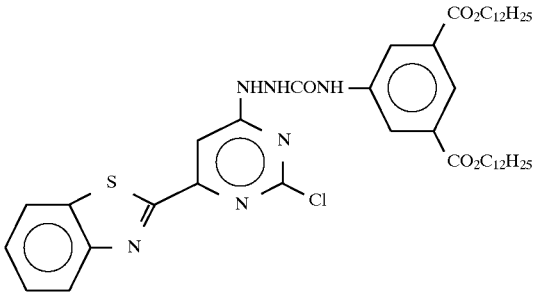
D-9
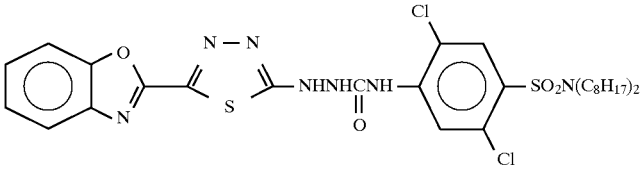
D-10
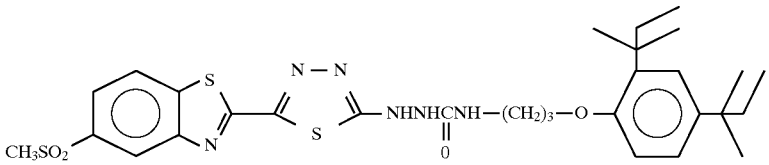
D-11
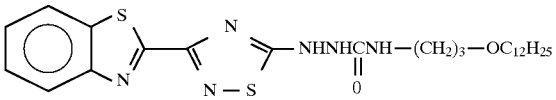

-continued
D-12
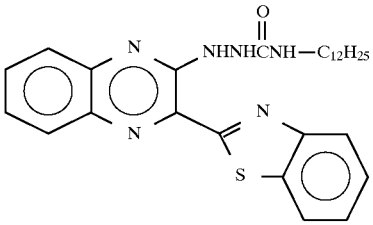
D-13
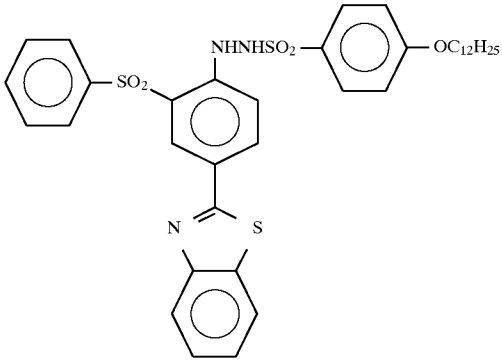
D-14
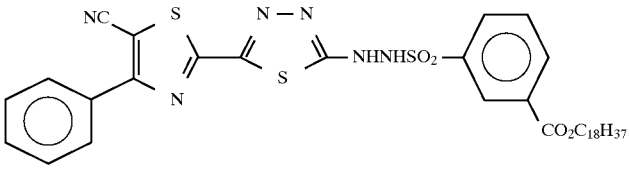
D-15
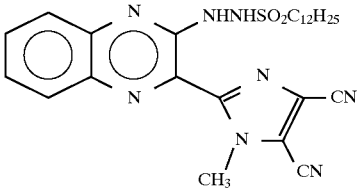
D-16
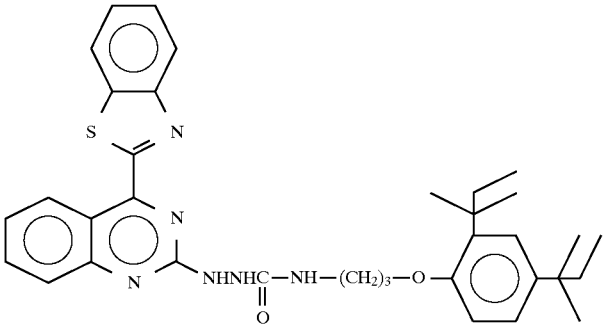
D-17
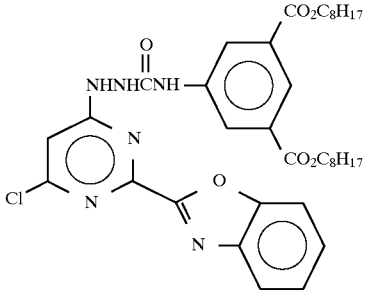

-continued
D-18
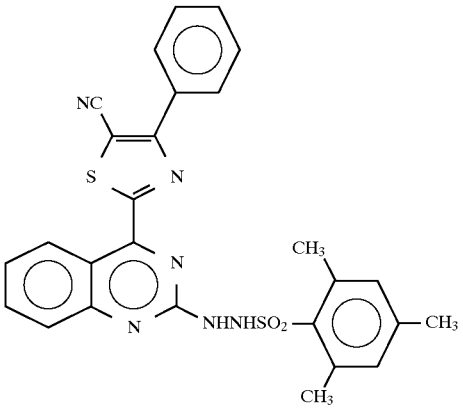
D-19
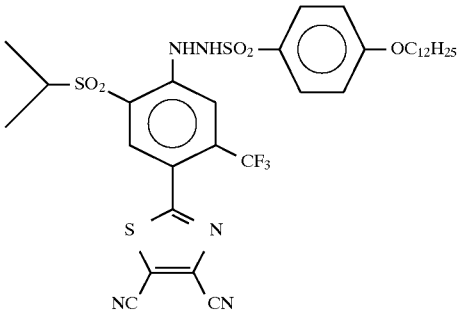
D-20
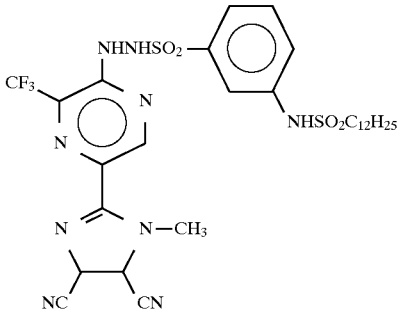
D-21
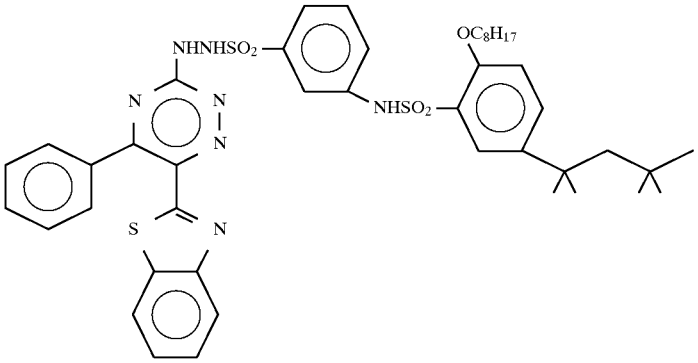

-continued
D-22
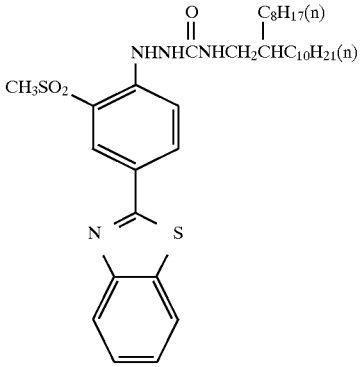
D-23
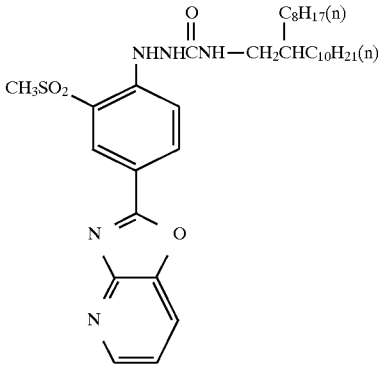
D-24
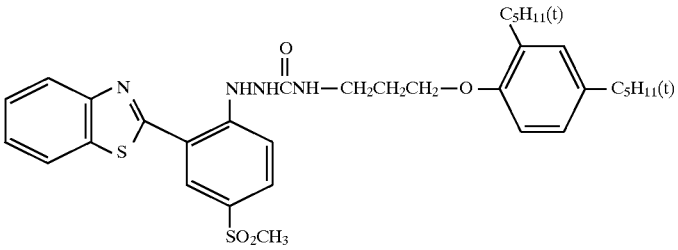
D-25
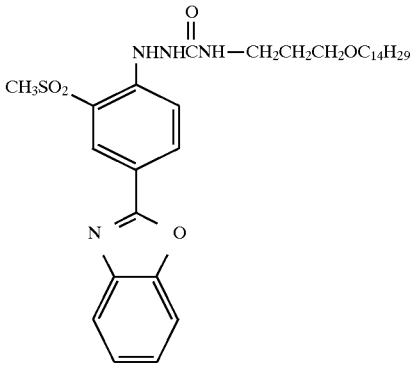

-continued
D-26
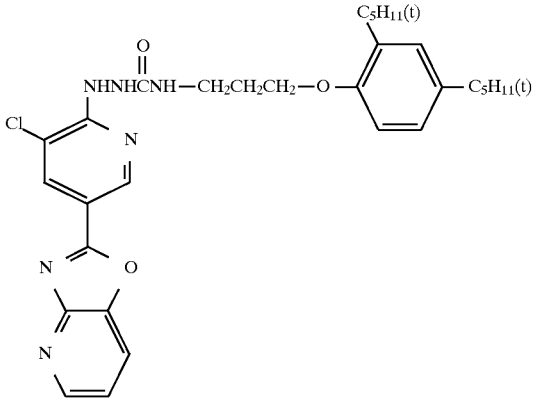
D-27
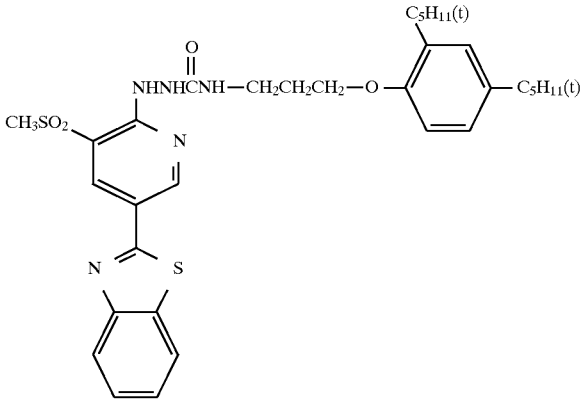
D-28
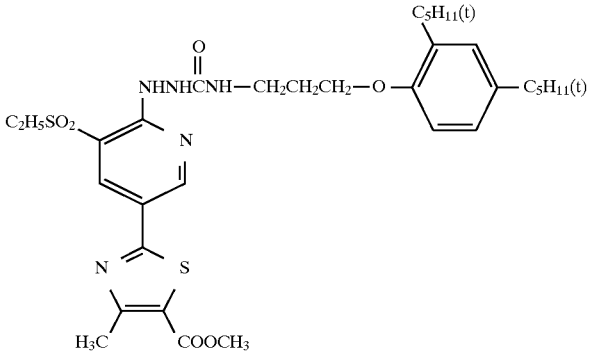
D-29
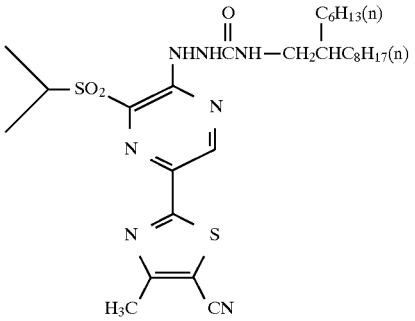
The color-developing agent of the present invention can be synthesized in various ways, and for example it can be synthesized with reference to methods described in JP-A No. 219180/1995 and Japanese patent application Nos. 49287/1995 and 55204/1995.
Typical synthetic examples for compounds used in the present invention will be shown below.

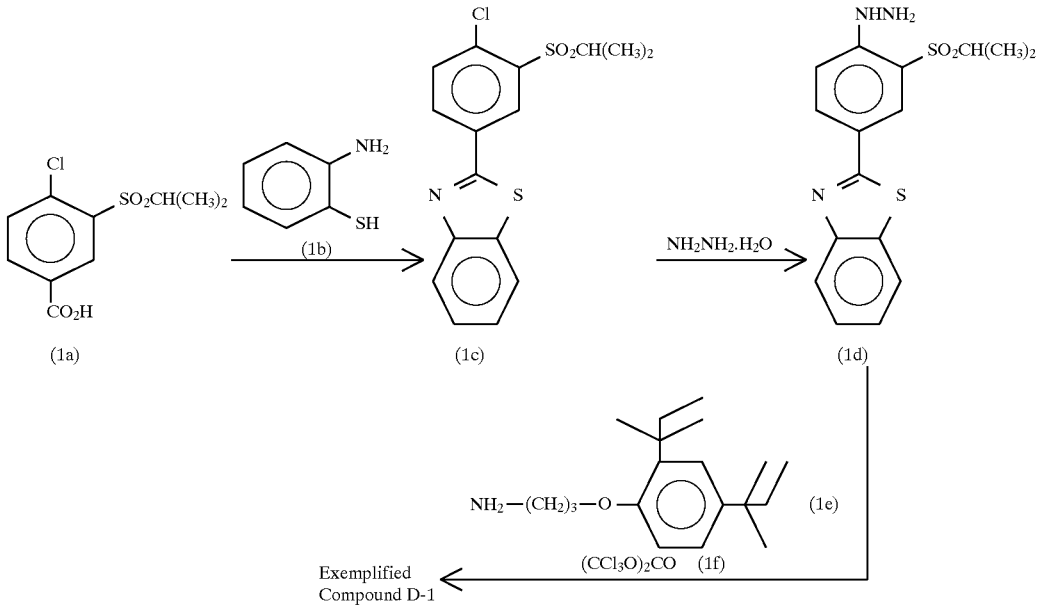

(Synthetic Example) Synthesis of Exemplified Compound D-1

1a (0.10 mol) and 1b (0.11 mol) were mixed in a polyphosphoric acid (80 ml) and were reacted at 100° C. for 3 hours. Thereafter, the reaction mixture was poured into ice water, and the deposited crystals were filtered off, to give crude crystals of 1c, in a yield of 76%.

1c (0.07 mol) was reacted with hydrazine monohydrate (0.35 mol) in 1,4-dioxane (150 ml) under reflux for 8 hours. The solvent was distilled off under reduced pressure; then ethyl acetate (200 ml) was added to the residue, and the resulting mixture was washed with water and condensed, to give a crude product of 1d (in a yield of 96% in terms of the pure product).

Then a solution of 1f (0.025 mol) in tetrahydrofuran (300 ml) was cooled with ice, and then 1e (0.075 mol) and triethylamine (0.15 mol) were added to the solution, and they were reacted for 2 hours. Then all the crude product of1d obtained above was added thereto, and the resultant mixture was allowed to react for 8 hours at room temperature.

Thereafter, to the reaction liquid were added water, ethyl acetate, and 2N hydrochloric acid, and then the aqueous layer was removed. The organic layer was washed with 1N hydrochloric acid and was condensed, to give a crude product of Exemplified Compound D-1. The production of Exemplified Compound D-1 was confirmed by mass spectrometry.

The color-developing agent of the present invention is used together with a compound that can form a dye by oxidation coupling reaction (a coupler). The coupler may be a coupler not substituted or substituted, at a coupling position with the oxidized product of the developing agent, but in the present invention a coupler substituted is preferred. Specific examples of the couplers are described in detail, for example, in "Theory of Photographic Process" (4th Ed., edited by T. H. James, Macmillan, 1977), pages 291 to 334 and 354 to 361, and in JP-A Nos. 12353/1983, 149046/1983, 149047/1983, 11114/1984, 124399/1984, 174835/1984, 231539/1984, 231540/1994, 2951/1985, 14242/1985, 23474/1985, and 66249/1985.

Examples of couplers that are preferably used in the present invention are listed below:

As couplers that are preferably used in the present invention, compounds having structures described by the following formulae (1) to (12) are mentioned. They are compounds collectively generally referred to as active methylenes, pyrazolones, pyrazoloazoles, phenols, naphthols, and pyrrolotriazoles, respectively, which are compounds known in the art.

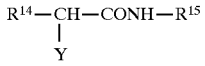

(1)

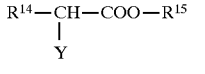

(2)

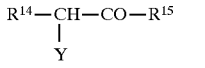

(3)

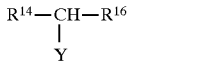

(4)

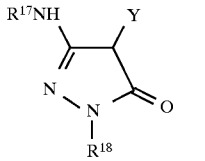

(5)

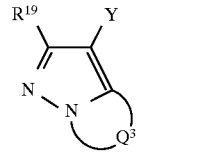

(6)

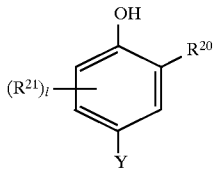

(7)

-continued (8)

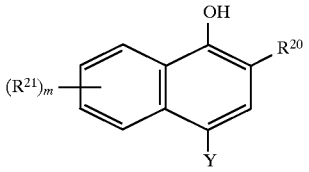

(9)

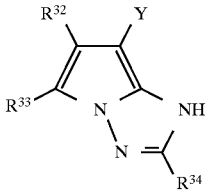

(10)

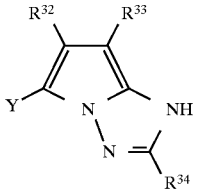

(11)

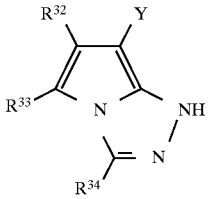

(12)

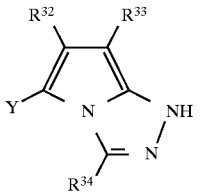

Formulae (1) to (4) represent couplers that are called active methylene-series couplers, and, in the formulae, $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group, optionally substitued.

In formulae (1) to (3), $R^{15}$ represents an optionally substituted alkyl group, aryl group, or heterocyclic residue. In formula (4), $R^{16}$ represents an optionally substituted aryl group or heterocyclic residue. Examples of the substituent that may be possessed by $R^{14}$, $R^{15}$, and $R^{16}$ include those mentioned for $R^6$ and $R^7$.

In formulae (1) to (4), Y represents a hydrogen atom or a group capable of coupling split-off by coupling reaction with the oxidized product of the developing agent. Examples of Y are a heterocyclic group (a saturated or unsaturated 5-membered to 7-membered monocyclic or condensed ring having as a hetero atom at least one nitrogen atom, oxygen atom, sulfur atom, or the like, e.g. succinimido, maleinimido, phthalimido, diglycolimido, pyrrole, pyrazole, imidazole, 1,2,4-triazole, tetrazole, indole, benzopyrazole, benzimidazole, benzotriazole, imidazolin-2,4-dione, oxazolidin-2,4-dione, thiazolidin-2,4-dione, imidazolidin-2-one, oxazolin-2-one, thiazolin-2-one, benzimidazolin-2-one, benzoxazolin-2-one, benzthiazolin-2-one, 2-pyrrolin-5-one, 2-imidazolin-5-one, indolin-2,3-dione, 2,6-dioxypurine, parabic acid, 1,2,4-triazolidin-3,5-dione, 2-pyridone, 4-pyridone, 2-pyrimidone, 6-pyridazone, 2-pyrazone, 2-amino-1,3,4-thiazolidine, and 2-imino-1,3,4-thiazolidin-4-one), a halogen atom (e.g. a chlorine atom and a bromine atom), an aryloxy group (e.g. phenoxy and 1-naphthoxy), a heterocyclic oxy group (e.g. pyridyloxy and pyrazolyloxy), an acyloxy group (e.g. acetoxy and benzoyloxy), an alkoxy group (e.g. methoxy and dodecyloxy), a carbamoyloxy group (e.g. N,N-diethylcarbamoyloxy and morpholinocarbonyloxy), an aryloxycarbonyloxy group (e.g. phenoxycarbonyloxy), an alkoxycarbonyloxy group (e.g. methoxycarbonyloxy and ethoxycarbonyloxy), an arylthio group (e.g. phenylthio and naphthylthio), a heterocyclic thio group (e.g. tetrazolylthio, 1,3,4-thiadiazolylthio, 1,3,4-oxadiazolylthio, and benzimidazolylthio), an alkylthio group (e.g. methylthio, octylthio, and hexadecylthio), an alkylsulfonyloxy group (e.g. methanesulfonyloxy), an arylsulfonyloxy group (e.g. benzenesulfonyloxy and toluenesulfonyloxy), a carbonamido group (e.g. acetamido and trifluoroacetamido), a sulfonamido group (e.g. methanesulfonamido and benzenesulfonamido), an alkylsulfonyl group (e.g. methanesulfonyl), an arylsulfonyl group (e.g. benzenesulfonyl), an alkylsulfinyl group (e.g. methanesulfinyl), an arylsulfinyl group (e.g. benzenesulfinyl), an arylazo group (e.g. phenylazo and naphthylazo), and a carbamoylamino group (e.g. N-methylcarbamoylamino).

Y may be substituted, and examples of the substituent that may be possessed by Y include those mentioned for $R^6$ and $R^7$.

Preferably Y represents a halogen atom, an aryloxy group, a heterocyclic oxy group, an acyloxy group, an aryloxycarbonyloxy group, an alkoxycarbonyloxy group, or a carbamoyloxy group.

In formulae (1) to (4), $R^{14}$ and $R^{15}$, and $R^{14}$ and $R^{16}$, may bond together to form a ring.

Formula (5) represents a coupler that is called a 5-pyrazolone-series coupler, and in the formula, $R^{17}$ represents an alkyl group, an aryl group, an acyl group, or a carbamoyl group. $R^{18}$ represents a phenyl group or a phenyl group that is substituted by one or more halogen atoms, alkyl groups, cyano groups, alkoxy groups, alkoxycarbonyl groups, or acylamino groups.

Preferable 5-pyrazolone-series couplers represented by formula (5) are those wherein $R^{17}$ represents an aryl group or an acyl group, and $R^{18}$ represents a phenyl group that is substituted by one or more halogen atoms.

With respect to these preferable groups, more particularly, $R^{17}$ is an aryl group, such as a phenyl group, a 2-chlorophenyl group, a 2-methoxyphenyl group, a 2-chloro-5-tetradecaneamidophenyl group, a 2-chloro-5-(3-octadecenyl-1-succinimido)phenyl group, a 2-chloro-5-octadecylsulfonamidophenyl group, and a 2-chloro-5-[2-(4-hydroxy-3-t-butylphenoxy)tetradecaneamido]phenyl group; or $R_{17}$ is an acyl group, such as an acetyl group, a 2-(2,4-di-t-pentylphenoxy)butanoyl group, a benzoyl group, and a 3-(2,4-di-t-amylphenoxyacetamido)benzoyl group, any of which may have a substituent, such as a halogen atom or an organic substituent that is bonded through a carbon atom, an oxygen atom, a nitrogen atom, or a sulfur atom. Y has the same meaning as defined above.

Preferably $R^{18}$ represents a substituted phenyl group, such as a 2,4,6-trichlorophenyl group, a 2,5-dichlorophenyl group, and a 2-chlorophenyl group.

Formula (6) represents a coupler that is called a pyrazoloazole-series coupler, and, in the formula, $R^{19}$ represents a hydrogen atom or a substituent. $Q^3$ represents a group of nonmetal atoms required to form a 5-membered azole ring having 2 to 4 nitrogen atoms, which azole ring may have a substituent (including a condensed ring).

Preferable pyrazoloazole-series couplers represented by formula (6), in view of spectral absorption characteristics of the color-formed dyes, are imidazo[1,2-b]pyrazoles described in U.S. Pat. No. 4,500,630, pyrazolo[1,5-b]-1,2,4-triazoles described in U.S. Pat. No. 4,500,654, and pyrazolo[5,1-c]-1,2,4-triazoles described in U.S. Pat. No. 3,725,067.

Details of substituents of the azole rings represented by the substituents $R^{19}$ and $Q^3$ are described, for example, in U.S. Pat. No. 4,540,654, the second column, line 41, to the eighth column, line 27. Preferable pyrazoloazole-series couplers are pyrazoloazole couplers having a branched alkyl group directly bonded to the 2-, 3-, or 6-position of the pyrazolotriazole group, as described in JP-A No. 65245/1986; pyrazoloazole couplers containing a sulfonamido group in the molecule, as described in JP-A No. 65245/1986; pyrazoloazole couplers having an alkoxyphenylsulfonamido ballasting group, as described in JP-A No. 147254/1986; pyrazolotriazole couplers having an alkoxy group or an aryloxy group at the 6-position, as described in JP-A No. 209457/1987 or 307453/1988; and pyrazolotriazole couplers having a carbonamido group in the molecule, as described in Japanese Patent Application No. 22279/1989. Y has the same meaning as defined above.

Formulae (7) and (8) are respectively called phenol-series couplers and naphthol-series couplers, and in the formulae $R^{20}$ represents a hydrogen atom or a group selected from the group consisting of —$CONR^{22}R^{23}$, —$SO_2NR^{22}R^{23}$, —$NHCOR^{22}$, —$NHCONR^{22}R^{23}$, and —$NHSO_2NR^{22}R^{23}$. $R^{22}$ and $R^{23}$ each represent a hydrogen atom or a substituent. In formulae (7) and (8), $R^{21}$ represents a substituent, 1 is an integer selected from 0 to 2, and m is an integer selected from 0 to 4. When 1 and m are 2 or more, $R^{21}$'s may be different. The substituents of $R^{21}$ to $R^{23}$ include those mentioned above as examples for $R^6$ and $R^7$. Y has the same meaning as defined above.

Preferable examples of the phenol-series couplers represented by formula (7) include 2-acylamino-5-alkylphenol couplers described, for example, in U.S. Pat. Nos. 2,369,929, 2,801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West German Patent Publication No. 3,329,729, and JP-A No. 166956/1984; and 2-phenylureido-5-acylaminophenol couplers described, for example, in U.S. Pat. Nos. 3,446,622, 4,333,999, 4,451,559, and 4,427,767. Y has the same meaning as defined above.

Preferable examples of the naphthol-series couplers represented by formula (8) include 2-carbamoyl-1-naphthol couplers described, for example, in U.S. Pat. Nos. 2,474,293, 4,052,212, 4,146,396, 4,282,233, and 4,296,200; and 2-carbamoyl-5-amido-1-naphthol couplers described, for example, in U.S. Pat. No. 4,690,889. Y has the same meaning as defined above.

Formulas (9) to (12) are couplers called pyrrolotriazoles, and $R^{32}$, $R^{33}$, and $R^{34}$ each represent a hydrogen atom or a substituent. Y has the same meaning as defined above. Examples of the substituent of $R^{32}$, $R^{33}$, and $R^{34}$ include those mentioned for $R^6$ and $R^7$. Preferable examples of the pyrrolotriazole-series couplers represented by formulae (9) to (12) include those wherein at least one of $R^{32}$ and $R^{33}$ is an electron-attracting group, which specific couplers are described in European Patent Nos. 488,248A1, 491,197A1, and 545,300. Y has the same meaning as defined above.

Further, a fused-ring phenol, an imidazole, a pyrrole, a 3-hydroxypyridine, an active methylene, an active methine, a 5,5-ring-fused heterocyclic, and a 5,6-ring-fused heterocyclic coupler, can be used.

As the fused-ring phenol-series couplers, those described, for example, in U.S. Pat. Nos. 4,327,173, 4,564,586, and 4,904,575, can be used.

As the imidazole-series couplers, those described, for example, in U.S. Pat. Nos. 4,818,672 and 5,051,347, can be used.

As the 3-hydroxypyridine-series couplers, those described, for example, in JP-A No. 315736/1989, can be used.

As the active methylene-series and active methine-series couplers, those described, for example, in U.S. Pat. Nos. 5,104,783 and 5,162,196, can be used.

As the 5,5-ring-fused heterocyclic-series couplers, for example, pyrrolopyrazole-series couplers described in U.S. Pat. No. 5,164,289, and pyrroloimidazole-series couplers described in JP-A No. 174429/1992, can be used.

As the 5,6-ring-fused heterocyclic-series couplers, for example, pyrazolopyrimidine-series couplers described in U.S. Pat. No. 4,950,585, pyrrolotriazine-series couplers described in JP-A No. 204730/1992, and couplers described in European Patent No. 556,700, can be used.

In the present invention, in addition to the above couplers, use can be made of couplers described, for example, in West German Patent Nos. 3,819,051A and 3,823,049, U.S. Pat. Nos. 4,840,883, 5,024,930, 5,051,347, and 4,481,268, European Patent Nos. 304,856A2, 329,036, 354,549A2, 374,781A2, 379,110A2, and 386,930A1, and JP-A Nos. 141055/1988, 32260/1989, 32261/1989, 297547/1990, 44340/1990, 110555/1990, 7938/1991, 160440/1991, 172839/1991, 172447/1992, 179949/1992, 182645/1992, 184437/1992, 188138/1992, 188139/1992, 194847/1992, 204532/1992, 204731/1992, and 204732/1992.

Specific examples of the couplers that can be used in the present invention are shown below, but, of course, the present invention is not limited to them:

(C-1)

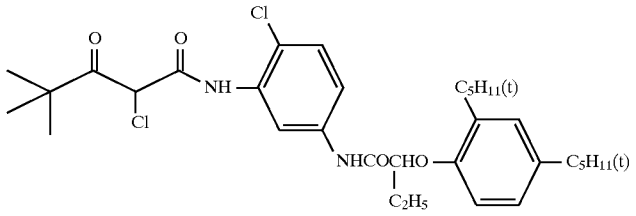

-continued
(C-2)
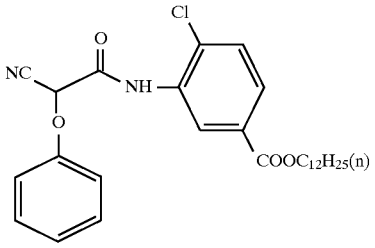
(C-3)
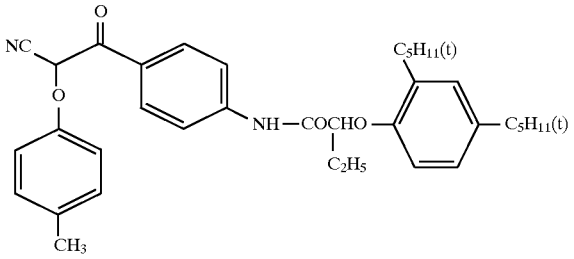
(C-4)
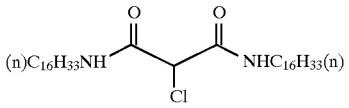
(C-5)
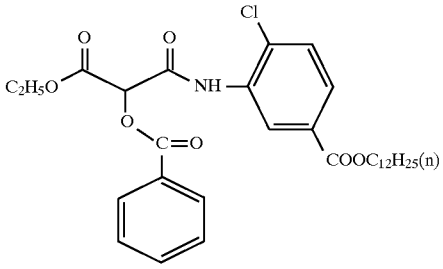
(C-6)
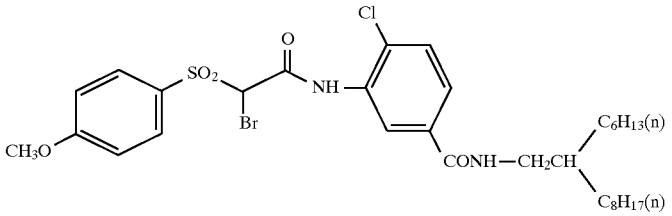
(C-7)
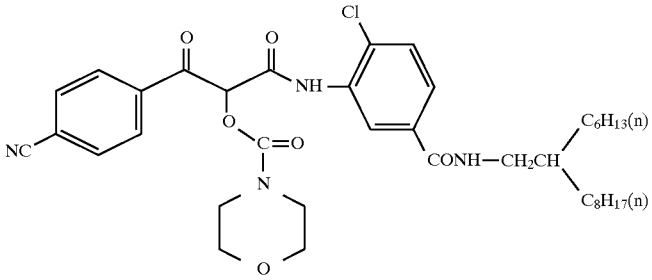

-continued
(C-8)
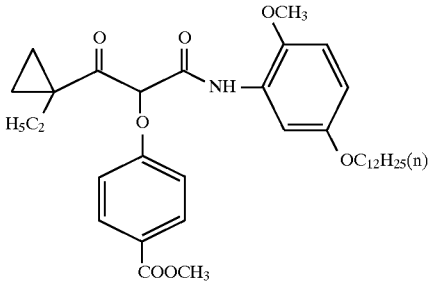
(C-9)
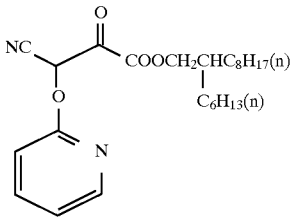
(C-10)
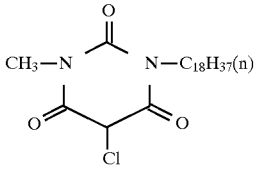
(C-11)
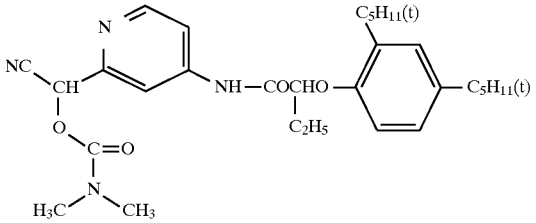
(C-12)
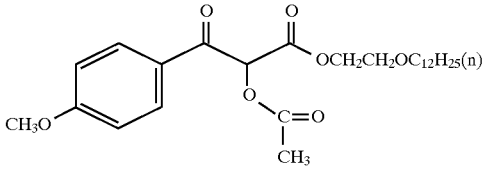
(C-13)
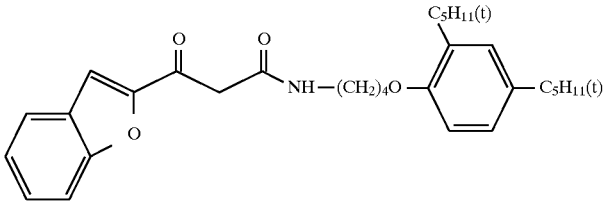
(C-14)
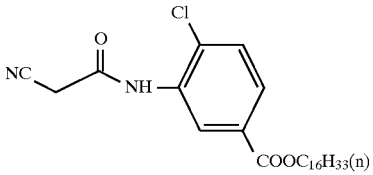

-continued
(C-15)
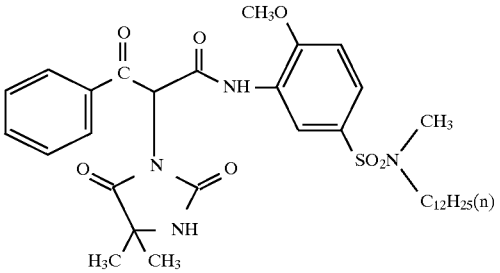
(C-16)
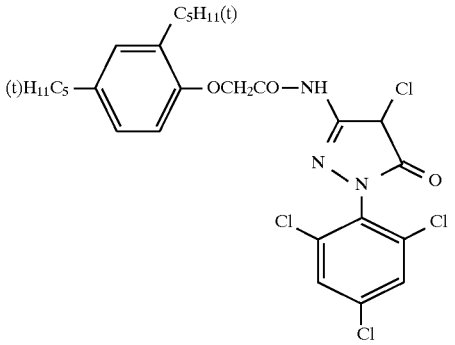
(C-17)
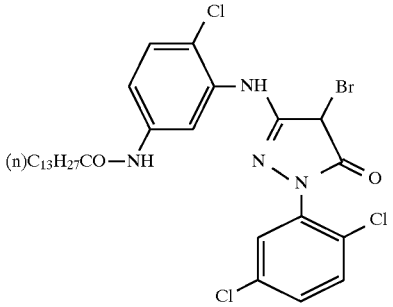
(C-18)
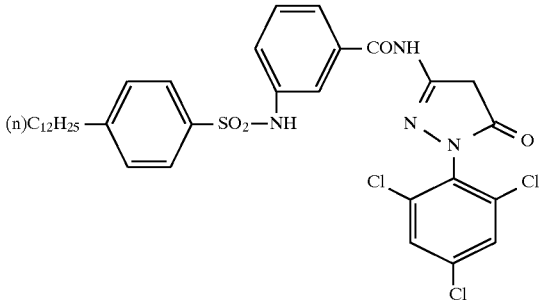
(C-19)
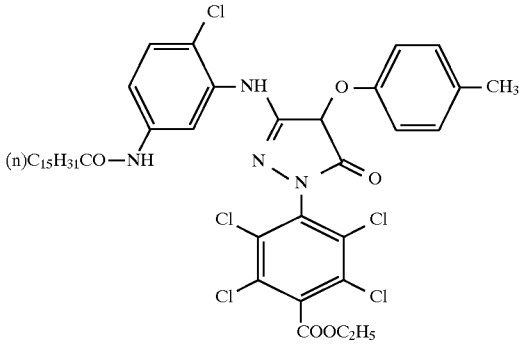

-continued
(C-20)
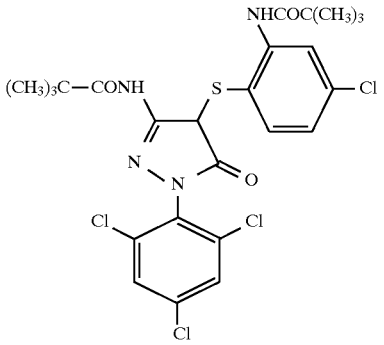
(C-21)
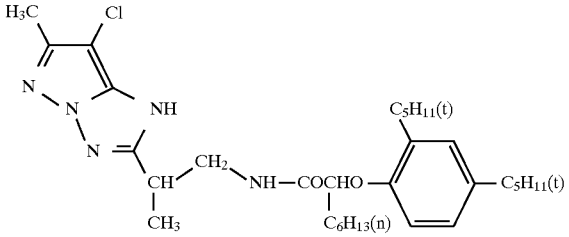
(C-22)
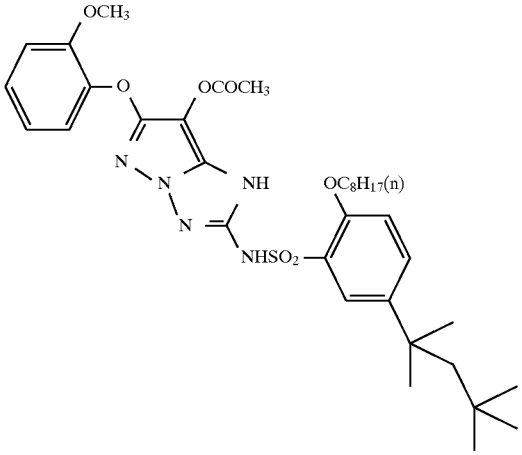
(C-23)
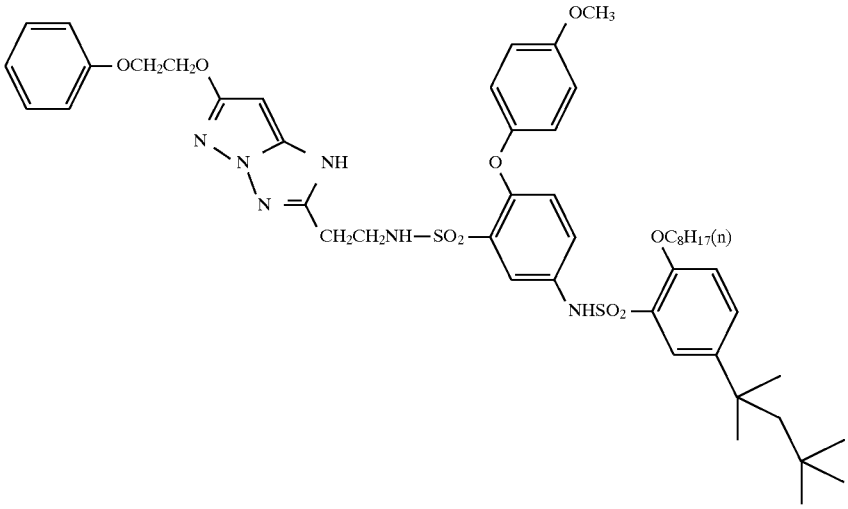

-continued
(C-24)
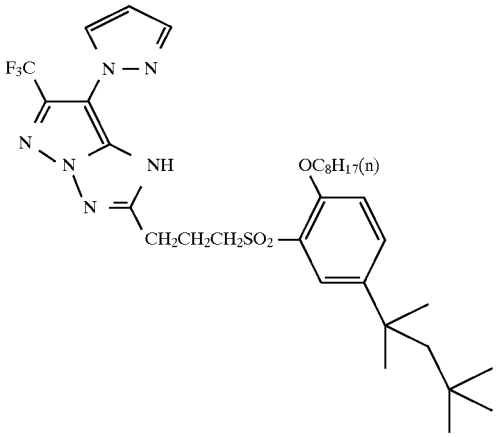
(C-25)
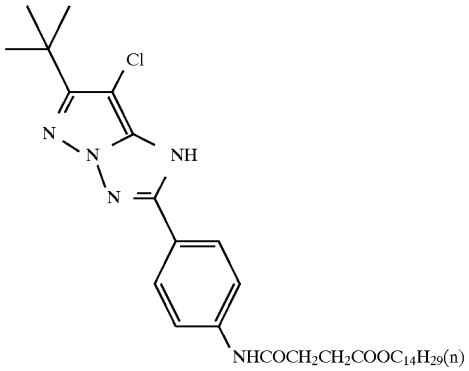
(C-26)
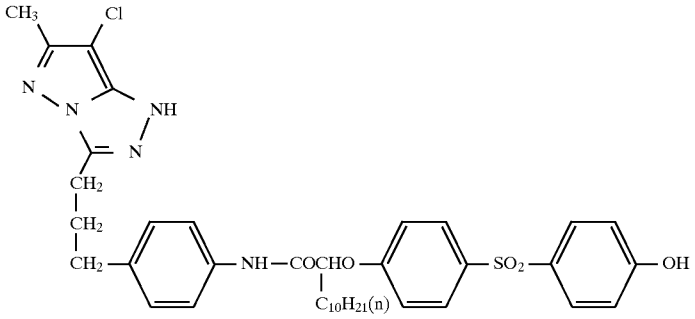

-continued
(C-27)
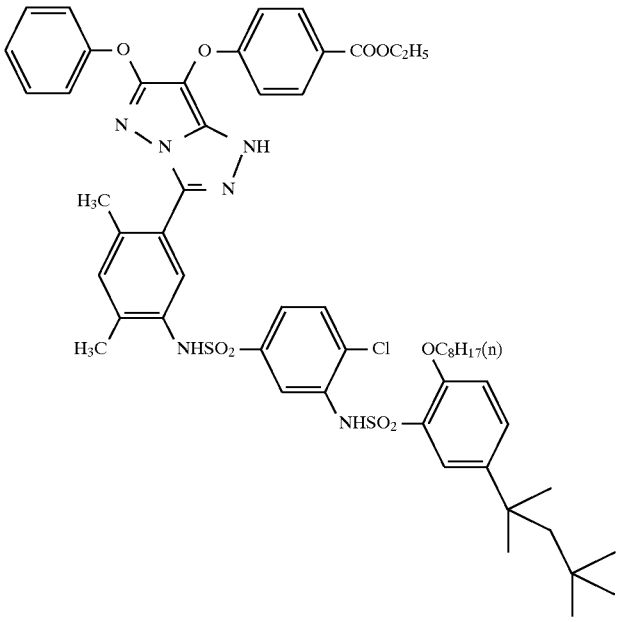
(C-28)
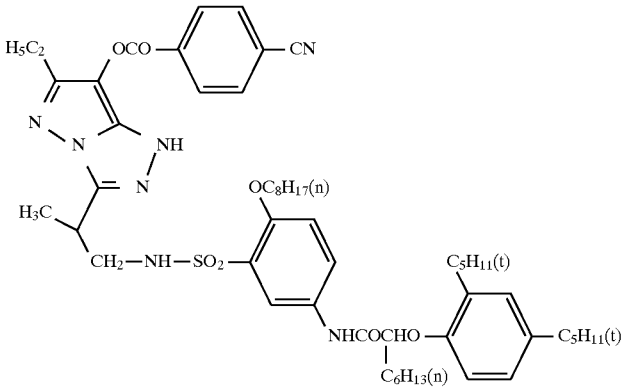
(C-29)
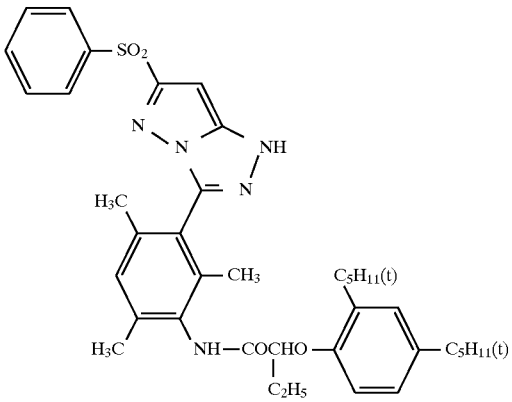

-continued
(C-30)
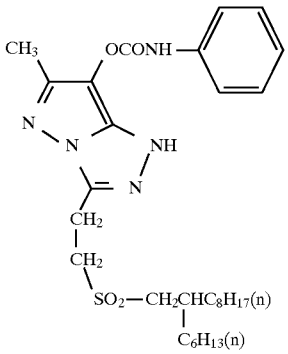
(C-31)
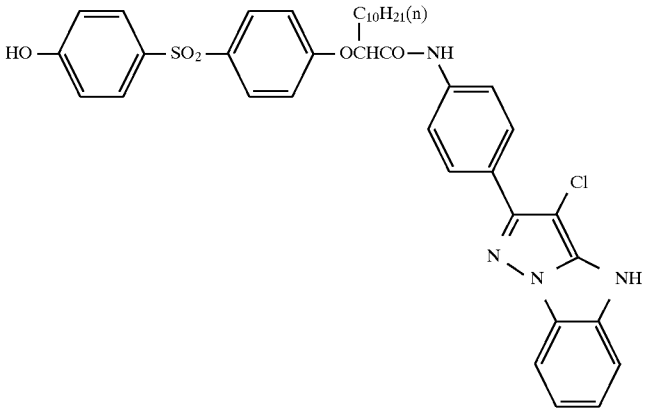
(C-32)
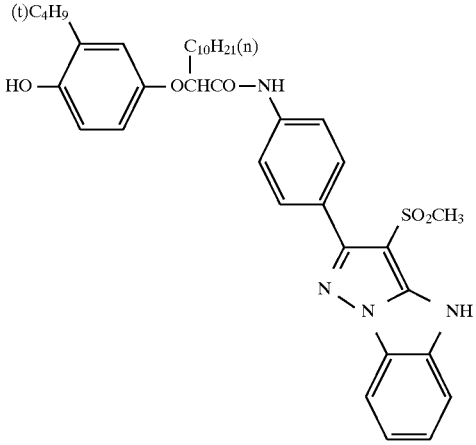
(C-33)
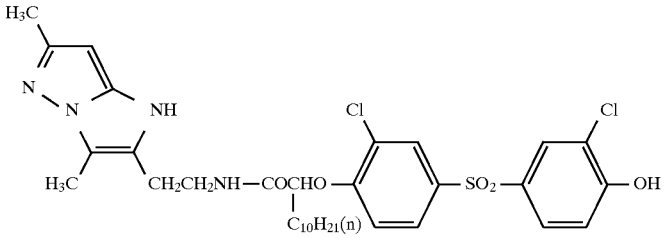

-continued
(C-34)
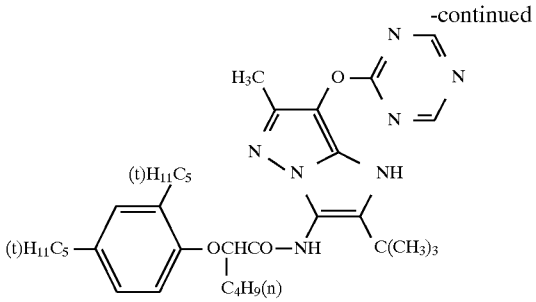
(C-35)
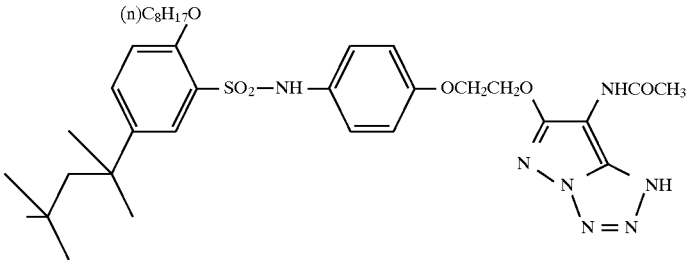
(C-36)
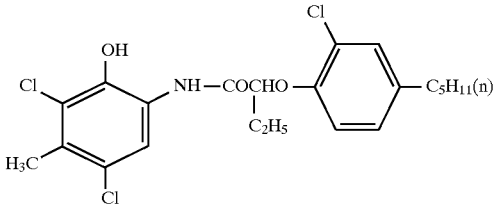
(C-37)
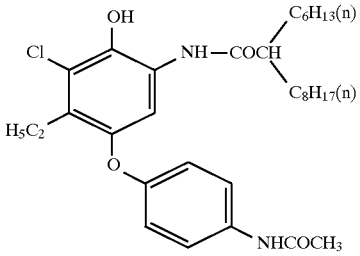
(C-38)
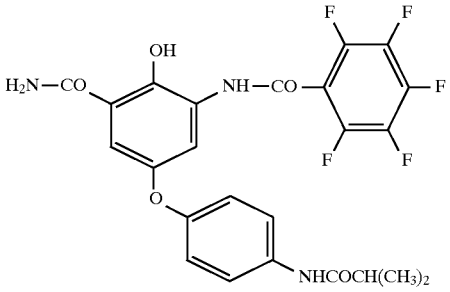
(C-39)
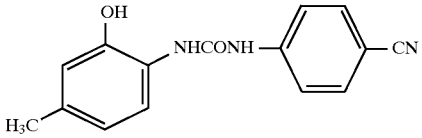
(C-40)
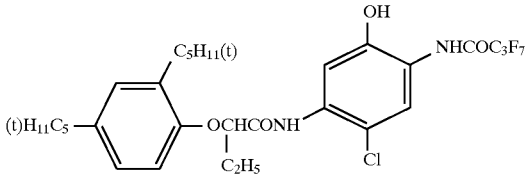

-continued
(C-41)
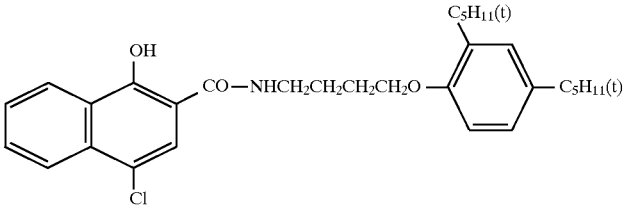
(C-42)
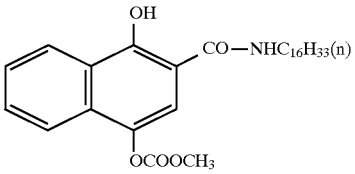
(C-43)
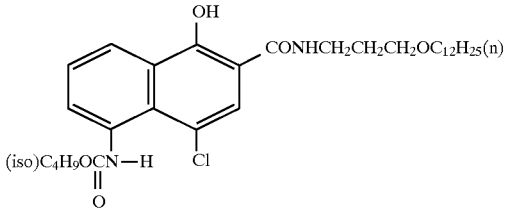
(C-44)
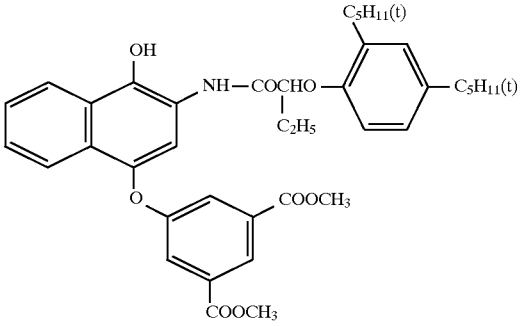
(C-45)
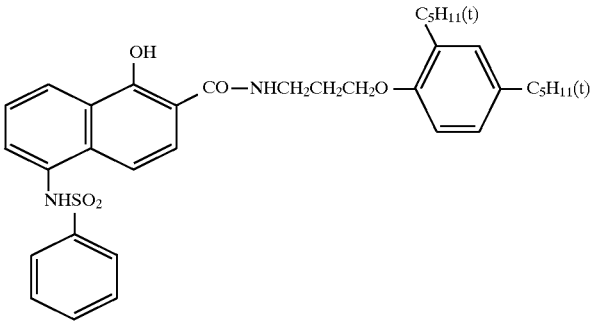

-continued
(C-46)
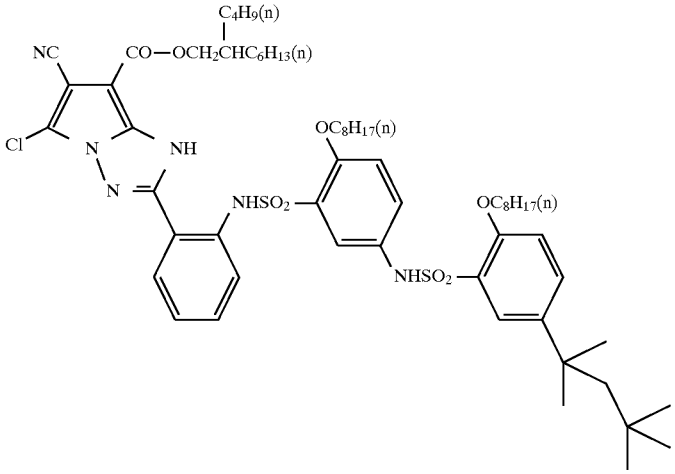
(C-47)
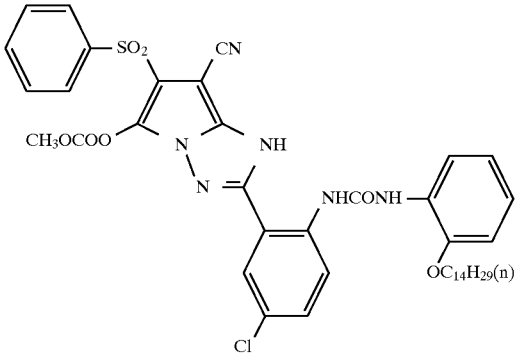
(C-48)
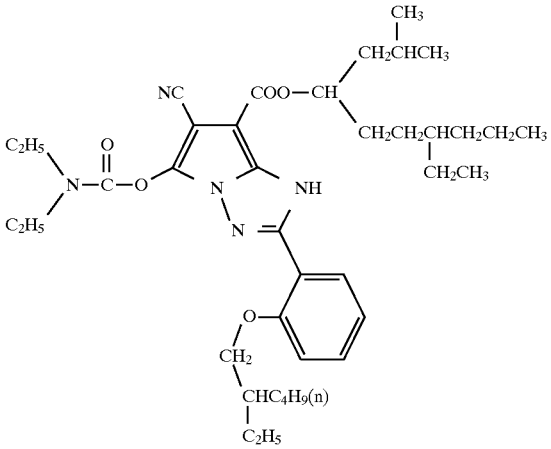
(C-49)
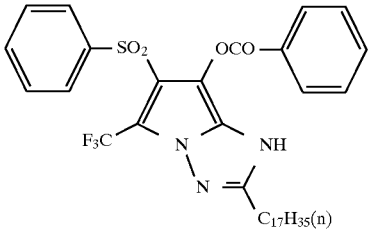

-continued
(C-50)
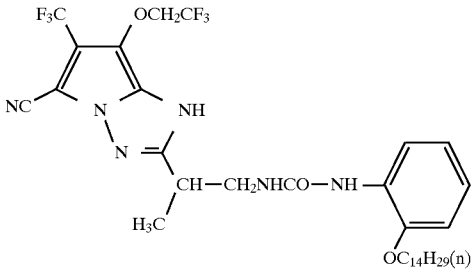
(C-51)
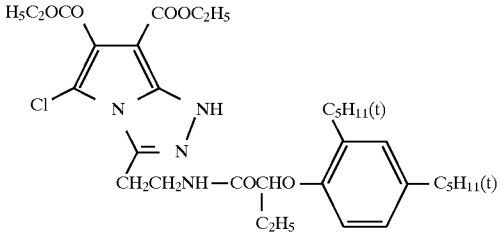
(C-52)
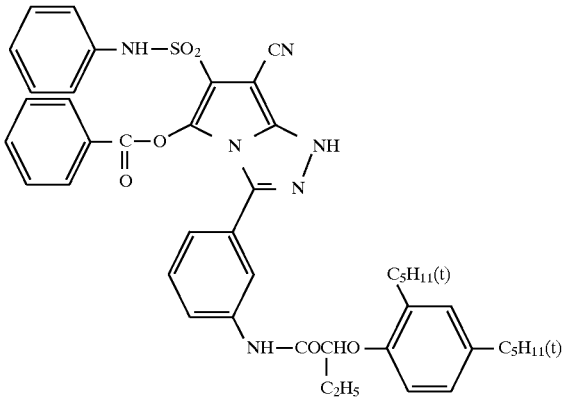
(C-53)
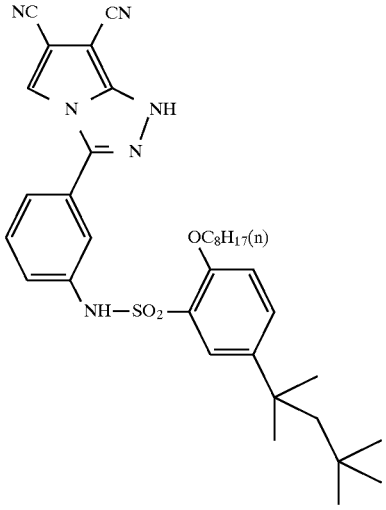

-continued
(C-54)
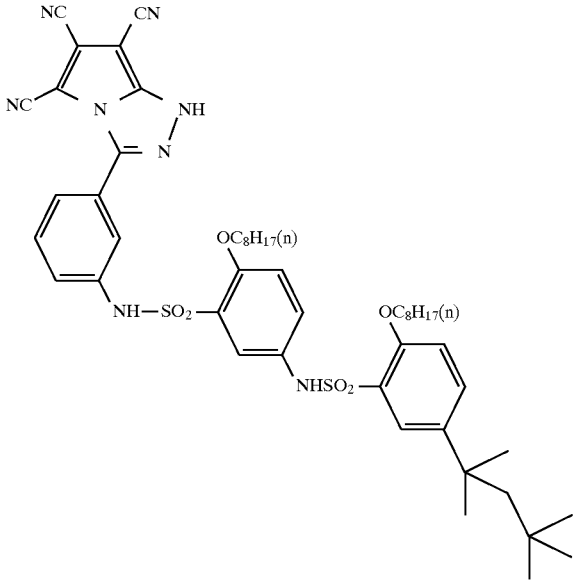
(C-55)
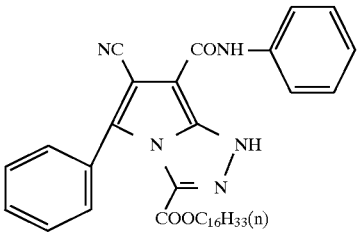
(C-56)
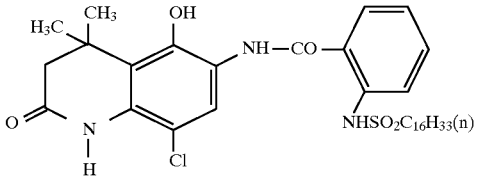
(C-57)
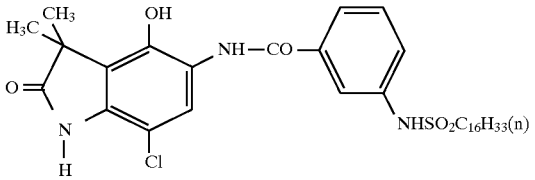
(C-58)
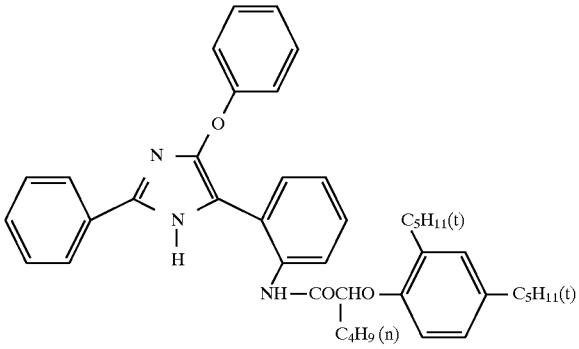

-continued
(C-59)
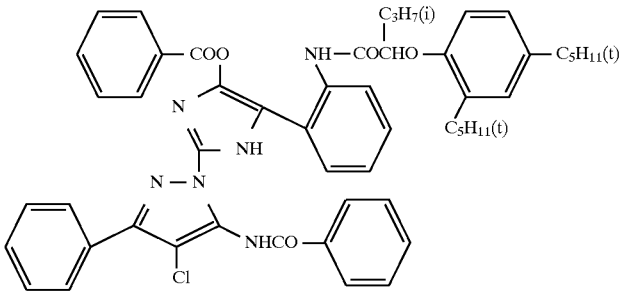
(C-60)
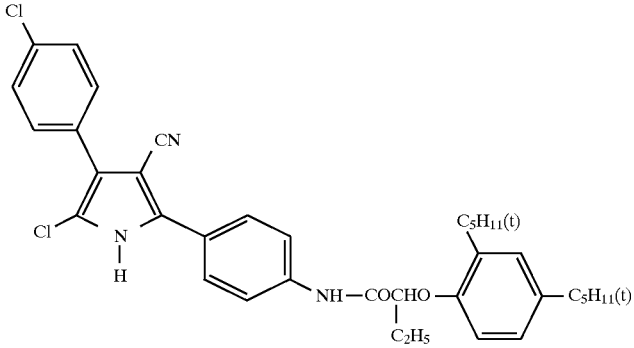
(C-61)
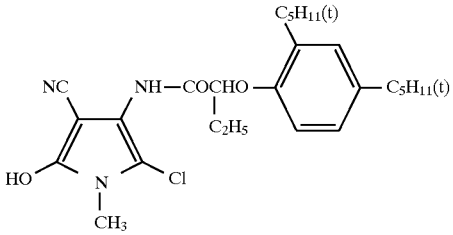
(C-62)
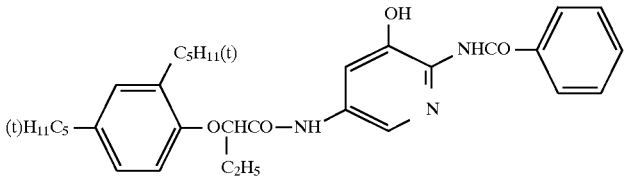
(C-63)
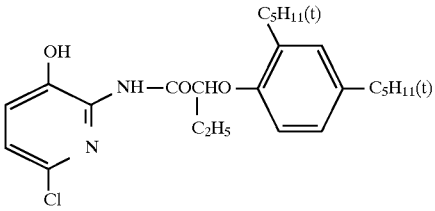
(C-64)
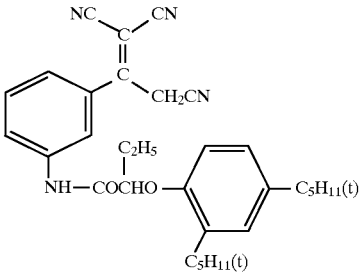

-continued
(C-65)
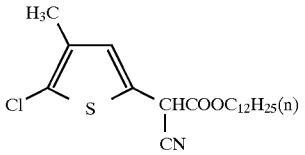
(C-66)
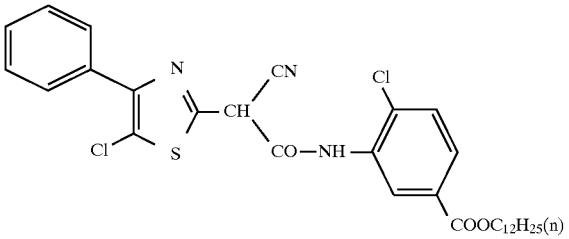
(C-67)
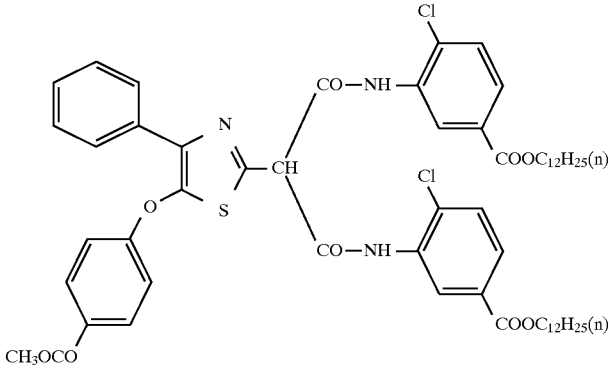
(C-68)
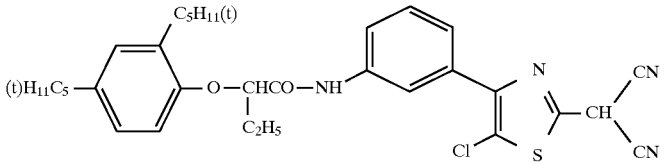
(C-69)
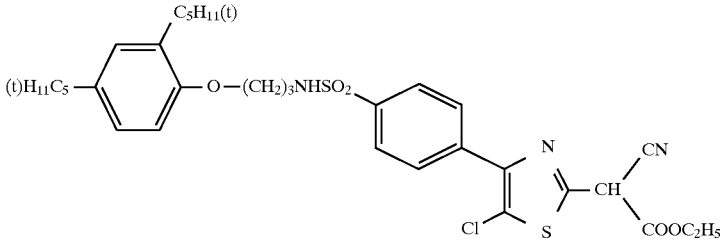
(C-70)
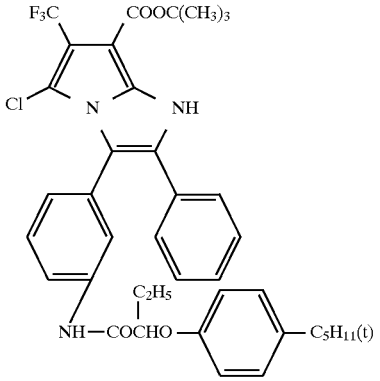

-continued
(C-71)
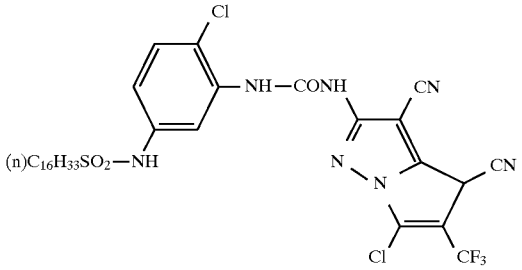
(C-72)
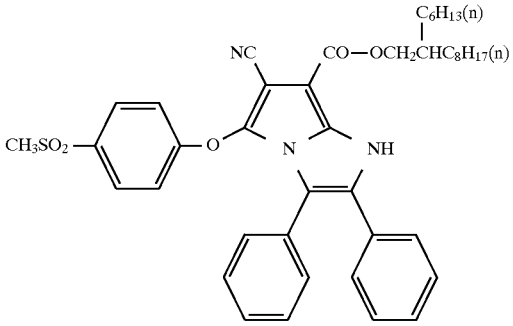
(C-73)
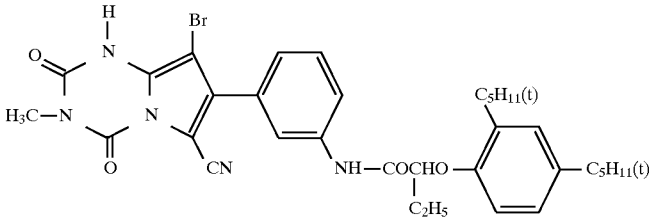
(C-74)
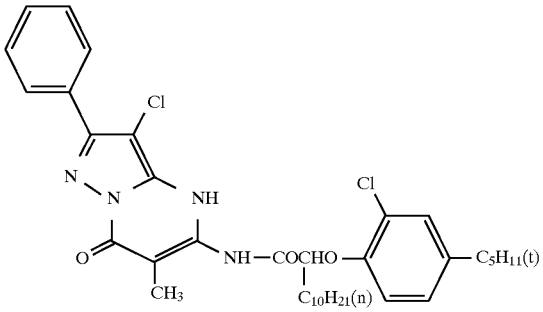
(C-75)
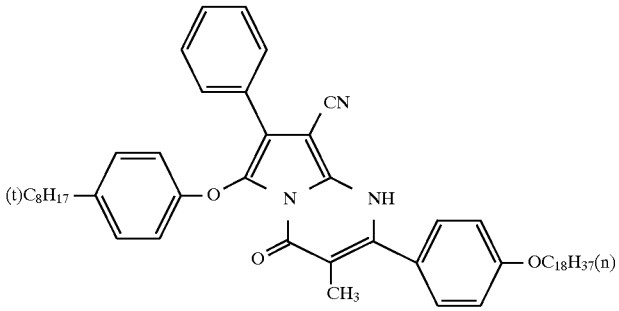
(C-76)
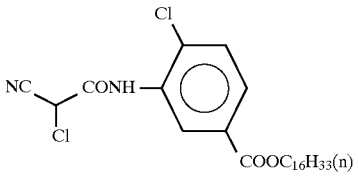

-continued
(C-77)
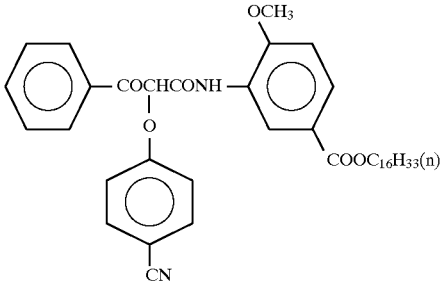
(C-78)
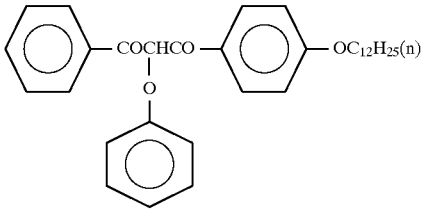
(C-79)
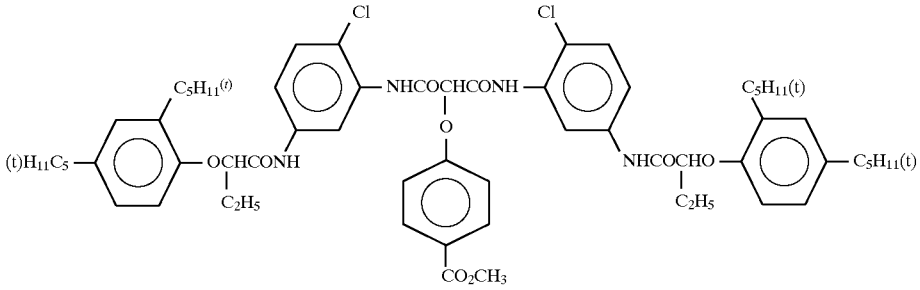
(C-80)
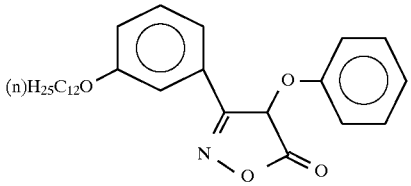
(C-81)
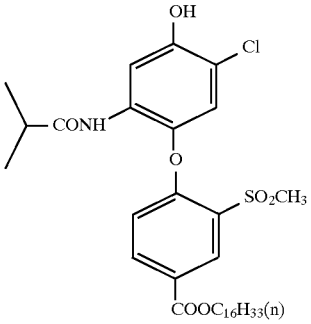
(C-82)
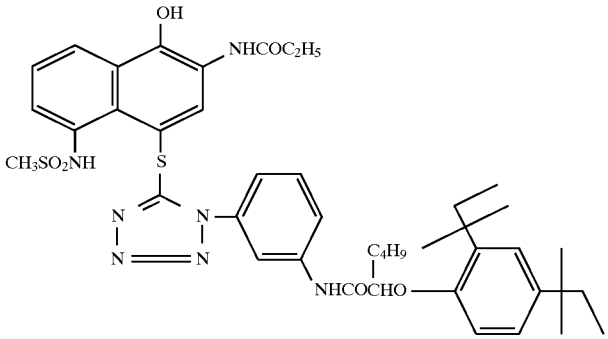

Now, examples in which dyes were synthesized from color-developing agents of the present invention, and couplers are described.

DYE SYNTHESIS EXAMPLES

(Dye Synthesis Example 1)

6.3 g of Coupler C-81, and 6.5 g of D-22, which was a compound according to the present invention, were suspended in 100 ml of acetonitrile at room temperature, and after 7.0 ml of diisopropylethylamine was added, 30 g of silver oxide was added, followed by stirring for 2 hours. After the completion of the reaction, the reaction mixture was filtered through Celite (trade name), to remove inorganic matter, and 200 ml of water and 200 ml of ethyl acetate were added, to carry out extraction. The organic phase was concentrated under reduced pressure, and the concentrate was purified through silica gel chromatography and was crystallized from a mixed solvent of dimethylformamide and methanol. The resulting dye (Dye 1) was dissolved in diemthylformamide, and the visible absorption spectrum was measured.

λmax 569.2 nm

(Dye Synthesis Example 2)

Dye 5 was synthesized in the same manner as described in Dye Synthesis Example 1, except that Coupler C-82 and a compound according to the present invention (D-22) were used.

λmax 648.9 nm

(Dye Synthesis Example 3)

Dye 6 was synthesized in the same manner as described in Dye Synthesis Example 1, except that Coupler C-82 and a compound according to the present invention (D-23) were used.

λmax 649.2 nm

(Dye Synthesis Example 4)

Dye 7 was synthesized in the same manner as described in Dye Synthesis Example 1, except that Coupler C-82 and a compound according to the present invention (D-24) were used.

λmax 639.1 nm

(Dye Synthesis Example 5)

Dye 8 was synthesized in the same manner as described in Dye Synthesis Example 1, except that Coupler C-82 and a compound according to the present invention (D-25) were used.

λmax 649.2 nm

Dye 1

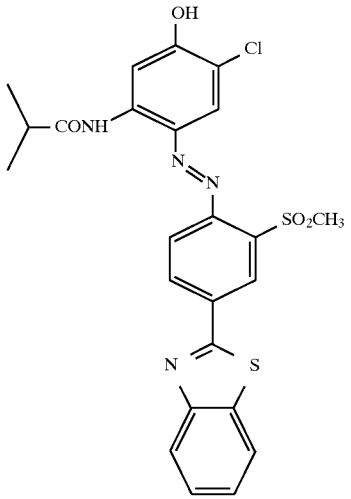

Dye 2

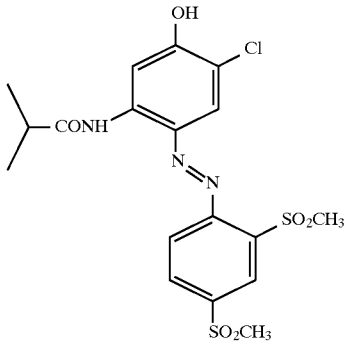

Dye 3

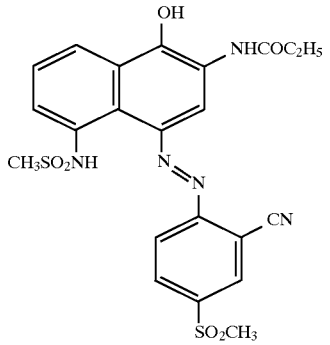

-continued

Dye 4

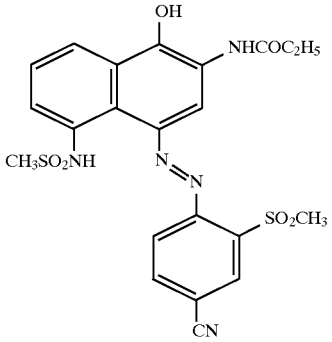

Dye 5

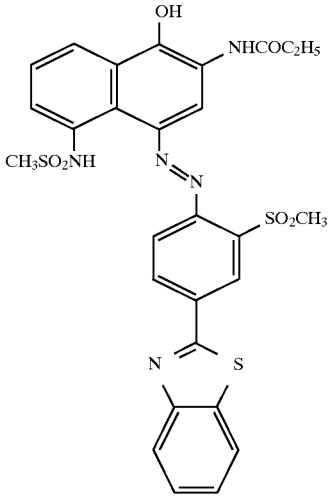

Dye 6

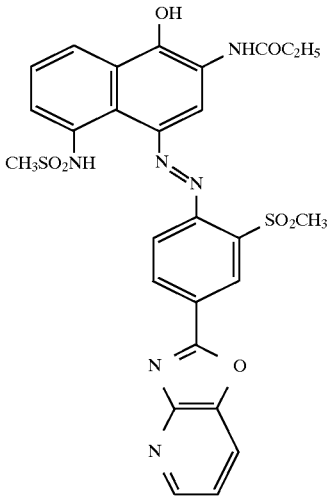

Dye 7

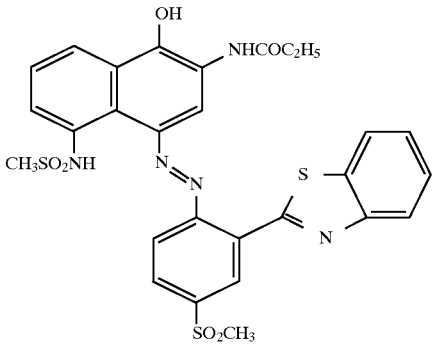

-continued

Dye 8

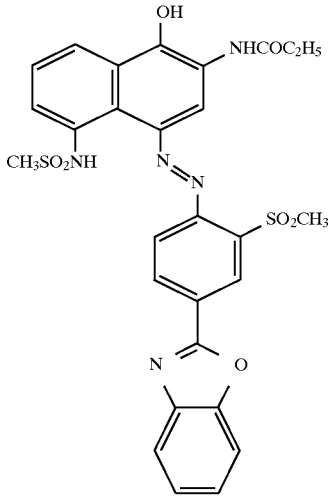

The data (λmax) are shown below:

| Comparative Example | | Present Invention | |
|---|---|---|---|
| Dye 2 | 527.0 nm | Dye 1 | 569.2 nm |
| Dye 4 | 612.6 nm | Dye 5 | 648.9 nm |
| Dye 4 | 612.6 nm | Dye 6 | 649.2 nm |
| Dye 4 | 612.6 nm | Dye 8 | 642.9 nm |
| Dye 3 | 611.9 nm | Dye 7 | 639.1 nm |

In comparison with the case in which a cyano group and a methanesulfonyl group are used, which are known to have a large effect of making the wavelength of λmax longer, the dyes according to the present invention are found to have a quite large effect of making the wavelength of λmax longer, which lengthening effect is on the order of 30 nm. It is also understood that Dyes 5, 6, 7, and 8 have absorption in quite preferable wavelength regions as cyan dyes.

The amount to be added, of the couplers that are used in the present invention, varies according to its molar extinction coefficient (ϵ). In order to obtain an image density of 1.0 or more in terms of reflection density, in the case of couplers wherein the ϵ of the dye that will be produced by coupling is of the order of 5,000 to 500,000, suitably the amount to be added of the couplers is of the order of generally 0.001 to 100 mmol/$m^2$, preferably 0.01 to 10 mmol/$m^2$, and more preferably 0.05 to 5 mmol/$m^2$, in terms of the coated amount.

When the color-developing agent of the present invention is to be contained in a light-seisitive material, it may be contained in any layer (e.g. an emulsion layer and an intermediate layer), and preferably it is contained in an emulsion layer. If there are multiple emulsion layers, preferably the color-developing agent is contained in each of the emulsion layers.

The amount of the color-developing agent of the present invention to be added (mol) is generally 0.01 to 100 times, preferably 0.1 to 10 times, and more preferably 0.2 to 5 times, the amount of the coupler (mol).

The color-developing agent of the present invention can be contained in, instead of a photographic material, a processing solution. In this case, preferably the amount is 0.1 g to 100 g, and more preferably 1 g to 20 g, per liter.

In the present invention, an auxiliary developing agent is preferably used. Herein the term "an auxiliary developing agent" means a substance that promotes the transfer of electrons from the color-developing agent to silver halides in the development process of the silver halide development; and in the present invention, preferably the auxiliary developing agent is a compound capable of releasing electrons according to the Kendall-Pelz rule, which compound is represented preferably by formula (B-1) or (B-2). Among these, the auxiliary developing agent represented by formula (B-1) is particularly preferable.

Formula (B-1)

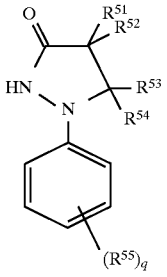

Formula (B-2)

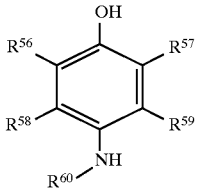

In formulae (B-1) and (B-2), $R^{51}$ to $R^{54}$ each represent a hydrogen atom, an alkyl group, a cycloalkyl group, an alkenyl group, an aryl group, or a heterocyclic group.

$R^{55}$ to $R^{59}$ each represent a hydrogen atom, a halogen atom, a cyano group, an alkyl group, a cycloalkyl group, an alkenyl group, an aryl group, a heterocyclic group, an alkoxy group, a cycloalkyloxy group, an aryloxy group, a heterocyclic oxy group, a silyloxy group, an acyloxy group, an amino group, an anilino group, a heterocyclic amino group, an alkylthio group, an arylthio group, a heterocyclic thio group, a silyl group, a hydroxyl group, a nitro group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, a carbonamido group, a ureido group, an imido group, an alkoxycarbonylamino group, an aryloxycarbonylamino group, a sulfonamido group, a sulfamoylamino group, an alkylsulfinyl group, an arenesulfinyl group, an alkanesulfonyl group, an arenesulfonyl group, a sulfamoyl group, a sulfo group, a phosphinoyl group, or a phosphinoylamino group.

q is an integer of 0 to 5, and when q is 2 or more, $R^{55}$'s may be different. $R^{60}$ represents an alkyl group or an aryl group.

Compounds represented by formula (B-1) or (B-2) are shown specifically below, but the auxiliary developing agent used in the present invention is not limited to these specific examples.

(ETA-1)

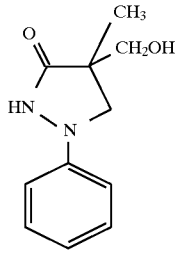

(ETA-2)

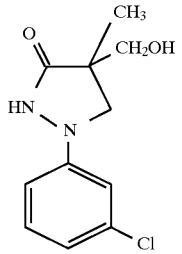

(ETA-3)

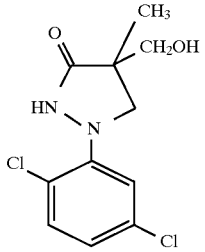

(ETA-4)

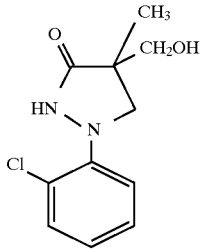

(ETA-5)

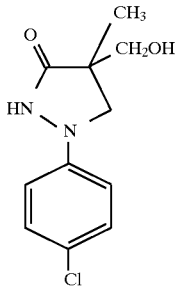

(ETA-6)

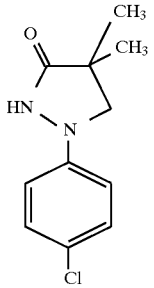

-continued
(ETA-7)
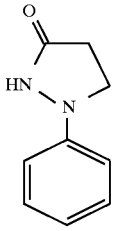
(ETA-8)
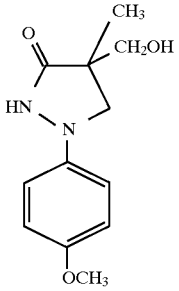
(ETA-9)
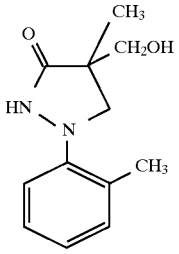
(ETA-10)
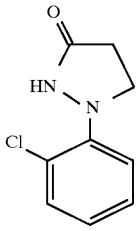
(ETA-11)
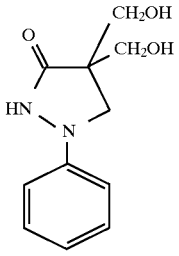
(ETA-12)
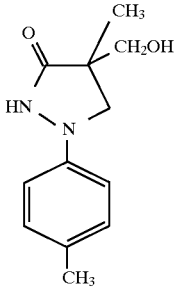
-continued
(ETA-13)
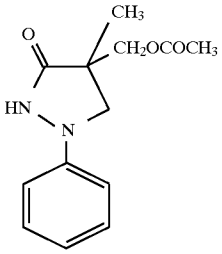
(ETA-14)
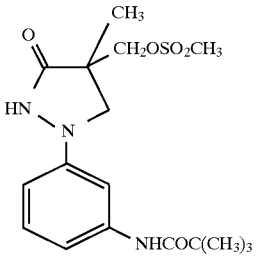
(ETA-15)
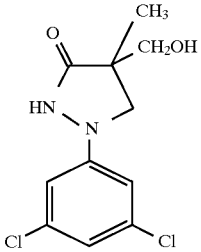
(ETA-16)
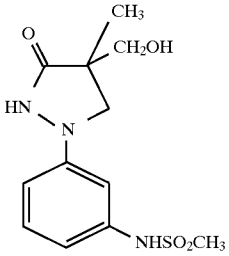
(ETA-17)
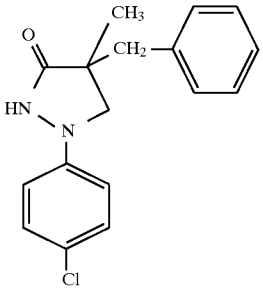
(ETA-18)
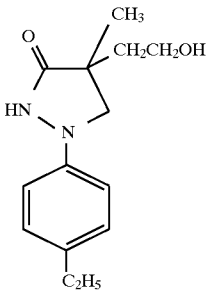

-continued
(ETA-19)
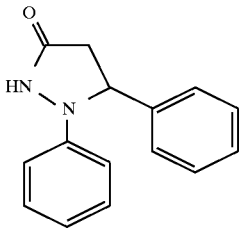
(ETA-20)
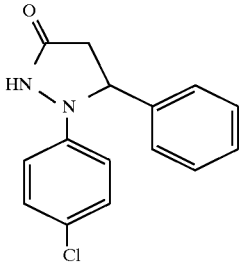
(ETA-21)
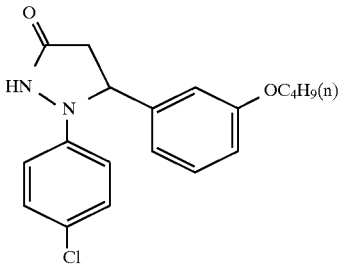
(ETA-22)
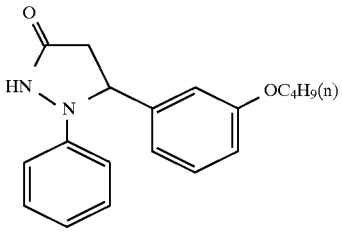
(ETA-23)
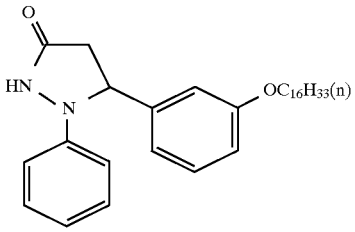
(ETA-24)
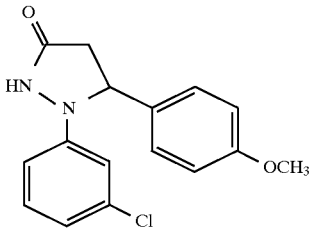
-continued
(ETA-25)
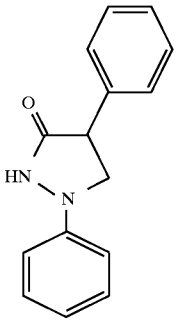
(ETA-26)
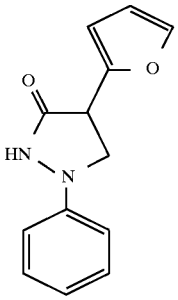
(ETA-27)
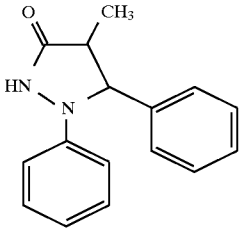
(ETA-28)
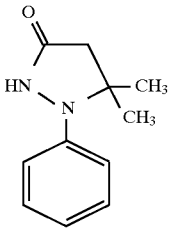
(ETA-29)
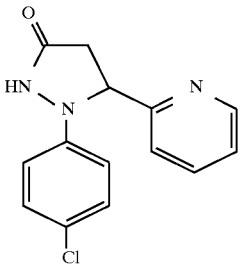
(ETA-30)
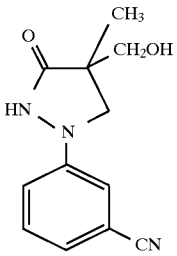

-continued (ETA-31)

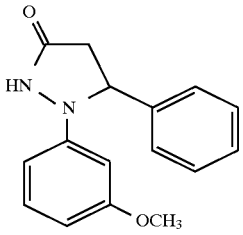

(ETA-32)

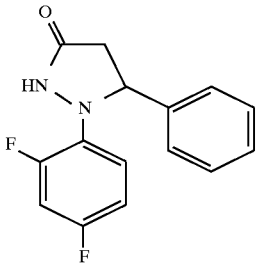

(ETA-33)

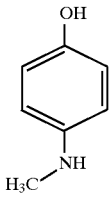

(ETA-34)

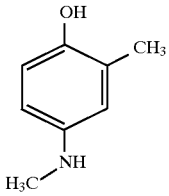

(ETA-35)

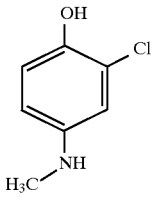

(ETA-36)

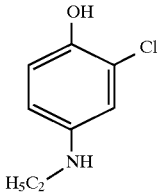

In the present invention, the auxiliary developing agent may be contained in any of the layers of the light-sensitive material, as same as the color-developing agent. If the auxiliary developing agent is added in the form of an emulsion, preferably it is contained in the same layer as the color-developing agent, or in the layer adjacent to that layer. If the auxiliary developing agent is contained in the form of fine solid particles, preferably it is contained in a layer wherein the color-developing agent is not contained. The form of the auxiliary developing agent that may be added is preferably a dispersion of fine solid particles. The auxiliary developing agent may be contained in a processing solution, such as a developing solution.

Preferably the amount of the auxiliary developing agent that will be added is 0.01 to 200 mol %, more preferably 0.1 to 100 mol %, and most preferably 1 to 50 mol %, based on the content of the color-developing agent.

In the present invention, a blocked photographic reagent, represented by formula (A), that will release a photographically useful group at the time of processing, can be used. Formula (A):

$$A\text{-}(L)_n\text{-}PUG$$

A represents a blocking group whose bond to $(L)_n$-PUG will be split off at the time of development processing; L represents a linking group whose right bond (in the above formula (A)) will be split off after the bond on the left of L is split off; n is an integer of 0 to 3; and PUG represents a photographically useful group.

Groups represented by formula (A) will now be described.

As the blocking group represented by A, the following already known groups can be used: blocking groups described, for example, in JP-B No. 9968/1973, JP-A Nos. 8828/1977 and 82834/1982, U.S. Pat. No. 3,311,476, and JP-B No. 44805/1972 (U.S. Pat. No. 3,615,617), such as an acyl group and a sulfonyl group; blocking groups that use the reverse Michael reaction, as described, for example, in JP-B Nos. 17369/1980 (U.S. Pat. No. 3,888,677), 9696/1980 (U.S. Pat. No. 3,791,830), and 34927/1980 (U.S. Pat. No. 4,009,029), and JP-A Nos. 77842/1981 (U.S. Pat. No. 4,307,175), 105640/1984, 105641/1984, and 105642/1984; blocking groups that use the formation of quinone methide, or a compound similar to quinone methide, by intramolecular electron transfer, as described, for example, in JP-B No. 39727/1979, U.S. Pat. Nos. 3,674,478, 3,932,480, and 3,993,661, and JP-A Nos. 135944/1982, 135,945/1982 (U.S. Pat. No. 4,420,554), 136640/1982, 196239/1986, 196240/1986 (U.S. Pat. No. 4,702,999), 185743/1986, 124941/1986 (U.S. Pat. No. 4,639,408), and 280140/1990; blocking groups that use intramolecular nucleophilic replacement reaction, as described, for example, in U.S. Pat. Nos. 4,358,525 and 4,330,617, and JP-A Nos. 53330/1980 (U.S. Pat. No. 4,310,612), 121328/1984, 218439/1984, and 318555/1988 (European Publication Patent No. 0295729); blocking groups that use ring cleavage of a 5-membered ring or 6-membered ring, as described, for example, in JP-A Nos. 76541/1982 (U.S. Pat. No. 4,335,200), 135949/1982 (U.S. Pat. No. 4,350,752), 179842/1982, 137945/1984, 140445/1984, 219741/1984, 202459/1984, 41034/1985 (U.S. Pat. No. 4,618,563), 59945/1987 (U.S. Pat. No. 4,888,268), 65039/1987 (U.S. Pat. No. 4,772,537), 80647/1987, 236047/1991, and 238445/1991; blocking groups that use the addition reaction of a nucleophilic reagent to a conjugated unsaturated bond, as described, for example, in JP-A Nos. 201057/1984 (U.S. Pat. No. 4,518,685), 95346/1986 (U.S. Pat. No. 4,690,885), 95347/1986 (U.S. Pat. No. 4,892,811), 7035/1989, 42650/1989 (U.S. Pat. No. 5,066,573), 245255/1989, 207249/1990, 235055/1990 (U.S. Pat. No. 5,118,596), and 186344/1992; blocking groups that use the β-elimination reaction, as described, for example, in JP-A Nos. 93442/1984, 32839/1986, and 163051/1987, and JP-B No. 37299/1993; blocking groups that use the nucleophilic replacement reaction of diarylmethanes, as described in JP-A No. 188540/1986; blocking groups that use the Lossen rearrangement reaction, as described in JP-A No. 187850/1987; blocking groups that use the reaction between the N-acylated product of thiazolidin-2-thion and amines, as described in JP-A Nos. 80646/1987, 144163/1987, and 147457/1987; and blocking groups that have two nucleophilic groups to react with two nucleophilic agents, as described in JP-A Nos. 296240/1990 (U.S. Pat. No. 5,019, 492), 177243/1992, 177244/1992, 177245/1992, 177246/1992, 177247/1992, 177248/1992, 177249/1992, 179948/1992, 184337/1992, and 184338/1992, International Publication Patent No. 92/21064, JP-A No. 330438/1992, International Publication Patent No. 93/03419, and JP-A No. 45816/1993, as well as JP-A Nos. 236047/1991 and 238445/1991.

The group represented by L in the compound represented by formula (A) may be any linking group that can be split off from the group represented by A, at the time of development processing, and that then can split $(L)_n$-1-PUG. Examples are groups that use the split of a hemi-acetal ring, as described in U.S. Pat. Nos. 4,146,396, 4,652,516, and 4,698,297; timing groups that bring about an intramolecular nucleophilic substitution reaction, as described in U.S. Pat. Nos. 4,248,962, 4,847,185, or 4,857,440; timing groups that use an electron transfer reaction to bring about a cleavage reaction, as described in U.S. Pat. No. 4,409,323 or 4,421,845; groups that use the hydrolysis reaction of an iminoketal to bring about a cleavage reaction, as described in U.S. Pat. No. 4,546,073; groups that use the hydrolysis reaction of an ester to bring about a cleavage reaction, as described in West German Publication Patent No. 2,626,317; or groups that use a reaction with sulfite ions to bring about a cleavage reaction, as described in European Patent No. 0572084.

PUG in formula (A) will now be described.

PUG in formula (A) represents a group photographically useful for an antifoggant, a photographic dye, and the like, and in the present invention the auxiliary developing agents represented by formula (B-1) or (B-2) are particularly preferably used for PUG.

When the auxiliary developing agents represented by formula (B-1) or (B-2) correspond to PUG of formula (A), the bonding position is at the oxygen atom or nitrogen atom of the auxiliary developing agent.

The color light-sensitive material of the present invention comprises basically photographic constitutional layers comprising at least one hydrophilic colloid layer coated on a base, and any one of the photographic constitutional layers contains a light-sensitive silver halide, a dye forming coupler, and a color-forming reducing agent.

Herein, an agent that will react directly with a silver salt is referred to as a color-developing agent, and an agent that will react indirectly with a silver salt through a mediator, like an auxiliary developing agent, is referred to as a color-forming reducing agent. The compound of the present invention can be used as either of them. This specification uses both terms, and they are not precisely and properly used and can in many cases be considered without fear to have the same meaning.

As the most general embodiment, the dye-forming coupler and the color-forming reducing agent to be used in the present invention are added to the same layer, or alternatively they may be added separately to different layers if they are placed in a state in which they can react. These components are preferably added to a silver halide emulsion layer in the light-sensitive material or to a layer adjacent thereto, and particularly preferably both are added to a silver halide emulsion layer.

The color-forming reducing agent and the coupler according to the present invention can be introduced into the light-sensitive material by various known dispersion methods, such as a method described in U.S. Pat. No. 2,322,027. Preferably the oil-in-water dispersion method is used, in which they are dissolved in a high-boiling organic solvent (and, if necessary, together with a low-boiling organic solvent), the solution is emulsified and dispersed in an aqueous gelatin solution, and the emulsified dispersion is added to a silver halide emulsion.

Also, if necessary, a low-boiling organic solvent, having a boiling point of 50° to 160° C., can be additionally used. Further, these dye-donative compounds, nondiffusible reducing agents, high-boiling organic solvents, etc., can be used in a combination of two or more.

The high-boiling organic solvent to be used in the present invention is preferably a compound nonmiscible with water, and having a melting point of 100° C. or below and a boiling point of 140° C. or over, that is a good solvent for the color-forming reducing agents and couplers. The melting point of the high-boiling organic solvent is more preferably 80° C. or below. However in the case of heat-processible light-sensitive materials, the melting point of the high-boiling organic solvent may be over 100° C. The boiling point of the high-boiling organic solvent is more preferably 160° C. or over, and even further preferably 170° C. or over. Details of these high-boiling organic solvents are described in JP-A No. 215272/1987, page 137, right lower column, to page 144, right upper column. In the present invention, the amount of the high-boiling organic solvent to be used may be any amount, but preferably the amount is such that the weight ratio of the high-boiling organic solvent to the color-forming reducing agent is from 20 or less: 1, more preferably from 0.02 to 5:1, and particularly preferably from 0.2 to 4:1.

Further, in the present invention, known polymer dispersion methods can be used. Specific examples of steps, effects, and latexes for impregnation of the latex dispersion method, which is one polymer dispersion method, are described, for example, in U.S. Pat. No. 4,199,363, West Germany Patent Application (OLS) Nos. 2,541,274 and 2,541,230, JP-B No. 41091/1978, and European Patent Publication No. 029104, and a dispersion method using an organic solvent-soluble polymer is described in PCT International Publication No. WO 88/00723.

The lipophilic fine particles containing the color-forming reducing agent according to the present invention may have any average grain size. In light of color-forming properties, the average particle size is preferably 0.05 to 0.3 $\mu$m, and further preferably 0.05 to 0.2 $\mu$m.

To make the average particle size of lipophilic fine particles small is generally accomplished, for example, by choosing a type of surface-active agent, by increasing the amount of the surface-active agent to be used, by elevating the viscosity of the hydrophilic colloid solution, by lowering the viscosity of the lipophilic organic layer, through use of an additional low-boiling organic solvent, by increasing the rotational frequency of the stirring blades of an emulsifying apparatus, to increase the shearing force, or by prolonging the emulsifying time.

The particle size of lipophilic fine particles can be measured by an apparatus, such as a Nanosizer (trade name, manufactured by British Coulter Co.).

In the present invention, when the dye that is produced from the color-forming reducing agent and the dye-forming coupler is a nondiffusible dye, a dye-fixing element is used together with the light-sensitive material. The dye-fixing element may be applied on a base separated from a base for the light-sensitive material, or it may be applied on the same base where the light-sensitive material is located on. The relative relationship of light-sensitive materials to dye-fixing elements, the relationship of light-sensitive materials to bases, and the relationship of light-sensitive materials to white reflective layers are described, for example, in U.S. Pat. No. 4,500,626.

Dye-fixing elements that are preferably used in the present invention have at least one layer that contains a mordant and a binder. If the present invention is applied to such a mode, it is not required to dip the material in an alkali to form color, and therefore image stability after processing is remarkably improved. Although the mordant according to the present invention can be used in any layer, if the mordant is added to a layer containing the color-forming reducing agent of the present invention, the stability of the color-forming reducing agent is deteriorated, and therefore preferably the mordant is used in a layer that does not contain the color-forming reducing agent. Further, the dye that is produced from a color-forming reducing agent and a coupler diffuses into the gelatin film that has been swelled during the processing, to dye the mordant. Therefore, in order to obtain good sharpness, the shorter the diffusion distance is, the more preferred it is. Accordingly, the layer to which the mordant is added is preferably a layer adjacent to the layer containing the color-forming reducing agent.

Further, since the dye that is produced from the color-forming reducing agent according to the present invention and the coupler for use in the present invention is a water-soluble dye, there is a possibility that the dye may flow out into the processing solution. Therefore, to prevent this, preferably the layer to which the mordant is added is situated on the side of the base opposite to the layer containing the color-forming reducing agent. However, when a barrier layer, as described in JP-A No. 168335/1995, is provided on the side of the base opposite to a layer in which the mordant is added, also preferably the layer in which the mordant is added is on the same side of the base as the layer containing the color-forming reducing agent.

The mordant for use in the present invention may also be added to several layers, and in particular, when several layers contain the color-forming reducing agent, also preferably the mordant is added to each layer adjacent thereto.

The coupler that forms a diffusible dye may be any coupler that results in a diffusible dye formed by coupling with the color-forming reducing agent according to the present invention, the resultant diffusible dye being capable of reaching the mordant. Preferably the coupler is a coupler that results in a diffusible dye having one or more dissociable groups with a pKa (an acid dissociation constant) of 12 or less, more preferably 8 or less, and particularly preferably 6 or less. Preferably the molecular weight of the diffusible dye that will be formed is 200 or more but 2,000 or less. Further, preferably the ratio (the molecular weight of the dye that will be formed/the number of dissociable groups with a pKa of 12 or less) is 100 or more but 2,000 or less, and more preferably 100 or more but 1,000 or less. Herein the value of pKa is the value measured by using, as a solvent, dimethylformamide/water (1:1).

The coupler that forms a diffusible dye is preferably one that results in a diffusible dye formed by coupling with the color-forming reducing agent according to the present invention, the resultant diffusible dye being dissolvable in an alkali solution having a pH of 11 in an amount of $1\times10^{-6}$ mol/liter or more, more preferably $1\times10^{-5}$ mol/liter or more, and particularly preferably $1\times10^{-4}$ mol/liter or more, at 25° C. Further, the coupler that forms a diffusible dye is preferably one that results in a diffusible dye formed by coupling with the color-forming reducing agent according to the present invention, the resultant diffusible dye having a diffusion constant of $1\times10^{-8}$ $m^2/s^-$ or more, more preferably $1\times10^{-7}$ $m^2/s^{-1}$ or more, and particularly preferably $1\times10^{-6}$ $m^2/s^{-1}$ or more, at 25° C. when dissolved in an alkali solution of pH 11, at a concentration of $10^{-4}$ mol/liter.

The mordant that can be used in the present invention can be suitably chosen from among mordants that are usually used, and among them, in particular, polymer mordants are preferable. Herein, by polymer mordant is meant a polymer containing tertiary amino groups, polymers having nitrogen-containing heterocyclic moieties, polymers containing quaternary cation groups thereof, etc.

Preferably specific examples of homopolymers and copolymers containing vinyl monomer units with a tertiary imidazole group are described, for example, in U.S. Pat. Nos. 4,282,305, 4,115,124, and 3,148,061 and JP-A Nos. 118834/1985, 122941/1985, 244043/1987, and 244036/1987.

Preferably specific examples of homopolymers and copolymers containing vinyl monomer units with a quaternary imidazolium salt are described, for example, in British Patent Nos. 2,056,101, 2,093,041, and 1,594,961, U.S. Pat. Nos. 4,124,386, 4,115,124, and 4,450,224, and JP-A No. 28325/1973.

Further, preferable specific examples of homopolymers and copolymers having vinyl monomer units with a quaternary ammonium salt are described, for example, in U.S. Pat. Nos.3,709,690, 3,898,088, and 3,958,995, and JP-A Nos. 57836/1985, 60643/1985, 122940/1985, 122942/1985, and 235134/1985.

Further, vinylpyridine polymers and vinylpyridinium cation polymers disclosed, for example, in U.S. Pat. Nos. 2,548,564, 2,484,430, 3,148,161, and 3,756,814; polymer mordants capable of being crosslinked to gelatin or the like disclosed, for example, in U.S. Pat. Nos. 3,625,694, 3,859,096, and 4,128,538, and British Patent No. 1,277,453; aqueous sol-type mordants disclosed, for example, in U.S. Pat. Nos. 3,958,995, 2,721,852, and 2,798,063, and JP-A Nos. 115228/1979, 145529/1979, and 26027/1979; water-insoluble mordants disclosed in U.S. Pat. No. 3,898,088; reactive mordants capable of covalent bonding to dyes, as disclosed in U.S. Pat. No. 4,168,976 (JP-A No. 137333/1979); and mordants disclosed in U.S. Pat. Nos. 3,709,690, 3,788,855, 3,642,482, 3,488,706, 3,557,066, and 3,271,147, and JP-A Nos. 71332/1975, 30328/1978, 155528/1977, 125/1978, and 1024/1978, can all be mentioned.

Still further, mordants described in U.S. Pat. Nos. 2,675,316 and 2,882,156 can be mentioned.

The molecular weight of the polymer mordants for use in the present invention is suitably 1,000 to 1,000,000, and particularly preferably 10,000 to 200,000.

The above polymer mordants are used generally by mixing them with a hydrophilic colloid.

As the hydrophilic colloid, a hydrophilic colloid and/or a highly hygroscopic polymer can be used, and gelatin is most typically used. The mixing ratio of the polymer mordant to the hydrophilic colloid, and the coating amount of the polymer mordant, can be determined easily by those skilled in the art in accordance with the amount of the dye to be mordanted, the type and composition of the polymer mordant, and the image formation process to be used, though suitably the mordant/hydrophilic colloid ratio is from 20/80 to 80/20 (by weight), and the coating amount of the mordant is suitably 0.2 to 15 $g/m^2$, and preferably 0.5 to 8 $g/m^2$, for use.

As the base to be used in the light-sensitive material according to the present invention, any transparent base or reflective base can be used if it can be coated with photographic emulsion layers, and examples are bases of glass, paper, and plastic film. As the plastic film to be used in the present invention, for example, a polyester film, a polyamide film, a polycarbonate film, and a polystyrene film, for example, of a polyethylene terephthalate, a polyethylene naphthalate, a cellulose triacetate, or a cellulose nitrate, can be used.

"A reflective base" that can be used in the present invention refers to a base that enhances reflectivity, to make sharp the dye image that has been formed in a silver halide emulsion layer. Such a reflective base includes a base coated thereon with a hydrophobic resin containing a light-reflecting material dispersed therein, such as titanium oxide, zinc oxide, calcium oxide, and calcium sulfate, and a base made of a hydrophobic resin containing a light-reflective material dispersed therein. Examples are a polyethylene-coated paper, a polyester-coated paper, a polypropylene-series synthetic paper, and a base having a reflective layer or using a reflective material, wherein the base is made of a material such as a glass sheet, a polyester film (e.g. a polyester film of a polyethylene terephthalate, a cellulose triacetate, or a cellulose nitrate), a polyamide film, a polycarbonate film, a polystyrene film, and a vinyl chloride resin film. As for the polyethylene-coated paper, a polyester-coated paper having as the major component a polyethylene terephthalate, as described particularly in European Patent EP No. 0,507,489, is preferably used.

The reflective base to be used in the present invention is preferably a paper base whose both surfaces are coated with a water-resistant resin layer, with at least one of the water-resistant resin layers containing white pigment fine particles. The foregoing white pigment particles are preferably contained in a density of 12% by weight or more, and more preferably 14% by weight or more. The light-reflective white pigment is preferably kneaded sufficiently in the presence of a surface-active agent, and pigment particles obtained by treating the surface of pigment particles with a dihydric to tetrahydric alcohol are preferable.

In the present invention, a base having a surface with the second diffuse reflectivity is preferably used. The term "the second diffuse reflectivity" means diffuse reflectivity obtained by making a specular surface irregular, to have fine separate specular surfaces facing different dispersed directions. The irregularity of the surface with the second diffuse reflectity is such that the three-dimensional average coarseness for the center plane is generally 0.1 to 2 $\mu$m, and preferably 0.1 to 1.2 $\mu$m. Details of such a base are described in JP-A No. 239244/1990.

To obtain a wide range of color on the chromaticity diagram using the three primaries yellow, magenta, and cyan, at least three silver halide emulsion layers respectively light-sensitive to different spectral regions are used in combination. For instance, three layers are coated onto the aforesaid base: a blue-sensitive layer, a green-sensitive layer, and a red-sensitive layer, in combination, or a green-sensitive layer, a red-sensitive layer, and an infrared-sensitive layer, in combination. The light-sensitive layers can be arranged in various orders usually known in color light-sensitive materials. Further, each of these light-sensitive layers may be divided into two or more layers, if required.

The light-sensitive material may be provided with photographic constitutional layers comprising the foregoing light-sensitive layers and protective layers, including a protective layer, an undercoat layer, an intermediate layer, an antihalation layer, a backing layer, etc. Further, to improve color separation, a variety of filter dyes can be added to the photographic constitutional layers.

Specifically, for example, layer constitutions as described in the above-mentioned patents, undercoat layers as described in U.S. Pat. No. 5,051,335, intermediate layers containing a solid pigment, as described in JP-A Nos. 167,838/1989 and 20,943/1986, intermediate layers containing a reducing agent and a DIR compound, as described in JP-A Nos. 120,553/1989, 34,884/1993, and 64,634/1990, intermediate layers containing an electron transfer agent, as described in U.S. Pat. Nos. 5,017,454 and 5,139,919, and JP-A No. 235,044/1990, protective layers containing a reducing agent, as described in JP-A No. 249,245/1992, or combinations of these layers, can be provided.

As a dye that can be used in the yellow filter layer and the antihalation layer, a dye that loses its color or dissolves out when developed and thus does not contribute to the density after processing, is preferred.

The expression "a dye in the yellow filter layer or the antihalation layer loses its color or is eliminated when developed," means that the amount of the dye remaining after processing becomes ⅓ or less, and preferably 1/10 or less, of the amount of the dye existing immediately before coating, which effect may be caused by dissolving out of the component of the dye from the light-sensitive material when the material is developed, by transfer of the component of the dye from the light-sensitive material to the processing material, or by conversion of the component of the dye to a colorless compound when the component is reacted at the time of development.

As the dye that can be used in the light-sensitive material of the present invention, known dyes can be used. For instance, a dye that can be dissolved in an alkali in a developer, and a dye of a type that reacts with a component, sulfite ions, a developing agent, or an alkali, in a developer, to lose its color, can be used.

Specifically, dyes described in European Patent Application EP No. 549,489A, and dyes ExF 2 to 6 described in JP-A No. 152129/1995, can be mentioned. A solid-dispersed dye as described in Japanese Patent Application No. 259805/1994 can also be used. Although this dye can be used when the light-sensitive material is developed with a processing solution, this dye is particularly preferably used when the light-sensitive material is thermally developed using a processing sheet, described later.

The dye may also be mordanted with a mordant and a binder. In this case, as the mordant and the dye, those known in the field of photography can be used, and examples include mordants described, for example, in U.S. Pat. No. 4,500,626, columns 58 to 59, and JP-A Nos. 88256/1986, pages 32 to 41, 244043/1987, and 244036/1987.

Further, a reducing agent and a compound that can react with the reducing agent to release a diffusible dye can be used to cause a movable dye to be released with an alkali at the time of development, to be dissolved into the processing solution or to be transferred to the processing sheet, to thereby be removed. Specifically, examples are described in U.S. Pat. No. 4,559,290 and 4,783,396, European Patent No. 220,746 A2, and Kokai-Giho No. 87-6119, as well as Japanese Patent Application No. 259805/1994, section Nos. 0080 to 0081.

Leuco dyes or the like that lose their color can be used, and specifically, a silver halide light-sensitive material containing a leuco dye that has been color-formed previously with a developer of an organic acid metal salt, is disclosed in JP-A No. 150,132/1989. Since a leuco dye and a developer complex react thermally or with an alkali agent to lose its color, in the present invention, if the light-sensitive material is thermally developed, this combination of a leuco dye and a developer is preferable.

As the leuco dyes, known leuco dyes can be used, which are described, for example, by Moriga and Yoshida in "Senryo to Yakuhin," 9, page 84 (Kaseihin Kogyo-kyokai); in "Shinban Senryo Binran," page 242 (Maruzen, 1970); by R. Garner in "Reports on the Progress of Appl. Chem," 56, page 199 (1971); in "Senryo to Yakuhin," 19, page 230 (Kaseihin Kogyo-kyokai, 1974); in "Shikizai," 62, page 288 (1989), and in "Senshoku Kogyo," 32, 208.

As the developer, a terra abla-series developer and a phenol formaldehyde resin, as well as an organic acid metal salt, are preferably used. As the organic acid metal salt, metal salts of salicylic acids, metal salts of phenol/salicylic acid/formaldehyde resins, rhodanates, metal salts of xanthogenates, etc., are useful, and as the metal, particularly zinc is preferred. As oil-soluble salicylic acid zinc salts out of the above developers, those described, for example, in U.S. Pat. Nos. 3,864,146 and 4,046,941, and JP-B No. 1327/1987, can be used.

The light-sensitive material of the present invention is preferably hardened with a hardening agent.

Examples of the hardening agent include hardening agents described, for example, in U.S. Pat. Nos. 4,678,739, column 41, and 4,791,042, and JP-A Nos. 116,655/1984, 245,261/1987, 18,942/1986, and 218,044/1992. More specifically, an aldehyde-series hardening agent (formaldehyde, etc.), an aziridine-series hardening agent, an epoxy-series hardening agent, a vinyl sulfone-series hardening agent (N,N'-ethylene-bis(vinylsulfonylacetamido) ethane, etc.), an N-methylol-series hardening agent (dimethylol urea, etc.), boric acid, metaboric acid, or a polymer hardening agent (compounds described, for example, in JP-A No. 234,157/1987), can be mentioned.

These hardening agents are used in an amount of generally 0.001 to 1 g, and preferably 0.005 to 0.5 g, per g of the hydrophilic binder.

In the light-sensitive material, various antifoggants or photographic stabilizers or their precursors can be used. Specific examples thereof include compounds described, for example, in the Research Disclosure mentioned herein, U.S. Pat. Nos. 5,089,378, 4,500,627, and 4,614,702, JP-A No. 13,564/1989, pages 7 to 9, 57 to 71, and 81 to 97, U.S. Pat. Nos. 4,775,610, 4,626,500, and 4,983,494, JP-A Nos. 174, 747/1987, 239,148/1987, 150,135/1989, 110,557/1990, and 178,650/1990, and RD No. 17,643 (1978), pages 24 to 25.

These compounds are preferably used in an amount of $5\times10^{-6}$ to $1\times10^{-1}$ mol, and more preferably $1\times10^{-5}$ to $1\times10^{-2}$ mol, per mol of silver.

As the binder or protective colloid that can be used in the light-sensitive material according to the present invention, gelatin is advantageously used, and other hydrophilic colloids can be used singly or in combination with gelatin. The calcium content of the gelatin is preferably 800 ppm or less, and more preferably 200 ppm or less, and the iron content of the gelatin is preferably 5 ppm or less, and more preferably 3 ppm or less. To prevent various mildews and fungi from propagating in the hydrophilic colloid layer to deteriorate an image, mildew-proofing agents, as described in JP-A No. 271247/1988, are preferably added.

In subjecting the light-sensitive material of the present invention to printer exposure, preferably a band stop filter, described in U.S. Pat. No. 4,880,726, is used. This removes light color mixing and improves color reproduction remarkably.

Further, when the light-sensitive material of the present invention is used as a photographing light-sensitive material, and then development is carried out by a heat development system at a development temperature of 60° C. or higher but 150° C. or lower, the image information of the obtained color negative is converted to digital signals, and its printing is carried out using the above heat development light-sensitive material—then the process from photographing to printing can be effected without using any processing solutions used for conventional color photographs.

Further, when use is made of a PICTROSTAT 330, (trade name, manufactured by Fuji Photo Film Co., Ltd.), to read optically the image information by its NSE unit, to be outputted, the process from photographing to printing can also be effected without using any processing solutions.

The silver halide grains used in the present invention are made of silver bromide, silver chloride, silver iodide, silver chlorobromide, silver chloroiodide, silver iodobromide, or silver chloroiodobromide. Other silver salts, such as silver rhodanate, silver sulfide, silver selenide, silver carbonate, silver phosphate, or a silver salt of an organic acid, may be contained in the form of independent grains or as part of silver halide grains. If it is desired to make the development/desilvering (bleaching, fixing, and bleach-fix) step rapid, silver halide grains having a high silver chloride content are desirable. Further, if the development is to be restrained moderately, it is preferable to contain silver iodide. The preferable silver iodide content varies depending on the intended light-sensitive material.

The grains of the silver halide emulsion for use in the present invention preferably have a distribution or a structure with respect to the halogen composition. Typical examples thereof are disclosed, for example, in JP-B No. 13162/1968, JP-A Nos. 215540/1986, 222845/1985, 143331/1985, 75337/1986 and 222844/1985.

In order to make the inside of grains have a structure, not only the enclosing structure, as mentioned above, but also a so-called junctioned structure can be used to form grains. Examples thereof are disclosed, for example, in JP-A Nos. 133540/1984 and 108526/1983, European Patent No. 199, 290A2, JP-B No. 24772/1983, and JP-A No. 16254/1984.

In the case of a junctioned structure, not only a combination of silver halides but also a combination of a silver halide with a silver salt compound having no rock salt structure, such as silver rhodanate and silver carbonate, can be used for the junctioned structure.

In the case of grains of silver iodobromide or the like having these structures, a preferable mode is that the core part is higher in silver iodide content than the shell part. Reversely, in some cases, grains having a lower silver iodide content in the core part than in the shell part are preferable. Similarly, in the case of grains having a junctioned structure, the silver iodide content of the host crystals is relatively higher than that of the junctioned crystals, or this may be reversed. The boundary part of the grains having these structures in which different halogen compositions are present, may be distinct or indistinct. Also preferable is a mode wherein the composition is continuously changed positively.

It is important that in the case of that two or more silver halides are present as mixed crystals, or as silver halide grains having structures, the halogen composition distribution between grains is controlled. The method of measuring the halogen composition distribution between grains is described in JP-A No. 254032/1985. In particular, a highly uniform emulsion having a deviation coefficient of 20% or below is preferable.

It is important to control the silver halide composition near the surface of grains. An increase in the silver iodide content or the silver chloride content at the part near the surface changes the adsorption of a dye or the developing speed, and in accordance with the purpose, this can be chosen.

In the silver halide grains used in the present invention, in accordance with the purpose, any of regular crystals having no twin plane, those described in "Shashin Kogyo no Kiso, Ginen Shashin-hen", edited by Nihon Shashin-gakkai (Corona Co.), page 163, parallel multiple twins having two or more parallel twin planes, and nonparallel multiple twins having two or more nonparallel twin planes, can be chosen and used. An example in which grains different in shape are mixed is disclosed in U.S. Pat. No. 4,865,964. In the case of regular crystals, cubes having (100) planes, octahedrons having (111) planes, and dodecahedral grains having (110) planes, as disclosed in JP-B No. 42737/1980 and JP-A No. 222842/1985, can be used. Further, (hlm) plane grains, as reported in "Journal of Imaging Science", Vol. 30, page 247 (1986), can be chosen and used in accordance with the purpose. Grains having two or more planes in one grain, such as tetradecahedral grains having (100) and (111) planes in one grain, grains having (100) and (110) planes in one grain, or grains having (111) and (110) planes in one grain, can also be chosen and used in accordance with the purpose.

The value obtained by dividing the diameter of the projected area, which is assumed to be a circle, by the thickness of the grain, is called an aspect ratio, which defines the shape of tabular grains. Tabular grains having an aspect ratio of greater than 1 can be used in the present invention. Tabular grains can be prepared by methods described, for example, by Cleve in "Photography Theory and Practice" (1930), page 131; by Gutoff in "Photographic Science and Engineering", Vol. 14, pages 248 to 257 (1970); and in U.S. Pat. Nos. 4,434,226, 4,414,310, 4,433,048, and 4,439,520, and British Patent No. 2,112,157. When tabular grains are used, such merits are obtained that the covering power is increased and the color sensitization efficiency due to a sensitizing dye is increased, as described in detail in the above-mentioned U.S. Pat. No. 4,434,226. The average aspect ratio of 80% or more of all the projected areas of grains is desirably 1 or more but less than 100, more preferably 2 or more but less than 20, and particularly preferably 3 or more but less than 10. As the shape of tabular grains, a triangle, a hexagon, a circle, and the like can be chosen. A regular hexagonal shape having six approximately equal sides, described in U.S. Pat. No. 4,797,354, is a preferable mode.

In many cases, the grain size of tabular grains is expressed by the diameter of the projected area assumed to be a circle, and grains having an average diameter of 0.6 microns or below, as described in U.S. Pat. No. 4,748,106, are preferable, because the quality of the image is made high. An emulsion having a narrow grain size distribution, as described in U.S. Pat. No. 4,775,617, is also preferable. It is preferable to restrict the shape of tabular grains so that the thickness of the grains may be 0.5 microns or below, and more preferably 0.3 microns or below, because the sharpness is increased. Further, an emulsion in which the grains are highly uniform in thickness, with the deviation coefficient of grain thickness being 30% or below, is also preferable. Grains in which the thickness of the grains and the plane distance between twin planes are defined, as described in JP-A No. 163451/1988, are also preferable.

In accordance with the purpose, it is preferable to choose grains having no dislocation lines, grains having several dislocation lines, or grains having many dislocation lines. Dislocation introduced straight in a special direction in the crystal orientation of grains, or curved dislocation, can be chosen, and it is possible to choose from, for example, dislocation introduced throughout grains, dislocation introduced in a particular part of grains, and dislocation introduced limitedly to a particular part such as fringes of grains. In addition to the case of introduction of dislocation lines into tabular grains, also preferable is the case of introduction of dislocation lines into regular crystalline grains or irregular grains, represented by potato grains.

The silver halide emulsion used in the present invention may be subjected to a treatment for making grains round, as disclosed, for example, in European Patent Nos. 96,727B1 and 64,412B1, or it may be improved in the surface, as disclosed in West German Patent No. 2,306,447C2 and JP-A No. 221320/1985.

Generally, the grain surface has a flat structure, but it is also preferable in some cases to make the grain surface uneven intentionally. Examples are described, for example, in JP-A Nos. 106532/1983 and 221320/1985, and U.S. Pat. No. 4,643,966.

The grain size of the emulsion used in the present invention is evaluated, for example, by the diameter of the projected area equivalent to a circle using an electron microscope; by the diameter of the grain volume equivalent to a sphere, calculated from the projected area and the grain thickness; or by the diameter of a volume equivalent to a sphere, using the Coulter Counter method. A selection can be made from ultrafine grains having a sphere-equivalent diameter of 0.01 microns or below, and coarse grains having a sphere-equivalent diameter of 10 microns or more. Preferably grains of 0.1 microns or more but 3 microns or below are used as photosensitive silver halide grains.

As the emulsion used in the present invention, an emulsion having a wide grain size distribution, that is, a so-called polydisperse emulsion, or an emulsion having a narrow grain size distribution, that is, a so-called monodisperse emulsion, can be chosen and used in accordance with the purpose. As the scale for representing the size distribution, the diameter of the projected area of the grain equivalent to a circle, or the deviation coefficient of the diameters of the grain volume equivalent to a sphere, can be used. If a monodisperse emulsion is used, it is preferable to use an emulsion having such a size distribution that the deviation coefficient is 25% or below, more preferably 20% or below, and further more preferably 15% or below.

Further, in order to allow the light-sensitive material to satisfy the intended gradation, in an emulsion layer having substantially the same color sensitivity, two or more monodisperse silver halide emulsions different in grain size are mixed and applied to the same layer or are applied as overlaid layers. Further, two or more polydisperse silver halide emulsions can be used as a mixture; or they can be used to form overlaid layers; or a combination of a monodisperse emulsion and a polydisperse emulsion can be used as a mixture; or the combination can be used to form overlaid layers.

The photographic emulsion for use in the present invention can be prepared by a method described, for example, by P. Glafkides in "Chemie et Physique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964. A method wherein grains are formed in the presence of excess silver ions (the so-called reverse precipitation process) can also be used. As one type of the double-jet method, a method wherein pAg in the liquid phase, in which a silver halide will be formed, is kept constant, that is, the so-called controlled double-jet method, can also be used. According to this method, a silver halide emulsion wherein the crystals are regular in shape and whose grain size is approximately uniform, can be obtained.

A method in which previously precipitated and formed silver halide grains are added to a reaction vessel for the preparation of an emulsion, and the methods described, for example, in U.S. Pat. Nos. 4,334,012, 4,301,241, and 4,150,994, are preferable in some cases. These can be used as seed crystals, or they are effective when they are supplied as a silver halide for growth. Further, in some cases, it is also effective to add fine grains having different halogen compositions in order to modify the surface.

The method in which a large part or only a small part of the halogen composition of silver halide grains is converted by the halogen conversion method is disclosed, for example, in U.S. Pat. Nos. 3,477,852 and 4,142,900, European Patent Nos. 273,429 and 273,430, and West German Publication Patent No. 3,819,241. To convert to a more hardly soluble silver salt, it is possible to add a solution of a soluble halogen or to add silver halide grains.

In addition to the method in which the grain growth is made by adding a soluble silver salt and a halogen salt at constant concentrations and at constant flow rates, grain formation methods wherein the concentration is changed or the flow rate is changed, as described in British Patent No. 1,469,480 and U.S. Pat. Nos. 3,650,757 and 4,242,445, are preferable methods. By increasing the concentration or increasing the flow rate, the amount of the silver halide to be supplied can be changed as a linear function, a quadratic function, or a more complex function, of the addition time.

A mixing vessel that is used when a solution of a soluble silver salt and a solution of a soluble halogen salt are reacted can be selected for use from methods described in U.S. Pat. Nos. 2,996,287, 3,342,605, 3,415,650, and 3,785,777, and West German Publication Patent Nos. 2,556,885 and 2,555,364.

For the purpose of promoting the ripening, a silver halide solvent is useful. For example, it is known to allow an excess amount of halide ions to be present in the reaction vessel, to promote the ripening. Further, other ripening agent can be used. All of the amount of these ripening agents may be blended in the dispersion medium in the reaction vessel before silver and halide salts are added, or their introduction into the reaction vessel may be carried out together with the addition of a halide salt, a silver salt, or a peptitizer.

As examples of these, ammonia, thiocyanates (e.g. potassium rhodanate and ammonium rhodanate), organic thioether compounds (e.g. compounds described, for example, in U.S. Pat. Nos. 3,574,628, 3,021,215, 3,057,724, 3,038,805, 4,276,374, 4,297,439, 3,704,130, and 4,782,013, and JP-A No. 104926/1982), thion compounds (e.g. tetra-substituted thioureas described, for example, in JP-A Nos. 82408/1978 and 77737/1980, and U.S. Pat. No. 4,221,863; and compounds described in JP-A No. 144319/1978), mercapto compounds capable of promoting the growth of silver halide grains, as described in JP-A No. 202531/1982, and amine compounds (e.g. described in JP-A No. 100717/1979), can be mentioned.

As a protective colloid and as a binder of other hydrophilic colloid layers that are used when the emulsion according to the present invention is prepared, gelatin is used advantageously, but another hydrophilic colloid can also be used.

Use can be made of, for example, a gelatin derivative, a graft polymer of gelatin with another polymer, a protein, such as albumin and casein; a cellulose derivative, such as hydroxyethyl cellulose, carboxymethyl cellulose, and cellulose sulfates; a saccharide derivative, such as sodium alginate, a starch derivative; and many synthetic hydrophilic polymers, including homopolymers and copolymers, such as a polyvinyl alcohol, a polyvinyl alcohol partial acetal, a poly-N-vinylpyrrolidone, a polyacrylic acid, a polymethacrylic acid, a polyacrylamide, a polyvinylimidazole, and a polyvinylpyrazole.

As the gelatin, in addition to lime-processed gelatin, acid-processed gelatin, and enzyme-processed gelatin described in Bull. Soc. Sci. Photo. Japan, No. 16, page 30 (1966), can be used. Further a hydrolyzate or enzymolyzate of gelatin can also be used. For the preparation of tabular grains, it is preferable to use a low-molecular-weight gelatin described in JP-A No. 158426/1989.

Preferably, the emulsion according to the present invention is washed with water for desalting and is dispersed in a freshly prepared protective colloid. The temperature at which the washing with water is carried out can be selected in accordance with the purpose, and preferably the temperature is selected in the range of 5° to 50° C. The pH at which the washing is carried out can be selected in accordance with the purpose, and preferably the pH is selected in the range of 2 to 10, and more preferably in the range of 3 to 8. The pAg at which the washing is carried out can be selected in accordance with the purpose, and preferably the pAg is selected in the range of 5 to 10. As a method of washing with water, one can be selected from the noodle washing method, the dialysis method using a diaphragm, the centrifugation method, the coagulation settling method, and the ion exchange method. In the case of the coagulation settling method, selection can be made from, for example, the method wherein sulfuric acid is used, the method wherein an organic solvent is used, the method wherein a water-soluble polymer is used, and the method wherein a gelatin derivative is used.

When the emulsion according to the present invention is prepared, in accordance with the purpose, it is preferable to allow a salt of a metal ion to be present, for example, at the time when grains are formed, in the step of desalting, at the time when the chemical sensitization is carried out, or before the application. When the grains are doped, the addition is preferably carried out at the time when the grains are formed; or after the formation of the grains, when the surface of the grains is modified or when the salt of a metal ion is used as a chemical sensitizer; or before the completion of the chemical sensitization. As to the doping of grains, selection can be made from a case in which the whole grains are doped, one in which only the core parts of the grains are doped, one in which only the shell parts of the grains are doped, one in which only the epitaxial parts of the grains are doped, and one in which only the substrate grains are doped. For example, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi can be used. These metals can be added if they are in the form of a salt that is soluble at the time when grains are formed, such as an ammonium salt, an acetate, a nitrate, a sulfate, a phosphate, a hydroxide, a six-coordinate complex, and a four-coordinate complex. Examples include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. As a ligand of the coordination compound, one can be selected from halo, aquo, cyano, cyanate, thiocyanate, nitrosyl, thionitrosyl, oxo, and carbonyl. With respect to these metal compounds, only one can be used, but two or more can also be used in combination.

In some cases, a method wherein a chalcogen compound is added during the preparation of the emulsion, as described in U.S. Pat. No. 3,772,031, is also useful. In addition to S, Se, and Te, a cyanate, a thiocyanate, a selenocyanate, a carbonate, a phosphate, or an acetate may be present.

The silver halide grains according to the present invention can be subjected to at least one of sulfur sensitization, selenium sensitization, tellurium sensitization (these three are called chalcogen sensitization, collectively), noble metal sensitization, and reduction sensitization, in any step of the production for the silver halide emulsion. A combination of two or more sensitizations is preferable. Various types of emulsions can be produced, depending on the steps in which the chemical sensitization is carried out. There are a type wherein chemical sensitizing nuclei are embedded in grains, a type wherein chemical sensitizing nuclei are embedded at parts near the surface of grains, and a type wherein chemical sensitizing nuclei are formed on the surface. In the emulsion according to the present invention, the location at which chemical sensitizing nuclei are situated can be selected in accordance with the purpose.

Chemical sensitizations that can be carried out preferably in the present invention are chalcogen sensitization and noble metal sensitization, which may be used singly or in combination; and the chemical sensitization can be carried out by using active gelatin, as described by T. H. James in "The Theory of the Photographic Process," 4th edition, Macmillan, 1997, pages 67 to 76, or by using sulfur, selenium, tellurium, gold, platinum, palladium, or iridium, or a combination of these sensitizing agents, at a pAg of 5 to 10, a pH of 5 to 8, and a temperature of 30° to 80 ° C., as described in Research Disclosure, Item 12008 (April 1974); Research Disclosure, Item 13452 (June 1975); Research Disclosure, Item 307105 (November 1989); U.S. Pat. Nos. 2,642,361, 3,297,446, 3,772,031, 3,857,711, 3,901,714, 4,266,018, and 3,904,415, and British Patent No. 1,315,755.

In the sulfur sensitization, an unstable sulfur compound is used, and specifically, thiosulfates (e.g. hypo), thioureas (e.g. diphenylthiourea, triethylthiourea, and allylthiourea), rhodanines, mercaptos, thioamides, thiohydantoins, 4-oxo-oxazolidin-2-thions, di- or poly-sulfides, polythionic acids, and elemental sulfur, and known sulfur-containing compounds described in U.S. Pat. Nos. 3,857,711, 4,266,018, and 4,054,457, can be used. In many cases, sulfur sensitization is used in combination with noble metal sensitization.

A preferable amount of a sulfur sensitizing agent used for the silver halide grains according to the present invention is $1\times10^{-7}$ to $1\times10^{-3}$ mol, and more preferably $5\times10^{-7}$ to $1\times10^{-4}$ mol, per mol of the silver halide.

In the selenium sensitization, known unstable selenium compounds are used, such as those described, for example, in U.S. Pat. Nos. 3,297,446 and 3,297,447, specific such selenium compounds are colloidal metal selenium, selenoureas (e.g. N,N-dimethylselenourea and tetramethylselenourea), selenoketones (e.g. selenoacetone), selenoamides (e.g. selenoacetamide), selenocarboxylic acids and esters, isoselenocyanates, selenides (e.g. diethylselenides and triphenylphosphine selenide), and selenophosphates (e.g. tri-p-tolylselenophosphate). In some cases, preferably the selenium sensitization is used in combination with one or both of sulfur sensitization and noble metal sensitization.

The amount of the selenium sensitizing agent to be used varies depending on the selenium compound, the silver halide grains, the chemical ripening conditions, and the like that are used, and the amount is generally of the order of $10^{-8}$ to $10^{-4}$ mol, and preferably $10^{-7}$ to $10^{-5}$ mol, per mol of the silver halide.

As the tellurium sensitizing agent used in the present invention, compounds described, for example, in Canadian Patent No. 800,958, British Patent Nos. 1,295,462 and 1,396,696, and Japanese patent application Nos. 333819/1990 and 131598/1991 can be used.

In the noble metal sensitization, a salt of a noble metal, such as gold, platinum, palladium, and iridium, can be used, and specifically gold sensitization, palladium sensitization, and a combination thereof are particularly preferable. In the case of gold sensitization, a known compound, such as chloroauric acid, potassium chloroaurate, potassium auriothiocyanate, gold sulfide, and gold selenide, can be used. The palladium compound means salts of divalent or tetravalent palladium salt. A preferable palladium compound is represented by $R_2PdX_6$ or $R_2PdX_4$, wherein R represents a hydrogen atom, an alkali metal atom, or an ammonium radical; and X represents a halogen atom, i.e. a chlorine atom, a bromine atom, or an iodine atom.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$ is preferable. Preferably a gold compound and a palladium compound are used in combination with a thiocyanate or a selenocyanate.

Preferably the emulsion according to the present invention is used in combination with gold sensitization. A preferable amount of the gold sensitizing agent is $1\times10^{-7}$ to $1\times10^{-3}$ mol, and more preferably $5\times10^{-7}$ to $5\times10^{-4}$ mol, per mol of the silver halide. A preferable amount of the palladium compound is in the range of $5\times10^{-7}$ to $1\times10^{-3}$ mol. A preferable amount of the thiocyan compound and the selenocyan compound is in the range of $1\times10^{-6}$ to $5\times10^{-2}$ mol.

Preferably that the silver halide emulsion according to the present invention is subjected to reduction sensitization during the formation of the grains, after the formation of the grains but before the chemical sensitization, or during or after the chemical sensitization.

Herein, the reduction sensitization can be selected from a method wherein a reduction sensitizer is added to a silver halide emulsion; a method called silver ripening, wherein the growth or ripening is made in an atmosphere having a pAg as low as 1 to 7; and a method called high-pH ripening, wherein the growth or ripening is made in an atmosphere having a pH as high as 8 to 11. Two or more methods can also be used in combination.

As the reduction sensitizer, known reduction sensitizers can be selected and used, such as stannous salts, ascorbic acid and its derivatives, amines and polyamines, hydrazine and its derivatives, formamidinesufinic acid, silane compounds, and boran compounds; and two or more compounds can be used in combination. As the reduction sensitizer, preferable compounds are stannous chloride, aminoiminomethanesulfinic acid (popularly called thiourea dioxide), dimethylamineboran, and ascorbic acid and its derivatives.

The chemical sensitization can be carried out in the presence of a so-called chemical sensitization auxiliary. As a useful chemical sensitization auxiliary, a compound is used that is known to suppress fogging and to increase the sensitivity in the process of chemical sensitization, such as azaindene, azapyridazine, and azapyrimidine. Examples of chemical sensitization auxiliary improvers are described in U.S. Pat. Nos. 2,131,038, 3,411,914, and 3,554,757, JP-A No. 126526/1983, and by G. F. Duffin in "Photographic Emulsion Chemistry" mentioned above, pages 138 to 143.

Preferably an oxidizing agent for silver is added during the process of the production of the emulsion according to the present invention. The oxidizing agent for silver refers to a compound that acts on metal silver to convert it to silver ions. Particularly useful is a compound that converts quite fine silver grains, which are concomitantly produced during the formation of silver halide grains and during the chemical sensitization, to silver ions. The thus produced silver ions may form a silver salt that is hardly soluble in water, such as a silver halide, silver sulfide, and silver selenide, or they may form a silver salt that is readily soluble in water, such as silver nitrate. The oxidizing agent for silver may be inorganic or organic. Example inorganic oxidizing agents include ozone, hydrogen peroxide and its adducts (e.g. $NaBO_2.H_2O_2.3H_2O$, $2NaCO_3.3H_2O_2$, $Na_4P_2O_7.2H_2O_2$, and $2Na_2SO_4.H_2O_2.2H_2O$); oxygen acid salts, such as peroxyacid salts (e.g. $K_2S_2O_8$, $K_2C_2O_6$, and $K_2P_2O_8$), peroxycomplex compounds (e.g. $K_2[Ti(O_2)C_2O_4].3H_2O$, $4K_2SO_4.Ti(O_2)OH.SO_4.2H_2O$, and $Na_3[VO(O_2)(C_2H_4)_2].6H_2O$), permanganates (e.g. $KMnO_4$), and chromates (e.g. $K_2Cr_2O_7$); halogen elements, such as iodine and bromine; perhalates (e.g. potassium periodate), salts of metals having higher valences (e.g. potassium hexacyanoferrate (III), and thiosulfonates.

Examples of the organic oxidizing agents include quinones, such as p-quinone; organic peroxides, such as peracetic acid and perbenzoic acid; and compounds that can release active halogen (e.g. N-bromosuccinimido, chloramine T, and chloramine B).

Use of a combination of the above reduction sensitization with the oxidizing agent for silver is a preferable mode.

In the photographic emulsion used in the present invention, various compounds can be incorporated for the purpose of preventing fogging during the process of the production of the light-sensitive material, during the storage of the light-sensitive material, or during the photographic processing, or for the purpose of stabilizing the photographic performance. That is, compounds known as antifoggants or stabilizers can be added, such as thiazoles including benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), mercaptopyrimidines, mercaptotriazines; thioketo compounds, such as oxazolinthione; and azaindenes, such as triazaindenes; tetraazaindenes (particularly 4-hydroxy-6-methyl-1,3,3a,7-tetraazaindene), and pentaazaindenes. For examples, those described in U.S. Pat. Nos. 3,954,474 and 3,982,947, and JP-B No. 28660/1987, can be used. A preferable compound is a compound described in Japanese Patent Application No. 47225/1987. In accordance with the purpose, the antifoggant and the stabilizer can be added at various times, for example, before the formation of the grains, during the formation of the grains, after the formation of the grains, in the step of washing with water, at the time of dispersion after the washing with water, before the chemical sensitization, during the chemical sensitization, after the chemical sensitization, and before the application.

Preferably, the photographic emulsion to be used in the present invention is spectrally sensitized with methine dyes and the like, because then the effect of the present invention is exhibited. Dyes that can be used include a cyanine dye, a merocyanine dye, a composite cyanin dye, a composite merocyanine dye, a halopolar cyanine dye, a hemicyanine dye, a styryl dye, and a hemioxonol dye. Particularly useful dyes are those belonging to a cyanine dye, a merocyanine dye, and a composite merocyanine dye. In these dyes, any of nuclei generally used in cyanine dyes as base heterocyclic ring nuclei can be applied. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; and a nucleus formed by fusing an cycloaliphatic hydrocarbon ring or an aromatic hydrocarbon ring to these nuclei, that is, such as an indolenine nucleus, a benzindolenine nucleus, an indole nucleus, a benzoxazole nucleus, a naphthooxazole nucleus, a benzothiazole nucleus, a naphthothiazole nucleus, a benzoselenazole nucleus, a benzimidazole nucleus, a quinoline nucleus, can be applied. These nuclei may be substituted on the carbon atom.

In the merocyanine dye or the composite merocyanine dye, as a nucleus having a ketomethylene structure, a 5- to 6-membered heterocyclic ring nucleus, such as a pyrazolin-5-one nucleus, a thiohydantoine nucleus, a 2-thiooxazolidin-2,4-dione nucleus, a thiazolidin-2,4-dione nucleus, a rhodanine nucleus, and a thiobarbituric acid nucleus, can be applied.

These sensitizing dyes can be used singly or in combination, and a combination of these sensitizing dyes is often used, particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,218 and 1,507,803, JP-B Nos. 4,936/1968 and 12,375/1978, and JP-A Nos. 110,618/1977 and 109,925/1977.

Together with the sensitizing dye, a dye having no spectral sensitizing action itself, or a compound that does not substantially absorb visible light and that exhibits supersensitization, may be included in the emulsion.

The timing where the sensitizing dye is added to the emulsion may be at any stage known to be useful in the preparation of emulsions. The addition is carried out most usually at a time after the completion of chemical sensitization and before coating, but it can be carried out at the same time as the addition of a chemical sensitizer, to carry out spectral sensitization and chemical sensitization simultaneously, as described in U.S, Patent Nos. 3,628,969 and 4,225,666; it can be carried out prior to chemical sensitization, as described in JP-A No. 113,928; or it can be carried out before the completion of the formation of the precipitate of silver halide grains to start spectral sensitization. Further, as taught in U.S. Pat. No. 4,255,666, these foregoing compounds may be added in portions, i.e., part of these compounds is added prior to chemical sensitization, and the rest is added after the chemical sensitization, and also the addition may be carried out at any time during the formation of silver halide grains, as disclosed, for example, in U.S. Pat. No. 4,183,756.

Generally the amount of the sensitizing dye to be added is of the order of $4\times10^{-6}$ to $8\times10^{-3}$ mol per mol of the silver halide, but when the silver halide grain size is 0.2 to 1.2 $\mu$m, which is more preferable, the amount of the sensitizing dye to be added is more effectively about $5\times10^{-5}$ to $2\times10^{-3}$ mol per mol of the silver halide.

To the light-sensitive material related to the present technique, may be added the above-mentioned various additives, and also other various additives in accordance with the purpose.

These additives are described in more detail in Research Disclosure, Item 17643 (December 1978); Research Disclosure, Item 18176 (November 1979); and Research Disclosure, Item 307105 (November 1989), and the particular parts are given below in a Table.

| Additive | RD 17643 | RD 18716 | RD 307105 |
|---|---|---|---|
| 1 Chemical sensitizers | p. 23 | p. 648 (right column) | p. 996 |
| 2 Sensitivity-enhancing agents | — | p. 648 (right column) | — |
| 3 Spectral sensitizers and Supersensitizers | pp. 23–24 | pp. 648– (right column) 649 (right column) | pp. 996– (right column) 998 (right column) |
| 4 Brightening agents | p. 24 | — | p. 998 (right column) |
| 5 Antifogging agents and Stabilizers | pp. 24–25 | p. 649 (right column) | pp. 998 (right column) 1000 (right column) |
| 6 Light absorbers, Filter dyes, and UV Absorbers | pp. 25–26 | pp. 649– (right column) 650 (left column) | p. 1003 (left to right column) |
| 7 Stain-preventing agents | p. 25 (right column) | p. 650 (left to right column) | — |
| 8 Image dye stabilizers | p. 25 | | |
| 9 Hardeners | p. 26 | p. 651 (left column) | pp. 1004– (right column) 1005 (left column) |
| 10 Binders | p. 26 | p. 651 (left column) | pp. 1003– (right column) 1004 (right column) |
| 11 Plasticizers and Lubricants | p. 27 | p. 650 (right column) | p. 1006 (left to right column) |
| 12 Coating aids and Surface-active agents | pp. 26—27 | p. 650 (right column) | pp. 1005– (left column) 1006 (left column) |
| 13 Antistatic agents | p. 27 | p. 650 (right colurnn) | pp. 1006– (right column) 1007 (left column) |

In the present invention, together with the light-sensitive silver halide, an organic metal salt can be added, as an oxidizing agent. Among such organic metal salts, an organic silver salt is particularly preferably used.

The organic compounds that can be used for forming the above organic silver salt oxidizing agent include benzotriazoles described in U.S. Pat. No. 4,500,626, columns 52 to 53, fatty acids, and other compounds. Also, acetylene silver described in U.S. Pat. No. 4,775,613 is useful. Organic silver salts may be used in a combination of two or more.

The above organic silver salts can be additionally used in an amount of generally 0.01 to 10 mol, and more preferably 0.01 to 1 mol, per mol of the light-sensitive silver halide. Suitably the sum of the coating amounts of the light-sensitive silver halide and the organic silver salt is 0.05 to 10 $g/m^2$, and preferably 0.1 to 4 $g/m^2$, in terms of silver.

As a method of developing the light-sensitive material of the present invention after exposure to light, a heat development method; an activator method, wherein a developing agent is built into the light-sensitive material, and the light-sensitive material is developed with an alkali processing solution; and a method wherein development is carried out using a processing solution containing a development agent/base, may be used.

The heating treatment of light-sensitive materials is known in the art, and heat-development light-sensitive materials and the process thereof are described, for example, in "Shashin Kogaku no Kiso" (published by Corona-sha, 1979), pages 553 to 555; "Eizo Joho" (published April 1978), page 40; "Nebletts Handbook of Photography and Reprography," 7th edition (Van Nostrand and Reinhold Company), pages 32 to 33; U.S. Pat. Nos. 3,152,904, 3,301,678, 3,392,020, and 3,457,075, British Patent Nos. 1,131,108 and 1,167,777, and Research Disclosure (June 1978), pages 9 to 15 (RD-17029).

The activator treatment refers to a treatment wherein a color-developing agent is built in a light-sensitive material and the light-sensitive material is developed with a processing solution free from any color-developing agent. In this case, the processing solution is characterized in that it does not contain a color-developing agent, which is normally contained as a development processing solution component, but the processing solution may contain other components (e.g. an alkali and an auxiliary developing agent). Examples of the activator treatment are shown in known publications, such as European Patent Nos. 545,491A1 and 565,165A1.

The method wherein development is carried out using a processing solution containing a developing agent/base is described in RD. No. 17643, pages 28 to 29; RD. No. 18716, 651, left column to right column; and RD. No. 307105, pages 880 to 881.

The color developer to be used for developing the light-sensitive material of the present invention is preferably an aqueous alkali solution containing, as the major component, an aromatic primary amine-series color-developing agent. As this color-developing agent, aminophenol compounds are useful, though p-phenylenediamine compounds are preferably used, and typical and preferable examples thereof include compounds described in EP No. 556700 A, page 28, lines 43 to 52. These compounds are used in a combination of two or more, in accordance with purposes. Generally the color developer contains a pH buffer, such as carbonates, borates, or phosphates of alkali metals; a development retarder, such as chlorides, bromides, iodides, benzimidazoles, benzothiazoles, or mercapto compounds; or an antifoggant, and the like. Further, if necessary, various preservatives, such as hydroxylamine, diethylhydroxylamine, sulfites, hydrazines including N,N-biscarboxymethylhydrazine, phenylsemicarbazides, triethanolamine, and catecholsulfonic acids; organic solvents, such as ethylene glycol and diethylene glycol; development accelerators, such as benzyl alcohol, polyethylene glycols, quaternary ammonium salts, and amines; dye-forming couplers; competing couplers; auxiliary developing agents, such as 1-phenyl-3-pyrazolidone; tackifiers; and various chelating agents, represented by amino polycarboxylic acids, amino polyphosphonic acids, alkylphosphonic acids, and phosphonocarboxylic acids, such as ethylenediaminetetraacetic acid, nitrilotriacetic acid, diethylenetriaminepenataaectic acid, cyclohexanediaminetetraacetic acid, hydroxylethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di-(o-hydroxyphenylacetic acid), and their salts, are added.

The pH of the color developer is generally 9 to 12. The replenishment rate of these developers depends on the color photographic light-sensitive material to be processed, and it is generally 3 liters or less per square meter of the light-sensitive material. The replenishment rate can be made to be 500 ml or less per square meter of the light-sensitive material, by reducing the bromide ion concentration in the replenisher. If the replenishment rate is reduced, it is preferable to reduce the contact area of the processing tank with air, to prevent the developer from evaporating or being oxidized by air. The processing effect due to contact of the photographic processing solution in the processing tank with air can be evaluated by the opening rate (=[the contact area of the processing solution with air ($cm^2$)]÷[the volume of the processing solution ($cm^3$)]). The opening rate is preferably 0.1 or less, and more preferably 0.001 to 0.05. As methods of reducing the opening rate, one wherein a shield, such as a floating lid, is provided on the surface of a photographic processing solution in the processing tank; a method wherein a movable lid is provided, described in JP-A No. 82032/1989; and a slit-developing method described in JP-A No. 216050/1988, can be mentioned. The opening rate is preferably reduced not only in the step of color developing and the step of black-and-white developing but also in all the subsequent steps, including the bleaching step, the bleach-fixing step, the fixing step, the washing step, and the stabilizing step. Further, the replenishment rate can be reduced by using a means of suppressing the accumulation of bromide ions in the developer. The time of the color development processing is generally set to be 2 to 5 min. The processing time can be shortened by increasing the temperature, the pH, and the concentration of the color developer.

Processing materials and processing methods used in the case of the activator treatment in the present invention will now be described in detail.

In the present invention, the light-sensitive material is developed (silver development/cross oxidation of the built-in color-forming reducing agent), desilvered, and washed with water or stabilized. In some cases, after the washing with water or the stabilizing processing, a treatment of alkalinization for color formation intensification is carried out.

When the light-sensitive material of the present invention is developed with a developing solution, preferably the developing solution contains a compound that serves as a developing agent of silver halides and/or allows the developing agent oxidation product resulting from the silver development to cross-oxidize the color-forming reducing agent built in the light-sensitive material. Preferably, pyrazolidones, dihydroxybenzenes, reductones, and aminophenols are used, and particularly preferably pyrazolidones are used.

Among pyrazolidones, 1-phenyl-3-pyrazolidones are preferable, and they include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-phenyl-5-phenyl-3-pyrazolidone, 1-p-tolyl-4-methyl-4-hydroxymethyl-3-pyrazolidone, 1-p-chlorophenyl-4-methyl-4-hydroxymethyl-3-pyrazolidone, 1-phenyl-2-hydroxymethyl-4,4-dimethyl-3-pyrazolidone, 1-phenyl-2-acetyl-3-pyrazolidone, and 1-phenyl-2-hydroxymethyl-5-phenyl-3-pyrazolidone.

Dihydroxybenzenes include hydroquinone, chlorohydroquinone, bromohydroquinone, isopropylhydroquinone, methylhydroquinone, 2,3-dichlorohydroquinone, 2,5-dichlorohydroquinone, 2,5-dimethylhydroquinone, and potassium hydroquinonemonosulfonate.

As reductones, ascorbic acid and its derivatives are preferable, and compounds described in JP-A No. 148822/1994, pages 3 to 10, can be used. In particular, sodium L-ascorbate and sodium erysorbate are preferable.

p-Aminophenols include N-methyl-p-aminophenol, N-(β-hydroxyethyl)-p-aminophenol, N-(4-hydroxyphenyl) glycine, and 2-methyl-p-aminophenol.

Although these compounds are generally used singly, use of two or more of them in combination is also preferable, to enhance the development and cross oxidation activity.

The amount of these compounds to be used in the developing solution is generally $2.5\times10^{-4}$ to 0.2 mol/liter, preferably 0.0025 to 0.1 mol/liter, and more preferably 0.001 to 0.05 mol/liter.

Example preservatives for use in the developing solution according to the present invention include sodium sulfite, potassium sulfite, lithium sulfite, ammonium sulfite, sodium bisulfite, potassium metabisulfite, formaldehyde/sodium bisulfite adduct, and hydroxylaminesulfate, which can be used in an amount in the range of generally 0.1 mol/liter or below, and preferably 0.001 to 0.02 mol/liter. If a high-silver-chloride emulsion is used in the light-sensitive material, the above compound is used in an amount of generally 0.001 mol/liter or below, and preferably it is not used at all in some cases.

In the present invention, instead of the above hydroxylamine or sulfite ions, diethylhydroxylamine, dialkylhydroxylamines described in JP-A No. 97355/1991, and organic preservatives, can be preferably used.

In the present invention, the developing solution contains halide ions, such as chloride ions, bromide ions, and iodide ions.

Herein the halide ions may be added directly to the developing solution, or they may be dissolved out from the light-sensitive material into the developing solution during the development processing.

The developing solution used in the present invention preferably has a pH of 8 to 13, and more preferably 9 to 12.

To retain the above pH, it is preferable to use various buffers. Preferably, carbonates, phosphates, tetraborates, and hydroxybenzoates are used.

The amount of the buffers to be added to the developing solution is preferably 0.05 mol/liter or over, and particularly preferably 0.1 to 0.4 mol/liter.

In addition, in the developing solution, as a sediment-preventive agent against calcium and magnesium, or as an agent for stabilizing the developing solution, various chelating agents can be used.

With respect to the amount of these chelating agents to be added, preferably the amount is enough to sequester the metal ions in the developing solution, and, for example, these chelating agents are used in an amount in the order of 0.1 to 10 g per liter.

In the present invention, if required, an arbitrary antifoggant can be added. As the antifoggant, nitrogen-containing heterocyclic compounds, and alkali metal halide, such as sodium chloride, potassium bromide, and potassium iodide, can be used.

The amount of the nitrogen-containing heterocyclic compounds to be added is generally $1\times10^{-5}$ to $1\times10^{-2}$ mol/liter, and preferably $2.5\times10^{-5}$ to $1\times10^{-3}$ mol/liter.

In the developing solution, if necessary, an arbitrary development accelerator can be added.

Preferably the developing solution contains a fluorescent whitening agent. In particular, it is preferable to use 4,4'-diamino-2,2'-disulfostilbene-series compounds.

The processing temperature of the developing solution to be applied to the present invention is generally 20° to 50° C., and preferably 30° to 45° C. The processing time is generally 5 sec to 2 min, and preferably 10 sec to 1 min. With respect to the replenishing rate, although a small amount is preferable, the replenishing rate is generally 15 to 600 ml, preferably 25 to 200 ml, and more preferably 35 to 100 ml, per $m^2$ of the light-sensitive material.

After the development, a desilvering process can be carried out. The desilvering process comprises a fixing process, or both bleaching process and a fixing process. When both bleaching and fixing are carried out, the bleaching process and the fixing process may be carried out separately or simultaneously (bleach-fixing process). Also, according to the purpose, the processing may be carried out in a bleach-fixing bath having two successive tanks; or the fixing process may be carried out before the bleach-fixing process; or the bleaching process may be carried out after the bleach-fixing process.

In some cases, it is preferable to carry out the stabilizing process, to stabilize silver salts and dye images, without carrying out the desilvering process after the development.

After the development, image-intensifying process (intensification) can be performed using peroxides, halorous acids, iodoso compounds, and cobalt(III) complex compounds described, for example, in West Germany Patent (OLS) Nos. 1,813,920, 2,044,993, and 2,735,262, and JP-A Nos. 9728/1973, 84240/1974, 102314/1974, 53826/1976, 13336/1977, and 73731/1977. To further intensify the image, an oxidizing agent for intensifying the image can be added to the above developer, so that the development and the intensification may be carried out at the same time in one bath. In particular, hydrogen peroxide is preferable, because the amplification rate is high. These intensification methods are preferable processing methods in view of environmental conservation. This is because the amount of silver in the light-sensitive material can be reduced considerably, and therefore, for example, a bleaching process is not required and silver (or silver salts) will not be released, for example, by a stabilizing process or the like.

Example bleaching agents for use in the bleaching solution or the bleach-fix solution include, for example, compounds of polyvalent metals, such as iron (III), cobalt (III), cromium (IV), and copper (II); peracids; qunones; and nitro compounds. Among them, aminopolycarboxylic acid iron (III) complex salts, such as ethylenediaminetetraacetatic acid iron (III) complex salt and 1,3-diaminopropanetetraacetic acid iron (III) complex salt; hydrogen peroxide, persulfates, and the like are preferred, in view of rapid processing and the prevention of environmental pollution.

The bleaching solution and bleach-fix solution that use these aminopolycarboxylic acid irons (III) complex salts can be used at a pH of generally 3 to 8, and preferably 5 to 7. The bleaching solution that uses persulfates or hydrogen peroxide can be used at a pH of generally 4 to 11, and preferably 5 to 10.

In the bleaching solution, the bleach-fix solution, and the bath preceding them, if required, a bleach-accelerating agent can be used.

In the bleaching solution, the bleach-fix solution, and the fixing solution, use can be made of known additives, such as a rehalogenating agent, a pH buffering agent, and a metal corrosion-preventive agent. In particular, it is preferable to contain an organic acid, to prevent bleach stain. The organic acid is preferably a compound having an acid dissociation constant (pKa) of 2 to 7.

Example fixing agents for use in the fixing solution and the bleach-fix solution include thiosulfates, thiocyanates, thioureas, a large amount of iodide salts, and thioether compounds, metho-ionic compounds, and nitrogen-containing heterocyclic compounds, having a sulfide group, as described in JP-A No. 365037/1992, pages 11 to 21, and JP-A No. 66540/1993, pages 1088 to 1092.

Preferable preservatives for the fixing solution and the bleach-fix solution are sulfites, bisulfites, carbonylbisulfite adducts, and sulfinic acid compounds described in European Patent No. 294769A.

In the fixing solution and the bleach-fix solution, further, for example, any of various fluorescent whitening agents, antifoaming agents, surface-active agents, polyvinylpyrolidones, and methanol can be contained.

The processing temperature of the desilvering step is generally 20° to 50° C., and preferably 30° to 45° C. The processing time is generally 5 sec to 2 min, and preferably 10 sec to 1 min. Although a small replenishing rate is preferable, the replenishing rate is generally 15 to 600 ml, preferably 25 to 200 ml, and more preferably 35 to 100 ml, per $m^2$ of the light-sensitive material. The processing is also preferably carried out without replenishment in such a way that the evaporated amount is supplemented with water.

The light-sensitive material of the present invention is generally passed through a washing step after the desilvering process. If a stabilizing process is carried out, the washing step can be omitted. In such a stabilizing process, processes described in JP-A Nos. 8543/1982, 14834/1983, and 220345/1985, and all known processes described in JP-A Nos. 127926/1983, 137837/1983, and 140741/1983, can be used. A washing-stabilizing process, in which a stabilizing bath containing a dye stabilizer and a surface-active agent typically used for the processing of color light-sensitive materials for photographing is used as a final bath, can be carried out.

In the washing liquid and stabilizing solution, use can be made of a water softener, such as sulfites, inorganic phosphoric acids, polyaminocarboxylic acids, and organic aminophosphonic acids; a metal salt, such as Mg salts, Al salts, and Bi salts; a surface-active agent, a hardener, a pH buffer, a fluorescent whitening agent, and a silver-salt-forming agent, such as nitrogen-containing heterocyclic compounds.

Example dye-stabilizing agents of the stabilizing solution include, for example, aldehydes, such as formalin and glutaraldehyde; N-methylol compounds, hexamethylenetetramine, or aldehyde sulfite adducts.

The pH of the washing liquid and the stabilizing solution is generally 4 to 9, and preferably 5 to 8. The processing temperature is generally 15° to 45° C., and preferably 25° to 40° C. The processing time is generally 5 sec to 2 min, and preferably 10 sec to 40 sec.

The overflow liquid associated with the replenishment of the above washing liquid and/or the stabilizing solution, can be reused in other processes, such as the desilvering process.

The amount of the washing liquid and/or the stabilizing solution can be set in a wide range depending on various conditions, and the replenishing rate is preferably 15 to 360 ml, and more preferably 25 to 120 ml, per $m^2$ of the light-sensitive material. To reduce the replenishing rate, it is preferable to use multiple tanks and a multi-stage countercurrent system.

In the present invention, in order to save water, water can be used that has been obtained by treating the overflow liquid or the in-tank liquid using a reverse osmosis membrane. For example, the treatment by reverse osmosis is preferably carried out for water from the second tank, or the more latter tank of the multi-stage countercurrent washing process and/or the stabilizing process.

In the present invention, preferably the stirring is intensified as much as possible. To intensify the stirring, specifically a method wherein a jet stream of a processing liquid is caused to impinge on the emulsion surface of a light-sensitive material, as described in JP-A Nos. 183460/1987 and 183461/1987; a method wherein a rotating means is used to increase the stirring effect, as described in JP-A No. 183461/1987; a method wherein a light-sensitive material is moved, with the emulsion surface of the material being in contact with a wiper blade provided in a liquid, so that a turbulent flow may occur near the emulsion surface, to improve the stirring effect; and a method wherein the total amount of a processing solution to be circulated is increased, can be mentioned. These means of improving the stirring are useful in any of the developing solution, the bleaching solution, the fixing solution, the bleach-fix solution, the stabilizing solution, and the washing water. These methods are effective in that the effective constituents in the solution are supplied to the light-sensitive material and the diffusion of unnecessary components in the light-sensitive material is promoted.

In the present invention, any state of the liquid opening rate [contact area of air ($cm^2$)/liquid volume ($cm^3$)] of any of the baths can exhibit excellent performance, but in view of the stability of the liquid components, preferably the liquid opening rate is 0 to 1.0 $cm^{-1}$. In the continuous processing, from a practical point of view, the liquid opening rate is preferably 0.001 to 0.05 $cm^{-1}$, and more preferably 0.002 to 0.03 $cm^{-1}$.

The automatic developing machine used for the light-sensitive material of the present invention is preferably provided with a means of transporting a light-sensitive material, as described in JP-A No. 191257/1985, 191258/1985, and 191259/1985. Such a transporting means can reduce remarkably the carry-in of the processing solution from a preceding bath to a succeeding bath. Therefore it is high in the effect of preventing the performance of a processing solution from being deteriorated. Such an effect is particularly effective in shortening the processing time of each process and in reducing the process replenishing rate. To shorten the processing time, it is preferable to shorten the crossover time (the aerial time), and a method wherein a light-sensitive material is transported between processes through a blade having a screening effect, as described, for example, in JP-A No. 86659/1992, FIGS. 4, 5, or 6, and JP-A No. 66540/1993, FIGS. 4 or 5, is preferable.

Further, if each of the processing solutions in the continuous process is concentrated due to evaporation, preferably water is added to compensate for the evaporation.

The processing time in each process according to the present invention means the time required from the start of the processing of the light-sensitive material at any process, to the start of the processing in the next process. The actual processing time in an automatic developing machine is determined generally by the linear speed and the volume of the processing bath, and in the present invention, as the linear speed, 500 to 4,000 mm/min can -be mentioned as a guide. Particularly in the case of a small-sized developing machine, 500 to 2,500 mm/min is preferable.

The processing time in the whole processing steps, that is, the processing time from the developing process to the drying process, is preferably 360 sec or below, more preferably 120 sec or below, and particularly preferably 90 to 30 sec. Herein the processing time means the time from the dipping of the light-sensitive material into the developing solution, till the emergence from the drying part of the processor.

As the processing agents with respect to this technique, various additives can be used, and more details are described in Research Disclosure Item 36544 (September 1994), whose related section is summarized below.

| Processing agent | Page |
|---|---|
| Developing agents | 536 |
| Preservatives of developing agents | 537, left column |
| Antifoggants | 537 |
| Chelating agents | 537, right column |
| Buffers | 537, right column |
| Surface-active agents | 538, left column, and 539, left column |
| Bleaching agents | 538, |
| Bleach-accelerating agents | 538, right column to 539, left column |
| Chelating agents for bleach | 539, left column |
| Rehaloganating agents | 539, left column |
| Fixing agents | 539, right column |
| Preservatives for fixing agents | 539, right column |
| Chelating agents for fixing | 540, left column |
| Surface-active agents for stabilization | 540, left |
| Scum-preventing agents for stabilization | 540, right |
| Chelating agents for stabilization | 540, right |
| Antifungus/mildew-proofing agents | 540, right |
| Image stabilizers | 540, right |

As for water-saving techniques in this art, details are described in Research Disclosure Item 36544 (September, 1994), page 540, right column, to page 541, left column.

Now, processing materials and processing methods to be used in heat development in the present invention will be described in detail.

In the light-sensitive material of the present invention, a base or a base precursor is preferably used for the purpose of accelerating silver development and the dye formation reaction. As the base precursor, for example, salts of organic acids with bases that will be decarboxylated by heat, as well as compounds that will release amines by intramolecular nucleophilic substitution reaction, Lossen rearrangement, or Beckman rearrangement, are mentioned. Specific examples thereof are described, for example, in U.S. Pat. Nos. 4,514,493 and 4,657,848 and Kochi Gijutsu (Known Techniques), No. 5, pages 55 to 86 (Mar. 22, 1991, published by Azutekku Yugen-kaisha). Further, the below-described method, as described in European Patent Publication No. 210,660 and U.S. Pat. No. 4,740,445, may be used, wherein a basic metal compound hardly soluble in water, and a compound (referred to as a complexing compound) that can react with the metal ion constituting that basic metal compound, through water as a medium, to form a complex, are used in combination, to produce a base.

The base or the base precursor is used in an amount of generally 0.1 to 20 $g/m^2$, and preferably 1 to 10 $g/m^2$.

To the light-sensitive material of the present invention may be added a heat solvent, for the purpose of accelerating the heat development. Examples thereof include polar organic compounds, as described in U.S. Pat. Nos. 3,347,675 and 3,667,959. Specifically, amide derivatives (e.g. benzamide), urea derivatives (e.g. methyl urea and ethylene urea), sulfonamide derivatives (e.g. compounds described in JP-B Nos. 40974/1989 and 13701/1992), polyol compounds, sorbitols, and polyethylene glycols can be mentioned.

When the heat solvent is insoluble in water, it is preferably used in the form of a solid dispersion. The layer to which it is added may be any of the light-sensitive layers and the light-nonsensitive layers, in accordance with the purpose.

The amount of the heat solvent to be added is generally 10 to 500% by weight, and preferably 20 to 300% by weight, based on the binder of the layer to which the heat solvent is added.

The heating temperature to be used in the heat development step is generally about 50° to 200° C., and particularly usefully 60° to 150° C.

In the heat development step, for the purpose of shielding air at the time of the development by heating; for the purpose of preventing materials from evaporating from the light-sensitive material; for the purpose of supplying materials for the processing to the light-sensitive material; or for the purpose of removing materials (e.g. YF dyes and AH dyes) in the light-sensitive material that will be unrequired after the development, or unrequired components produced at the time of the development, heating may be carried out with a material different from the light-sensitive material placed on the surface of the light-sensitive material. The base and the binder of the processing sheet used in this case may be similar to those used in the light-sensitive material.

To the processing sheet, a mordant may be added for the purpose, for example, of removing the above-described dyes. As the mordant, mordants known in the field of photography can be used, and mordants described, for example, in U.S. Pat. No. 4,500,626, columns 58 to 59, JP-A Nos. 88256/1986, pages 32 to 41, 24043/1987, and 244036/1987, can be mentioned. Also, dye-accepting polymer compounds described in U.S. Pat. No. 4,463,079 may be used.

When a processing sheet is used, the base or the base precursor is preferably contained in another sheet, because the raw stock stability of the light-sensitive material is enhanced. As for the heat solvent, the heat solvent may be incorporated into either or both of the light-sensitive material and the processing sheet, in accordance with the purpose.

When the heat development is carried out by using a processing sheet, a solvent may be used for the purpose of accelerating the development, the transfer of the materials for processing, or the diffusion of unrequired materials. Such a solvent is specifically described, for example, in U.S. Pat. Nos. 4,704,245 and 4,470,445 and JP-A No. 238056/1986.

In this system, the heating temperature is preferably at or below the boiling point of the solvent to be used. For instance, if the solvent is water, the heating temperature is 50° to 100° C.

Examples of the solvent that is used for acceleration of the development and/or for diffusion transfer of materials for processing include water, an aqueous basic solution containing an inorganic alkali metal salt or an organic base (as the base, those described in the section of image formation-accelerating agents can be used), a low-boiling solvent, and a mixed solution of a low-boiling solvent with water or the above-mentioned aqueous basic solution. Also, a surface-active agent, an antifoggant, a complexing compound with a hardly-soluble metal salt, a mildew-proofing agent, and an antifungus agent may be contained in the solvent.

As the solvent to be used in these heat development steps, water is preferably used, and the water may be any water that is generally used. Specifically, for example, distilled water, tap water, well water, and mineral water can be used. In the heat-development apparatus in which the light-sensitive material of the present invention and an image-receiving element are used, water may be used only once, or it may be circulated for repeated use. In the latter case, water that contains components dissolved out of the material will be used. Also, apparatuses and water described, for example, in JP-A Nos. 144,354/1988, 144,355/1988, 38,460/1987, and 210,555/1993 may be used.

These solvents may be used in such a way that they are applied to the light-sensitive material or the processing sheet or to both of them. The use amount of the solvent may be a weight corresponding to or below the maximum swell volume of the entire coated film.

As the method of applying water, for example, methods described, for example, in JP-A No. 253,159/1987, page 5, and 85,544/1988 are preferably used. Further, the solvent may be enclosed in microcapsules or may take the form of a hydrate, to be previously built into either or both of the light-sensitive material and the processing sheet, for use.

The suitable temperature of the water to be applied is generally 30° to 60° C., as described, for example, in JP-A No. 85,544/1988, supra.

If the heat development is effected in the presence of a small amount of water or a solvent, it is effective to adopt a method as described in European Patent Publication No. 210,660 and U.S. Pat. No. 4,740,445, wherein a basic metal compound hardly soluble in water, and a compound (referred to as a complexing compound) that can react with the metal ion constituting that basic metal compound, through water as a medium, to form a complex, are used in combination, to produce a base. In this case, desirably the basic metal compound hardly soluble in water is added to the light-sensitive material, and the complexing compound is added to the processing sheet, in view of raw stock stability.

As the heating method in the development step, for example, a method wherein contact is made with a heated block or plate; a method wherein contact is made with a heating plate, a hot presser, a heat roller, a heat dram, a halogen lamp heater, an infrared lamp heater, a far infrared lamp heater, or the like, and a method wherein passage through an atmosphere at high temperatures, are mentioned.

As the method of placing the light-sensitive material and the processing sheet together, methods described in JP-A Nos. 253,159/1987 and 147,244/1986, page 27, can be applied.

To process the photographic elements for use in the present invention, any of various heat development apparatuses can be used. For example, apparatuses described, for example, in JP-A Nos. 75,247/1984, 177,547/1984, 181,353/1984, and 18,951/1985, unexamined published Japanese Utility Model Application (JU-A) No. 25,944/1987, and Japanese Patent Application Nos. 277,517/1992, 243,072/1992, 4,244,693/1992, 164,421/1994, and 164,422/1994 are preferably used.

As a commercially available apparatus, for example, a PICTROSTAT 100, a PICTROSTAT 200, a PICTROSTAT 300, a PICTROSTAT 330, a PICTROSTAT 50, a PICTROGRAPHY 3000, and a PICTROGRAPHY 2000 (all trade names, manufactured by Fuji Photo Film Co., Ltd.), can be used.

As a heating means of thermally developing the light-sensitive material of the present invention and/or the processing sheet, a mode having an electroconductive heat-generating layer may be used. As the heat-generating element for use in this invention, one described, for example, in JP-A No. 145,544/1986 can be used.

In the light-sensitive material, various surface-active agents can be used, for example, for the purpose of acting as coating auxiliaries, for the purpose of improving releasability and slip properties, for the purpose of preventing electrification, and for the purpose of accelerating development. Specific examples of the surface-active agents are described, for example, in Kochi Gijutsu No. 5, pages 136 to 138 (Mar. 22, 1991, published by Azutekku Yugen-kaisha), and JP-A Nos. 173,463/1987 and 183,457/1987.

In the light-sensitive material, organofluoro compounds may be contained, for example, for the purpose of preventing slipperiness and electrification, and improving releasability. As representative examples of the organofluoro compounds, can be mentioned hydrophobic fluoro compounds including fluorine-containing surface-active agents described, for example, in JP-B No. 9053/1982, columns 8 to 17, and JP-A Nos. 20944/1986 and 135826/1987; oily fluoro compounds, such as fluorine-containing oils; and solid fluoro compound resins, such as ethylene tetrafluoride resins.

The light-sensitive material preferably has slipperiness. Preferably the slip-agent-containing layer is provided on the side of the light-sensitive layer, as well as on the side of the backing layer. Preferable slipperiness is 0.25 or less, but 0.01 or more, in terms of coefficient of dynamic friction. In this case, the value is obtained in the measurement wherein a sample is transferred at 60 cm/min against a stainless steel ball of a diameter 5 mm, at 25° C. and 60% RH. In this evaluation, if it is replaced with the light-sensitive surface as the partner material, the value will be almost on the same level.

Slip agents that can be used include, for example, polyorganosiloxanes, higher fatty acid amides, higher fatty acid metal salts, and esters of higher fatty acids with higher alcohols; and polyorganosiloxanes that can be used include polydimethylsiloxane, polydiethylsiloxane, polystyrylmethylsiloxane, and polymethylphenylsiloxane. The layer to which the slip agent is added is preferably the outermost layer of the emulsion layers, or the backing layer. In particular, polydimethylsiloxanes, and esters having a long-chain alkyl group are preferable.

Further, in the present invention, an antistatic agent is preferably used. As the antistatic agent, polymers, including carboxylic acids, carboxylates, and sulfonates; cationic polymers, and ionic surface-active compounds can be mentioned.

Most preferable antistatic agents are fine particles of at least one crystalline metal oxide selected from the group consisting of ZnO, $TiO_2$, $SnO_2$, $Al_2O_3$, $In_2O_3$, $SiO_2$, MgO, BaO, $MoO_3$, and $V_2O_5$, and having a specific volume resistance of $10^7$ Ω·cm or less, and more preferably $10^5$ Ω·cm or less and a particle size of 0.001 to 1.0 μm, or fine particles of their composite oxides (Sb, P, B, In, S, Si, C, etc.); as well as fine particles of the above metal oxides in the form of a sol, or fine particles of composite oxides of these. The content thereof in the light-sensitive material is preferably 5 to 500 mg/$m^2$, and particularly preferably 10 to 350 mg/$m^2$. The ratio of the amount of the electroconductive crystalline oxide or its composite oxide to the amount of the binder is preferably from 1/300 to 100/1, and more preferably from 1/100 to 100/5.

The structure of the light-sensitive material or the processing sheet (including the backing layer) can contain various polymer latexes, for the purpose of improving physical properties of the film with respect to dimensional stability, prevention of curling, adhesion, cracking of the film, desensitization of an increase in pressure, etc. Specifically, any of polymer latexes described, for example, in JP-A Nos. 245258/1987, 136648/1987, and 110066/1987 can be used. Particularly when a polymer latex having a low glass transition point (40° C. or below) is used in the mordant layer, the mortant layer can be prevented from cracking, and on the other hand, when a polymer latex having a high glass transition point is used in the backing layer, a curling-prevention effect can be obtained.

When a matting agent is used in the light-sensitive material of the present invention, the matting agent may be added to either the side of the emulsions or the side of the backing layer, and particularly preferably it is added to the outermost layer on the side of the emulsions. The matting agent may or may not be soluble in the processing solution, and preferably a matting agent soluble in the processing solution and a matting agent insoluble in the processing solution are used together. For example, polymethyl methacrylate, poly(methyl methacrylate/methacrylic acid=9/1 or 5/5 (molar ratio)), and polystyrene particles are preferably used. Preferably the particle diameter is 0.8 to 10 μm. The narrower the particle diameter distribution is, the better it is. Preferably 90% or more of all the particles is within 0.9 to 1.1 times the average particle diameter. To enhance the matte feature, it is also preferable at the same time to add fine particles of 0.8 μm or below, and examples are polymethyl methacrylates (0.2 μm), poly(methyl methacrylate/methacrylic acid=9/1 (molar ratio)) (0.3 μm), polystyrene particles (0.25 μm), and colloidal silica (0.03 μm).

Specific examples are described in JP-A No. 88256/1986, page 29. In addition, there are compounds described in JP-A Nos. 274944/1988 and 274952/1988, such as benzoguanamine resin beads, polycarbonate resin beads, and AS resin beads. Further, compounds described in the above Research Disclosure can also be used.

As the base of the light-sensitive material and the processing sheet used in the heat development system, one that can withstand the processing temperature can be used. Generally, photographic bases, such as papers and synthetic polymers (films), described in "Shashin Kogaku no Kiso, Ginen Shashin-hen," edited by Nihonshashin-gakkai, published by Korona-sha KK (1974), pages 223 to 240, can be mentioned. Specifically, polyethylene terephthalates, polyethylene naphthalates, polycarbonates, polyvinyl chlorides, polystyrenes, polypropylenes, polyimides, and celluloses (e.g. triacetylcullulose) can be mentioned.

These can be used singly or as a base, one or both surfaces of which are laminated with a synthetic polymer, such as a polyethylene.

Besides these, bases described, for example, in JP-A Nos. 253,159/1987, pages 29 to 31; 161,236/1989, pages 14 to 17; 316,848/1988, 22,651/1990, and 59,955/1991, and U.S. Pat. No. 5,001,033 can be used.

Particularly when heat resistance and curling properties are severely demanded, bases that are described as bases for light-sensitive materials in JP-A Nos. 41281/1994, 43581/1994, 51426/1994, 51437/1994, and 51442/1994, Japanese Patent Application Nos. 251845/1992, 231825/1992, 253545/1992, 258828/1992, 240122/1992, 221538/1992, 21625/1993, 15926/1993, 331928/1992, 199704/1993, 13455/1994, and 14666/1994, can be preferably used.

Further, a base of a styrene-series polymer having mainly a syndiotactic structure can be preferably used.

Further, to adhere the base to the constitutional layers of light-sensitive material, a surface treatment is preferably carried out. A surface activation treatment can be mentioned, which includes a chemical treatment, a mechanical treatment, a corona discharge treatment, a flame treatment, an ultraviolet treatment, a high-frequency treatment, a glow discharge treatment, an active-plasma treatment, a laser treatment, a mixed-acid treatment, and an ozone oxidation treatment. Among the surface treatments, an ultraviolet irradiation treatment, a flame treatment, a corona treatment, and a grow treatment are preferable.

With respect to the undercoating technique, a single layer or two or more layers may be used. As the binder for the undercoat layer, for example, copolymers produced by using, as a starting material, a monomer selected from among vinyl chloride, vinylidene chloride, butadiene, methacrylic acid, acrylic acid, itaconic acid, maleic anhydride, and the like, as well as polyethylene imines, epoxy resins, grafted gelatins, nitrocelluloses, and gelatin, can be mentioned. As compounds that can swell the base, resorcin and p-chlorophenol can be mentioned. As gelatin hardening agents in the undercoat layer, chrome salts (e.g. chrome alum), aldehydes (e.g. formaldehyde and glutaraldehyde), isocyanates, active halogen compounds (e.g. 2,4-dichloro-6-hydroxy-s-triazine), epichlorohydrin resins, active vinyl sulfone compounds, and the like can be mentioned. $SiO_2$, $TiO_2$, inorganic fine particles, or polymethyl methacrylate copolymer fine particles (0.01 to 10 $\mu$m) may be included as a matting agent.

Further, as the base, bases having a magnetic recording layer, as described in JP-A Nos. 124645/1992, 40321/1993, and 35092/1994, and Japanese Patent Application Nos. 58221/1993 and 106979/1993, can be used to record photographing information or the like.

The magnetic recording layer refers to a layer formed by coating a base with an aqueous or organic solvent coating solution containing magnetic particles dispersed in a binder.

To prepare the magnetic particles, use can be made of a ferromagnetic iron oxide, such as $\gamma Fe_2O_3$, Co-coated $\gamma Fe_2O_3$, Co-coated magnetite, Co-containing magnetite, ferromagnetic chromium dioxide, a ferromagnetic metal, a ferromagnetic alloy, hexagonal Ba ferrite, Sr ferrite, Pb ferrite, and Ca ferrite. A Co-coated ferromagnetic iron oxide, such as Co-coated $\gamma Fe_2O_3$, is preferable. The shape may be any of a needle shape, a rice grain shape, a spherical shape, a cubic shape, a plate-like shape, and the like. The specific surface area is preferably 20 $m^2/g$ or more, and particularly preferably 30 $m^2/g$ or more, in terms of $S_{BET}$. The saturation magnetization (as) of the ferromagnetic material is preferably $3.0\times10^4$ to $3.0\times10^5$ A/m, and particularly preferably $4.0\times10^4$ to $2.5\times10^5$ A/m. The ferromagnetic particles may be surface-treated with silica and/or alumina or an organic material. The surface of the magnetic particles may be treated with a silane coupling agent or a titanium coupling agent, as described in JP-A No. 161032/1994. Further, magnetic particles whose surface is coated with an inorganic or an organic material, as described in JP-A Nos. 259911/1992 and 81652/1993, can be used.

As the binder used for the magnetic particles, as described in JP-A No. 219569/1992, a thermoplastic resin, a thermal-setting resin, a radiation-setting resin, a reactive resin, an acid-degradable polymer, an alkali-degradable polymer, a biodegradable polymer, a natural polymer (e.g. a cellulose derivative and a saccharide derivative), and a mixture of these can be used. The above resins have a Tg of −40° to 300° C. and a weight-average molecular weight of 2,000 to 1,000,000. Examples include vinyl copolymers, cellulose derivatives, such as cellulose diacetates, cellulose triacetates, cellulose acetate propionates, cellulose acetate butylates, and cellulose tripropionates; acrylic resins, and polyvinyl acetal resins; and gelatin is also preferable. Cellulose di(tri)acetates are particularly preferable. To the binder may be added an epoxy, aziridine, or isocyanate crosslinking agent, to harden the binder. Examples of the isocyanate crosslinking agent include isocyanates, such as tolylene diisocyanate, 4,4'-diphenylmethane diisocyanate, hexamethylene diisocyanate, and xylylene diisocyanate; reaction products of these isocyanates with polyalcohols (e.g. a reaction product of 3 mol of tolylene diisocyanate with 1 mol of trimethylolpropane), and polyisocyanates produced by condensation of these isocyanates, which are described, for example, in JP-A No. 59357/1994.

The method of dispersing the foregoing magnetic material in the foregoing binder is preferably one described in JP-A No. 35092/1994, in which method use is made of a kneader, a pin-type mill, an annular-type mill, and the like, which may be used alone or in combination. A dispersant described in JP-A No. 088283/1993 and other known dispersants can be used. The thickness of the magnetic recording layer is generally 0.1 to 10 $\mu$m, preferably 0.2 to 5 $\mu$m, and more preferably 0.3 to 3 $\mu$m. The weight ratio of the magnetic particles to the binder is preferably from (0.5:100) to (60:100), and more preferably from (1:100) to (30:100). The coating amount of the magnetic particles is generally 0.005 to 3 $g/m^2$, preferably 0.01 to 2 $g/m^2$, and more preferably 0.02 to 0.5 $g/m^2$. The transmission yellow density of the magnetic recording layer is preferably 0.01 to 0.50, more preferably 0.03 to 0.20, and particularly preferably 0.04 to 0.15. The magnetic recording layer can be provided to the undersurface of the photographic base by coating or printing through all parts or in a striped fashion. To apply the magnetic recording layer, use can be made of an air doctor, a blade, an air knife, squeezing, impregnation, a reverse roll, a transfer roll, gravure, kiss, cast, spraying, dipping, a bar, extrusion, or the like. A coating solution described, for example, in JP-A No. 341436/1993 is preferable.

The magnetic recording layer may be provided with functions, for example, of improving lubricity, of regulating curling, of preventing electrification and adhesion, and of abrading a head, or it may be provided with another functional layer that is provided with these functions. An abrasive in which at least one type of particles comprises aspherical inorganic particles having a Moh's hardness of 5 or more, is preferable. The aspherical inorganic particles preferably comprise a fine powder of an oxide, such as aluminum oxide, chromium oxide, silicon dioxide, and titanium dioxide; a carbide, such as silicon carbide and titanium carbide; diamond, or the like. The surface of these abrasives may be treated with a silane coupling agent or a titanium coupling agent. These particles may be added to the magnetic recording layer, or they may form an overcoat (e.g. a protective layer and a lubricant layer) on the magnetic recording layer. As a binder used at that time, the above-mentioned binders can be used, and preferably the same binder as used in the magnetic recording layer is used. Light-sensitive materials having a magnetic recording layer are described in U.S. Pat. Nos. 5,336,589, 5,250,404, 5,229,259, and 5,215,874, and EP No. 466,130.

Polyester bases preferably used in the above light-sensitive material having a magnetic recording layer will be further described (details, including light-sensitive materials, processing, cartridges, examples, etc., are described in Kokaigiho, Kogi No. 94-6023 (Hatsumei-kyokai; 15, 3, 1994)). Polyesters are produced by using, as essential components, diols and aromatic dicarboxylic acids. The aromatic dicarboxylic acids include 2,6-, 1,5-, 1,4- and 2,7-naphthalene dicarboxylic acids; terephthalic acid, isophthalic acid, and phthalic acid; and the diols include diethylene glycol, triethylene glycol, cyclohexanedimethanol, bisphenol A, and bisphenols. Their polymers include homopolymers, such as polyethylene terephthlates, polyethylene naphthalates, and polycyclohexanedimethanol terephthalates. Polyesters comprising 2,6-naphthalenedicarboxylic acid as an acidic reaction component, at a content of 50 to 100 mol % of the total dicarboxylic acid component, are particularly preferable. Among them, polyethylene 2,6-naphthalates are particularly preferable. The average molecular weight is in the range of generally about 5,000 to 200,000. The Tg of the polyesters is generally 50° C. or over, and preferably 90° C. or over.

Then the polyester base is heat-treated at a heat treatment temperature of generally 40° C. or over, but less than the Tg, and preferably at a heat treatment temperature of the Tg−20° C. or more, but less than the Tg, so that it will hardly have core set curl. The heat treatment may be carried out at a constant temperature in the above temperature range, or it may be carried out with cooling. The heat treatment time is generally 0.1 hour or more, but 1,500 hours or less, and preferably 0.5 hours or more, but 200 hours or less. The heat treatment of the base may be carried out with the base rolled, or it may be carried out with it being conveyed in the form of web. The surface of the base may be made rough (unevenness, for example, by applying electroconductive inorganic fine particles, such as $SnO_2$ and $Sb_2O_5$), so that the surface state may be improved. Further, it is desirable to provide, for example, a rollette (knurling) at the both ends for the width of the base (both right and left ends towards the direction of rolling) to increase the thickness only at the ends, so that a trouble of deformation of the base will be prevented. The trouble of deformation of the base means that, when a base is wound on a core, on its second and further winding, the base follows unevenness of its cut edge of the first winding, deforming its flat film-shape. These heat treatments may be carried out at any stage after the production of the base film, after the surface treatment, after the coating of a backing layer (e.g. with an antistatic agent and a lubricant), and after coating of an undercoat, with preference given to after coating of an antistatic agent.

Into the polyester may be blended an ultraviolet absorber. Further, prevention of light piping can be attained by blending dyes or pigments commercially available for polyesters, such as Diaresin (trade name, manufactured by Mitsubisi Chemical Industries Ltd.), and Kayaset (trade name, manufactured by Nippon Kayaku Co., Ltd.).

Film patrones (magazines) into which the light-sensitive material can be loaded for use as a photographing material are now described. The major material of the patrone to be used in the present invention may be metal or synthetic plastic.

Preferable plastic materials are polystyrenes, polyethylenes, polypropylenes, polyphenyl ethers, and the like. Further, the patrone may contain various antistatic agents, and preferably, for example, carbon black, metal oxide particles; nonionic, anionic, cationic, and betaine surface-active agents, or polymers can be used. These antistatic patrones are described in JP-A Nos. 312537/1989 and 312538/1989. In particular, the resistance of the patrone at 25° C. and 25% RH is preferably $10^{12}$ Ω or less. Generally, plastic patrones are made of plastics with which carbon black or a pigment has been kneaded, to make the patrones screen light. The size of the patrone may be size 135, which that is currently used, and, to make cameras small, it is effective to change the diameter of the 25-mm cartridge of the current size 135, to 22 mm or less. Preferably the volume of the case of the patrone is 30 $cm^3$ or less, and more preferably 25 $cm^3$ or less. The weight of the plastic to be used for the patrone or the patrone case is preferably 5 g to 15 g.

Further, the patrone may be one in which a spool is rotated to deliver a film. Also the structure may be such that the forward end of film is housed in the patrone body, and by rotating a spool shaft in the delivering direction, the forward end of the film is delivered out from a port of the patrone. These patrones are disclosed in U.S. Pat. Nos. 4,834,306 and 5,226,613.

As the method of making a print on a heat development light-sensitive material or a color paper by using this color photographing material, methods described in JP-A Nos. 241251/1993, 19364/1993, and 19363/1993 can be employed.

When the developing agent of the present invention is used, color-forming properties, as well as hue, can be improved greatly (e.g. the absorption of the formed dye is made to fall in the long-wavelength range), and further the stability of a dye itself can be improved remarkably, because it becomes remarkably stable as a dissociated product.

EXAMPLES

The present invention will be described in more detail with reference to Examples, but the present invention is not restricted to them.

Example 1

A paper base, both surfaces of which had been laminated with a polyethylene, was subjected to surface corona discharge treatment; then it was provided with a gelatin undercoat layer containing sodium dodecylbenzensulfonate, and it was coated with three photographic constitutional layers, to produce a photographic printing paper (100) having the three-layer constitution shown below. The coating solutions were prepared as follows.

(Second-Layer Coating Solution)

17 g of a coupler (ExY), 20 g of a color-forming reducing agent (R-1), and 80 g of a solvent (Solv-1) were dissolved in ethyl acetate, and the resulting solution was emulsified and dispersed into 400 g of a 16% gelatin solution containing 10% sodium dodecylbenzensulfonate and citric acid, to prepare an emulsified dispersion A. On the other hand, a silver chlorobromide emulsion A (cubes, a mixture of a large-size emulsion A having an average grain size of 0.10 μm, and a small-size emulsion A having an average grain size of 0.08 μm (3:7 in terms of mol of silver), the deviation coefficients of the grain size distributions being 0.08 and 0.10 respectively, and each emulsion having 0.3 mol % of silver bromide locally contained in part of the grain surface whose substrate was made up of silver chloride) was prepared. To the large-size emulsion A of this emulsion, had been added $7.0\times10^{-4}$ mol, per mol of silver, of each of blue-sensitive sensitizing dyes A, B, and C shown below, and to the small-size emulsion A of this emulsion, had been added $8.6\times10^{-4}$ mol, per mol of silver, of each of blue-sensitive sensitizing dyes A, B, and C shown below. The chemical ripening of this emulsion was carried out with a sulfur sensitizer and a gold sensitizer being added. The above emulsified dispersion A and this silver chlorobromide emulsion A were mixed and dissolved, and a second-layer coating solution was prepared so that it would have the composition shown below. The coating amount of the emulsion is in terms of silver.

The coating solutions for the first layer and the third layer were prepared in the similar way as that for the second-layer coating solution. As the gelatin hardener for each layer, 1-oxy-3,5-dichloro-s-triazine sodium salt was used.

Further, to each layer, were added Cpd-2, Cpd-3, Cpd-4, and Cpd-5, so that the total amounts would be 15.0 $mg/m^2$, 60.0 $mg/m^2$, 52.0 $mg/m^2$, and 10.0 $mg/m^2$, respectively.

For the silver chlorobromide emulsion of the second layer, the following spectral sensitizing dyes were used.

Sensitizing dye A

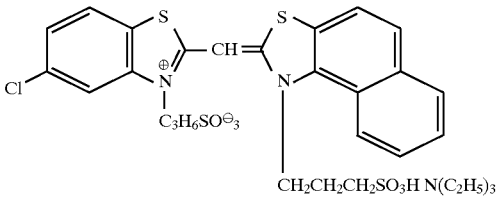

Sensitizing dye B

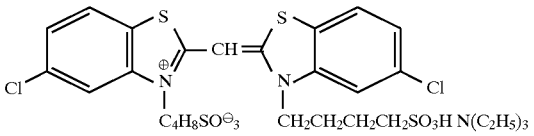

Sensitizing dye C

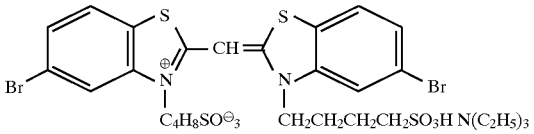

Further, 1-(5-methylureidophenyl)-5-mercaptotetrazole was added, in an amount of $3.0\times10^{-3}$ mol per mol of the silver halide.

(Layer constitution)

The composition of each layer is shown below. The figures show coating amounts ($g/m^2$). The coating amounts of the silver halide emulsions are in terms of silver. The fine-particle solid dispersion of 1,5-diphenyl-3-pyrazolidone added to the first layer was prepared according to the method described in JP-A No. 235044/1990, page 20.

Base

Polyethylene-Laminated Paper

[The polyethylene on the first layer side contained a white pigment ($TiO_2$) and a blue dye (ultramarine)]

| First Layer | |
|---|---|
| Gelatin | 1.08 |
| 1,5-diphenyl-3-pyrazolidone (in a state of fine-particle solid dispersion) | 0.02 |

-continued

| Second Layer | |
|---|---|
| The above silver chlorobromide emulsion A | 0.01 |
| Gelatin | 1.48 |
| Yellow coupler (ExY) | 0.17 |
| Color-forming reducing agent (R-1) | 0.20 |
| Solvent (Solv-1) | 0.79 |
| Third Layer (protective layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-1) | 0.01 |

Samples (101) to (106) were prepared in the same manner as in Sample (100), except that the yellow coupler and the color-forming reducing agent in the coating solution of the second layer were changed to the yellow coupler and the color-forming reducing agent, in the same molar amounts, shown in Table 1.

Further, Samples (200) to (207) were prepared in the same manner as in Sample (100), except that, in the coating solution of the second layer, the silver chlorobromide emulsion A was changed to the following silver chlorobromide emulsion B, in the same amount of silver, and the coupler and the color-forming reducing agent were changed to the magenta coupler and the color-forming reducing agent, in the same molar amounts, shown in Table 2.

A silver chlorobromide emulsion B: cubes, a mixture of a large-size emulsion B having an average grain size of 0.10 μm, and a small-size emulsion B having an average grain size of 0.08 μm (1:3 in terms of mol of silver). The deviation coefficients of the grain size distributions were 0.10 and 0.08, respectively, and each emulsion had 0.8 mol % of AgBr locally contained in part of the grain surface whose substrate was made up of silver chloride.

For the silver chlorobromide emulsion B, the following spectral sensitizing dyes were used:

Sensitizing dye D

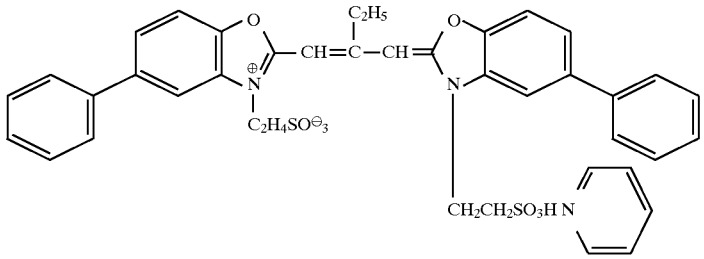

-continued

Sensitizing dye E

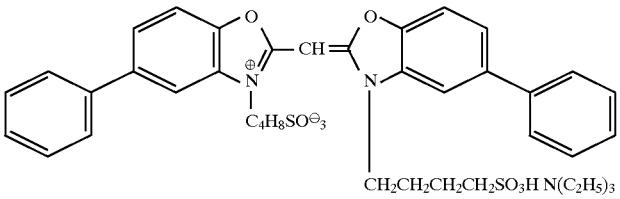

Sensitizing dye F

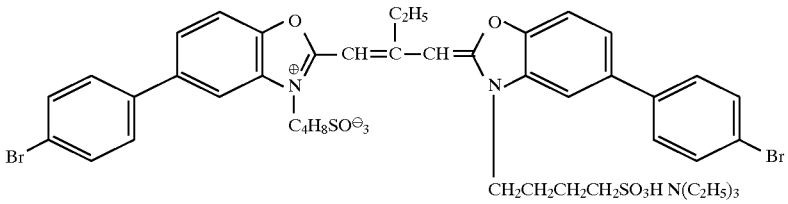

(The sensitizing dye D was added to the large-size emulsion in an amount of $1.5\times10^{-3}$ mol per mol of the silver halide, and to the small-size emulsion in an amount of $1.8\times10^{-3}$ mol per mol of the silver halide; the sensitizing dye E was added to the large-size emulsion in an amount of $2.0\times10^{-4}$ mol per mol of the silver halide, and to the small-size emulsion in an amount of $3.5\times10^{-4}$ mol per mol of the silver halide; and the sensitizing dye F was added to the large-size emulsion in an amount of $1.1\times10^{-3}$ mol per mol of the silver halide, and to the small-size emulsion in an amount of $1.4\times10^{-3}$ mol per mol of the silver halide.)

Further, Samples (300) to (305) were prepared in the same manner as in Sample (100), except that, in the coating solution of the second layer, the silver chlorobromide emulsion A was changed to the following silver chlorobromide emulsion C, in the same amount of silver, and the coupler and the color-forming reducing agent were changed to the cyan coupler and the color-forming reducing agent, in the same molar amounts, shown in Table 3.

A silver chlorobromide emulsion C: cubes, a mixture of a large-size emulsion C having an average grain size of 0.10 μm, and a small-size emulsion C having an average grain size of 0.08 μm (1:4 in terms of mol of silver). The deviation coefficients of the grain size distributions were 0.09 and 0.11, respectively, and each emulsion had 0.8 mol % of AgBr locally contained in part of the grain surface whose substrate was made up of silver chloride.

For the silver chlorobromide C, the following spectral sensitizing dyes were used:

Sensitizing dye G

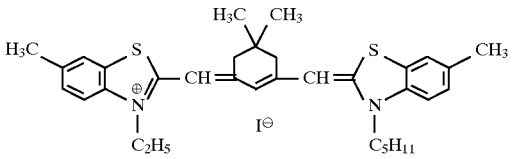

-continued

Sensitizing dye H

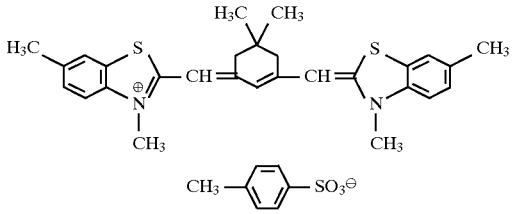

(Each was added to the large-size emulsion in an amount of $2.6\times10^{-4}$ mol per mol of the silver halide, and to the small-size emulsion in an amount of $4.0\times10^{-4}$ per mol of the silver halide.)

(R-1)

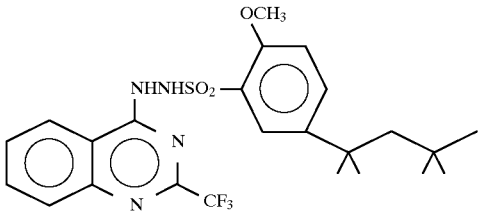

(Compound described in European Pat. No. 545491A1)

(Cpd-1) Surface-active agent 7:3 mixture (by weight ratio) of

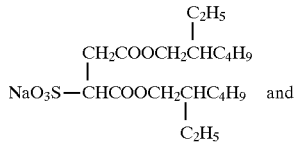

and

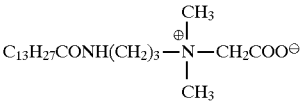

-continued (Cpd-2) Antiseptic

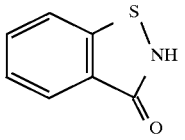

(Cpd-3) Antiseptic

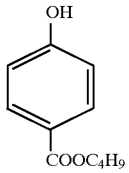

(Cpd-4) Antiseptic 1:1:1:1 mixture of a, b, c, d

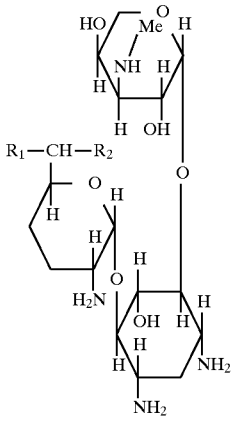

| | $R_1$ | $R_2$ |
|---|---|---|
| a | —Me | —NHMe |
| b | —Me | —$NH_2$ |
| c | —H | —$NH_2$ |
| d | —H | —NHMe |

(Cpd-5) Antiseptic

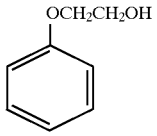

(Solv-1) Solvent

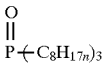

Using an FWH-type sensitometer (color temperature of the light source: 3,200° K), manufactured by Fuji Photo Film Co., Ltd., gradation exposure was given to the thus prepared Samples (100) to (106) through a blue filter for sensitometry, to the thus prepared Samples (200) to (207) through a green filter for sensitometry, and to the thus prepared Samples (300) to (305) through a red filter for sensitometry.

The thus exposed Samples were processed with the following processing solutions in the following processing steps:

(Processing Step 1)

| Processing step | Temperature | Time |
|---|---|---|
| Development | 40° C. | 40 sec |
| Rinse | room temperature | 45 sec |

(Developing Solution (alkali activating solution containing hydrogen peroxide))

| | |
|---|---|
| Water | 600 ml |
| Potassium phosphate | 40 g |
| KCl | 5 g |
| Hydroxylethylidene-1,1-diphosphonic acid (30%) | 4 ml |
| $H_2O_2$ | 10 ml |
| Water to make | 1,000 ml |
| pH (at 25° C. by using potassium hydroxide) | 11.5 |

As a rinsing solution, water was used, which had been prepared by adding sodium chloroisocyanurate to deionized water (having a conductivity of 5 μS/cm or below) in an amount of 0.02 g/liter, to conduct sterilization. The pH thereof was 6.5.

The maximum color density (Dmax) part of the processed Samples (100) to (106) was measured using blue light; the maximum color density part of the processed Samples (200) to (207) was measured using green light; and the maximum color density part of the processed Samples (300) to (305) was measured using red light. The results are shown in Tables 1, 2, and 3, respectively.

TABLE 1

| Sample No. | Color-forming reducing agent | Coupler | Dmax | Remarks |
|---|---|---|---|---|
| 100 | R-1 | C-21 | 0.14 | Comparative Example |
| 101 | D-1 | " | 0.71 | This Invention |
| 102 | D-4 | " | 0.70 | " |
| 103 | D-5 | " | 0.65 | " |
| 104 | D-6 | " | 0.58 | " |
| 105 | D-8 | " | 0.62 | " |
| 106 | D-16 | " | 0.64 | " |

TABLE 2

| Sample No. | Color-forming reducing agent | Coupler | Dmax | Remarks |
|---|---|---|---|---|
| 200 | R-1 | C-56 | 0.16 | Comparative Example |
| 201 | D-1 | " | 0.98 | This Invention |
| 202 | D-4 | " | 0.89 | " |
| 203 | D-5 | " | 0.79 | " |
| 204 | D-6 | " | 0.52 | " |
| 205 | R-1 | C-63 | 0.15 | Comparative Example |
| 206 | D-11 | " | 0.69 | This invention |
| 207 | D-12 | " | 0.73 | " |

TABLE 3

| Sample No. | Color-forming reducing agent | Coupler | Dmax | Remarks |
|---|---|---|---|---|
| 300 | R-1 | C-44 | 0.18 | Comparative Example |
| 301 | D-1 | " | 0.98 | This Invention |
| 302 | D-5 | " | 0.86 | " |

TABLE 3-continued

| Sample No. | Color-forming reducing agent | Coupler | Dmax | Remarks |
|---|---|---|---|---|
| 303 | R-1 | C-66 | 0.20 | Comparative Example |
| 304 | D-1 | " | 0.92 | This invention |
| 305 | D-5 | " | 0.86 | " |

As is apparent from the results in Tables 1, 2, and 3, can be understood that, by using the color-forming reducing agents of the present invention, even if auxiliary developing agent was built into light-sensitive materials and intensification was carried out with hydrogen peroxide, remarkably high color densities were obtained.

Example 2

A paper base, both surfaces of which had been laminated with a polyethylene, was subjected to surface corona discharge treatment; then it was provided with a gelatin undercoat layer containing sodium dodecylbenzensulfonate, and it was coated with various photographic constitutional layers, to produce a multi-layer photographic color printing paper (400) having the layer constitution shown below. The coating solutions were prepared as follows.

(First-Layer Coating Solution)

17 g of a coupler (ExY), 20 g of a color-forming reducing agent (R-1), and 80 g of a solvent (Solv-2) were dissolved in ethyl acetate, and the resulting solution was emulsified and dispersed into 400 g of a 16% gelatin solution containing 10% sodium dodecylbenzensulfonate and citric acid, to prepare an emulsified dispersion A. On the other hand, a silver chlorobromide emulsion D (cubes, a mixture of a large-size emulsion D having an average grain size of 0.88 μm, and a small-size emulsion D having an average grain size of 0.70 μm (3:7 in terms of mol of silver), the deviation coefficients of the grain size distributions being 0.08 and 0.10, respectively, and each emulsion having 0.3 mol % of silver bromide locally contained in part of the grain surface whose substrate was made up of silver chloride) was prepared. To the large-size emulsion D of this emulsion, had been added $1.4\times10^{-4}$ mol, per mol of silver, of each of blue-sensitive sensitizing dyes A, B , and C used in the Example 1, and to the small-size emulsion D of this emulsion, had been added $1.7\times10^{-4}$ mol, per mol of silver, of each of blue-sensitive sensitizing dyes A, B, and C used in the Example 1. The chemical ripening of this emulsion was carried out with a sulfur sensitizer and a gold sensitizer being added. The above emulsified dispersion A and this silver chlorobromide emulsion D were mixed and dissolved, and a first-layer coating solution was prepared so that it would have the composition shown below. The coating amount of the emulsion is in terms of silver.

In the similar way as the method of preparing the first-layer coating solution, coating solutions for the second layer to the seventh layer were prepared. As the gelatin hardeners for each layers, 1-oxy-3,5-dichloro-s-triazine sodium salt was used.

Further, to each layer, were added Cpd-2, Cpd-3, Cpd-4, and Cpd-5, so that the total amounts would be 15.0 mg/m$^2$, 60.0 mg/m$^2$, 48.0 mg/m$^2$, and 11.0 mg/m$^2$, respectively.

For the silver chlorobromide emulsion of each photosensitive emulsion layer, the following spectral sensitizing dyes were used.

(Blue-Sensitive Emulsion Layer)

The blue-sensitive sensitizing dyes A, B, and C, used in the Example 1, were added in amounts as follows. (Each was added to the large-size emulsion in an amount of $1.4\times10^{-4}$ mol, per mol of silver halide, and to the small-size emulsion in an amount of $1.6\times10^{-4}$ mol per mol of silver halide.)

(Green-Sensitive Emulsion Layer)

The green-sensitive sensitizing dyes D, E, and F, used in the Example 1, were added in amounts as follows.

(The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.)

(Red-Sensitive Emulsion Layer)

The red-sensitive sensitizing dyes G and H, used in the Example 1, were added in amounts as follows.

(Each was added to the large-size emulsion in an amount of $5.0\times10^{-5}$ mol per mol of the silver halide, and to the small-size emulsion in an amount of $8.0\times10^{-5}$ per mol of the silver halide.)

Further, the following compound was added to the fifth layer (the red-sensitive emulsion layer) in an amount of $2.6\times10^{-2}$ mol per mol of the silver halide.

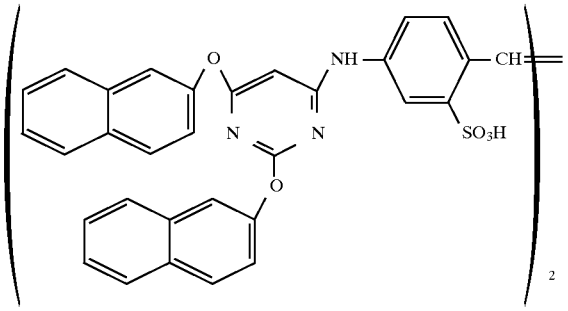

To the blue-sensitive emulsion layer, the green-sensitive emulsion layer, and the red-sensitive emulsion layer, was added 1-(5-methylureidophenyl)- 5-mercaptotetrazole in amounts of $3.5\times10^{-4}$ mol, $3.1\times10^{-3}$ mol, and $2.6\times10^{-4}$ mol, respectively, per mol of the silver halide.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to prevent irradiation, the following dyes were added to the emulsion layers (the coating amount is shown in parentheses).

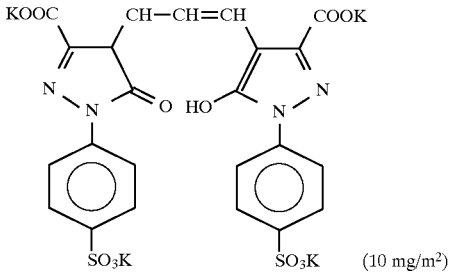

(10 mg/m$^2$)

and

-continued

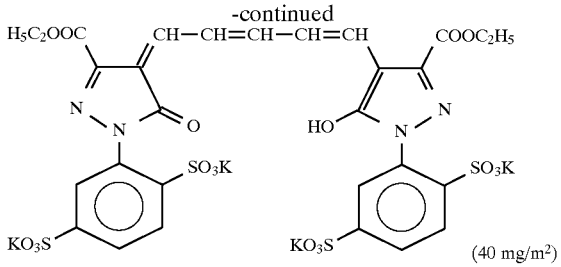

(Layer Constitution)

The composition of each layer is shown below. The numbers show coating amounts (g/m$^2$). In the case of the silver halide emulsion, the coating amount is in terms of silver.

Base

Polyethylene-Laminated Paper

[The polyethylene on the first layer side contained a white pigment ($TiO_2$) and a blue dye (ultramarine)]

| | |
|---|---|
| First Layer (Blue-Sensitive Emulsion Layer) | |
| The above silver chlorobromide emulsion D | 0.20 |
| Gelatin | 1.52 |
| Yellow coupler (ExY) | 0.17 |
| Color-forming reducing agent (R-1) | 0.20 |
| Solvent (Solv-1) | 0.81 |
| Second Layer (Color Mixing Inhibiting Layer) | |
| Gelatin | 1.12 |
| Color mixing inhibitor (Cpd-6) | 0.11 |
| Solvent (Solv-2) | 0.19 |
| Solvent (Solv-3) | 0.07 |
| Solvent (Solv-4) | 0.27 |
| Solvent (Solv-5) | 0.09 |
| 1,5-diphenyl-3-pyrazolidone (in a state of fine-article solid dispersion) | 0.03 |
| Third Layer (Green-Sensitive Emulsion Layer) | |
| A silver chlorobromide emulsion E: cubes, a mixture of a large-size emulsion E having an average grain size of 0.55 μm, and a small-size emulsion E having an average grain size of 0.39 μm (1:3 in terms of mol of silver). The deviation coefficients of the grain size distributions were 0.10 and 0.08, respectively, and each emulsion had 0.8 mol % of AgBr contained in part of the grain surface whose substrate was made up of silver chloride. | 0.20 |
| Gelatin | 1.49 |
| Magenta coupler (ExM) | 0.24 |
| Color-forming reducing agent (R-1) | 0.20 |
| Solvent (Solv-1) | 0.80 |
| Fourth Layer (Color Mixing Inhibiting Layer) | |
| Gelatin | 0.78 |
| Color mixing inhibitor (Cpd-6) | 0.08 |
| Solvent (Solv-2) | 0.14 |
| Solvent (Solv-3) | 0.05 |
| Solvent (Solv-4) | 0.14 |
| Solvent (Solv-5) | 0.06 |
| 1,5-diphenyl-3-pyrazolidone (in a state of fine-particle solid dispersion) | 0.02 |
| Fifth Layer (Red-Sensitive Emulsion Layer) | |
| A silver chlorobromide emulsion F: cubes, a mixture of a large-size emulsion F having an average grain size of 0.5 μm, and a small-size emulsion F having an average grain size of 0.41 μm (1:4 in terms of mol of silver). The deviation coefficients of the grain size distributions were 0.09 and 0.11, respectively, and each emulsion had 0.8 mol % of silver bromide locally contained in part of the grain surface whose substrate was made up of silver chloride. | 0.20 |

-continued

| | |
|---|---|
| Gelatin | 1.50 |
| Cyan coupler (ExC) | 0.21 |
| Color-forming reducing agent (R-1) | 0.20 |
| Solvent (Solv-1) | 0.79 |
| Sixth Layer (Ultraviolet Absorbing Layer) | |
| Gelatin | 0.63 |
| Ultraviolet absorbing agent (UV-1) | 0.39 |
| Color image stabilizer (Cpd-7) | 0.05 |
| Solvent (Solv-6) | 0.05 |
| Seventh Layer (Protective Layer) | |
| Gelatin | 0.99 |
| Acryl-modified copolymer of polyvinyl alcohol (modification degree: 17%) | 0.04 |
| Liquid paraffin | 0.02 |
| Surface-active agent (Cpd-1) | 0.01 |

(Cpd-6) Color mixing inhibitor mixture (by weight ratio) of (1):(2):(3)=1:1:1

(1)

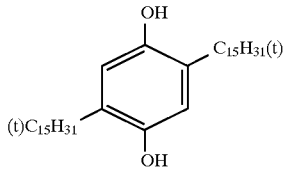

(2)

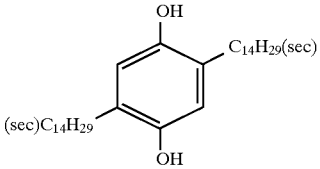

(3)

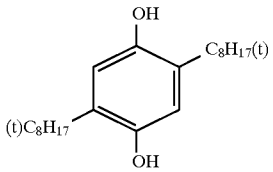

(Cpd-7) Color image stabilizer

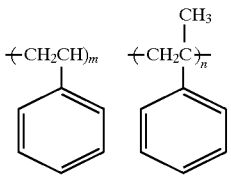

number-average molecular weight 600 m/m = 9/1

(Solv-2) Solvent

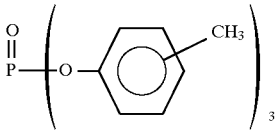

-continued (Solv-3) Solvent

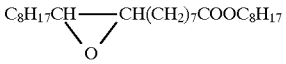

(Solv-4) Solvent

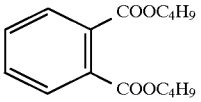

(Solv-5) Solvent

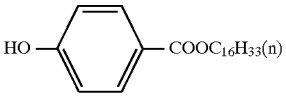

(Solv 6) Solvent

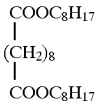

(UV-1) Ultraviolet absorbent mixture (by weight ratio) of (1):(2):(3):(4):(5) = 1:2:2:3:1

(1)

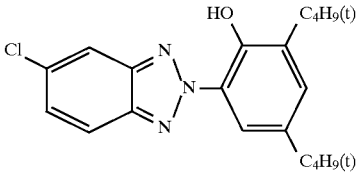

(2)

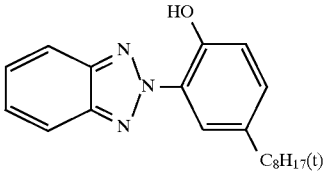

-continued (3)

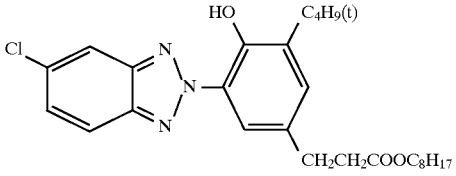

(4)

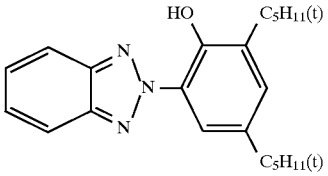

(5)

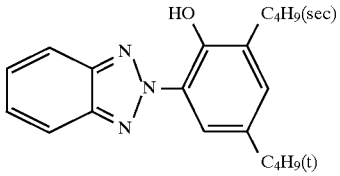

Samples (401) to (407) were prepared in the same manner as in Sample (400), except that instead of the coupler and the color-forming reducing agent, the coupler and the color-forming reducing agent shown in Table 4 were used, in the same molar amounts.

TABLE 4

| | Cyan | | | Magenta | | | Yellow | | |
|---|---|---|---|---|---|---|---|---|---|
| Sample No. | Coupler | Color-forming reducing agent | Added amount | Coupler | Color-forming reducing agent | Added amount | Coupler | Color-forming reducing agent | Added amount |
| 400 (Comparative Example) | C-68 | R-1 | 1.0 | C-56 | R-1 | 1.0 | C-21 | R-1 | 1.0 |
| 401 (This invention) | " | D-1 | 1.0 | " | D-1 | 1.0 | " | D-1 | 1.0 |
| 402 (This invention) | " | D-6 | 1.0 | " | D-6 | 1.0 | " | D-6 | 1.0 |
| 403 (This invention) | " | D-10 | 1.0 | " | D-10 | 1.0 | " | D-10 | 1.0 |
| 404 (This invention) | " | D-16 | 1.0 | C-63 | D-16 | 1.0 | " | D-16 | 1.0 |

TABLE 4-continued

| Sample No. | Cyan Coupler | Cyan Color-forming reducing agent | Cyan Added amount | Magenta Coupler | Magenta Color-forming reducing agent | Magenta Added amount | Yellow Coupler | Yellow Color-forming reducing agent | Yellow Added amount |
|---|---|---|---|---|---|---|---|---|---|
| 405 (Comparatve Example) | C-44 | R-1 | 1.2 | " | R-1 | 1.0 | C-3 | R-1 | 1.0 |
| 406 (This invention) | " | D-1 | 1.2 | " | D-1 | 0.9 | " | D-1 | 0.9 |
| 407 (This invention) | " | D-16 | 1.2 | " | D-16 | 0.9 | " | D-16 | 0.9 |

Added amount is represented in terms of the molar ratio to the color-developing agent of each layer of the light-sensitive material 400.

By using an FWH-type sensitometer (color temperature of the light source: 3,200° K), manufactured by Fuji Photo Film Co., Ltd., gradation exposure was given to all of the thus prepared Samples through a three color separation filter for sensitometry.

The thus exposed Samples were processed with the following processing solutions in the following processing steps:

| Processing step | Temperature | Time |
|---|---|---|
| Development | 40° C. | 30 sec |
| Bleach-fix | 40° C. | 45 sec |
| Rinse | room temperature | 90 sec |

(Developing Solution (alkali activating solution))

| | |
|---|---|
| Water | 600 ml |
| Potassium phosphate | 40 g |
| KCl | 5 g |
| Hydroxylethylidene-1,1-diphosphonic acid (30%) | 4 ml |
| Water to make | 1,000 ml |
| pH (at 25° C. by using potassium hydroxide) | 12 |

(Bleach-fix Solution)

| | |
|---|---|
| Water | 600 ml |
| Ammonium thiosulfate (700 g/liter) | 93 ml |
| Ammonium sulfite | 40 g |
| Ethylenediaminetetraacetic acid iron (III) ammonium salt | 55 g |
| Ethylenediamintetraacetic acid | 2 g |
| Nitric acid (67%) | 30 g |
| Water to make | 1,000 ml |
| pH (at 25° C. by using acetic acid and aqueous ammonia) | 5.8 |

The rinsing solution used in the Example 1 was used.

For the processed Samples, the maximum color density (Dmax) part and the minimun color density (Dmin) part that was non-exposed part were measured using red light, green light, and blue light. The results are shown in Table 5.

TABLE 5

| Sample No. | Cyan Dmin | Cyan Dmax | Magenta Dmin | Magenta Dmax | Yellow Dmin | Yellow Dmax |
|---|---|---|---|---|---|---|
| 400 (Comparative Example) | 0.20 | 0.24 | 0.19 | 0.24 | 0.17 | 0.19 |
| 401 (This invention) | 0.19 | 0.97 | 0.18 | 0.96 | 0.17 | 0.70 |
| 402 (This invention) | 0.19 | 0.85 | 0.19 | 0.88 | 0.16 | 0.68 |

TABLE 5-continued

| Sample No. | Cyan Dmin | Cyan Dmax | Magenta Dmin | Magenta Dmax | Yellow Dmin | Yellow Dmax |
|---|---|---|---|---|---|---|
| 403 (This invention) | 0.20 | 0.88 | 0.19 | 0.90 | 0.17 | 0.60 |
| 404 (This invention) | 0.19 | 0.79 | 0.18 | 0.82 | 0.17 | 0.59 |
| 405 (Comparative Example) | 0.21 | 0.25 | 0.19 | 0.23 | 0.17 | 0.20 |
| 406 (This invention) | 0.20 | 1.10 | 0.19 | 0.89 | 0.16 | 0.65 |
| 407 (This invention) | 0.21 | 0.98 | 0.18 | 0.78 | 0.16 | 0.60 |

As is apparent from the results in Table 5, it can be understood that, even in the cases of a multilayer light-sensitive material having an auxiliary developing agent built therein, remarkably high color densities were obtained. Further, the images obtained from the light-sensitive materials of the present invention were excellent in hue and image stability, when compared to those of Comparative Examples.

Example 3

A paper base, both surfaces of which had been laminated with a polyethylene, was subjected to surface corona discharge treatment; then it was provided with a gelatin undercoat layer containing sodium dodecylbenzensulfonate, and it was coated with three photographic constitutional layers, to produce a multi-layer photographic printing paper (500) having three layers shown below. The coating solutions were prepared as follows.

(First-Layer Coating Solution)

17 g of a coupler (Y-1), 20 g of a color-forming reducing agent (R-1), and 80 g of a solvent (Solv-2) were dissolved in ethyl acetate, and the resulting solution was emulsified and dispersed into a 16% gelatin solution containing 10% sodium dodecylbenzensulfonate and citric acid, to prepare an emulsified dispersion D. The emulsified dispersion D and the silver chlorobromide emulsion D used in the Example 2 were mixed and dissolved, and a first-layer coating solution was prepared so that it would have the composition shown below. The coating amount of the emulsion is in terms of silver.

In the similar way as the method of preparing the first-layer coating solution, coating solutions for the second layer and the third layer were prepared. As the gelatin hardeners for each layers, 1-oxy-3,5-dichloro-s-triazine sodium salt was used.

Further, to each layer, were added Cpd-2, Cpd-3, Cpd-4, and Cpd-5, so that the total amounts would be 15.0 mg/m$^2$, 60.0 mg/m$^2$, 50.0 mg/m$^2$, and 10.0 mg/m$^2$, respectively.

For the silver chlorobromide emulsion of the first layer, the blue-sensitive sensitizing dyes A, B, and C, used in the Example 2, were used in the same amounts as in the Example 2.

Further, 1-(5-methylureidophenyl)-5-mercaptotetrazole was added in amount of $3.0\times10^{-3}$ mol per mol of the silver halide.

(Layer Constitution)

The composition of each layer is shown below. The numbers show coating amounts (g/m$^2$). In the case of the silver halide emulsion, the coating amount is in terms of silver.

Base

Polyethylene-Laminated Paper

[The polyethylene on the first layer side contained a white pigment ($TiO_2$) and a blue dye (ultramarine)]

| | |
|---|---|
| First Layer | |
| The above silver chlorobromide emulsion D | 0.20 |
| Gelatin | 1.49 |
| Yellow coupler (Y-1) | 0.17 |
| Color-forming reducing agent (R-1) | 0.20 |
| Solvent (Solv-2) | 0.81 |
| Second Layer | |
| Gelatin | 3.20 |
| Mordant (Cpd-8) | 3.25 |
| Third Layer (Protective Layer) | |
| Gelatin | 1.02 |
| Acryl-modified copolymer of polyvinyl alcohol (modification degree: 17%) | 0.04 |
| Liquid paraffin | 0.02 |
| Surface-active agent (Cpd-1) | 0.01 |

(Cpd-8) Mordant

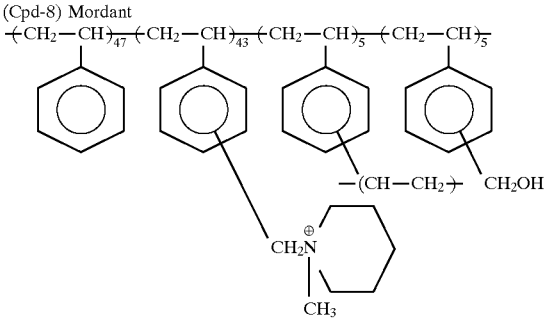

Sample (501) was prepared in the same manner as in Sample (500), except that instead of the color-forming reducing agent in the coating solution for the first layer, the color-forming reducing agent shown in Table 6 was used, in the same molar amounts.

Further, Samples (600) and (601) were prepared in the same manner as in Sample (500), except that, in the coating solution of the first layer, the silver chlorobromide emulsion D was changed to the silver chlorobromide emulsion E used in the Example 2, in the same amount of silver, and the coupler and the color-forming reducing agent were changed to the magenta coupler and the color-forming reducing agent, in the same molar amounts, shown in Table 6. For the silver chlorobromide emulsion E, the green-sensitive sensitizing dyes D, E, and F, used in the Example 2, were used in the same amounts as in the Example 2.

Further, Samples (700) and (701) were prepared in the same manner as in Sample (500), except that, in the coating solution of the first layer, the silver chlorobromide emulsion D was changed to the silver chlorobromide emulsion F used in the Example 2, in the same amount of silver, and the coupler and the color-forming reducing agent were changed to the cyan coupler and the color-forming reducing agent, in the same molar amounts, shown in Table 6. For the silver chlorobromide emulsion F, the red-sensitive sensitizing dyes G and H, used in the Example 2, were used in the same amounts as in the Example 2.

By using an FWH-type sensitometer (color temperature of the light source: 3,200° K), manufactured by Fuji Photo Film Co., Ltd., gradation exposure was given, to the thus-prepared Samples (500) and (501) through a blue color filter for sensitometry, to the thus-prepared Samples (600) and (601) trough a green color filter for sensitometry, and to the thus-prepared Samples (700) and (701) through a red color filter for sensitometry.

The thus exposed Samples were processed with the following processing solutions in the following processing steps:

| Processing step | Temperature | Time |
|---|---|---|
| Development | 40° C. | 20 sec |
| Bleach-fix | 40° C. | 45 sec |
| Rinse | room temperature | 45 sec |

(Developing Solution)

| | |
|---|---|
| Water | 600 ml |
| Potassium phosphate | 40 g |
| Disodium N,N-bis(sulfonatoethyl)hydroxylamine | 10 g |
| KCl | 5 g |
| Hydroxylethylidene-1,1-diphosphonic acid (30%) | 4 ml |
| 1-Phenyl-4-methyl-4-hydroxymethyl-3-pyrazolidone | 1 g |
| Water to make | 1,000 ml |
| pH (at 25° C. by using potassium hydroxide) | 12 |

The bleach-fix solution and the rinsing solution, used in the Example 2, were used.

The maximum color density (Dmax) part of the processed Samples was measured using blue light, for Samples (500) and (501), green light, for Samples (600) and (601), and red light, for Samples (700) and (701), respectively. The results are shown in Table 6.

TABLE 6

| Sample No. | Color-forming reducing agent | Coupler | Dmax | Remarks |
|---|---|---|---|---|
| 500 | R-1 | Y-1 | 0.20 | Comparative Example |
| 501 | D-1 | " | 0.66 | This Invention |
| 600 | R-1 | M-1 | 0.21 | Comparative Example |
| 601 | D-1 | " | 0.79 | This invention |
| 700 | R-1 | C-1 | 0.23 | Comparative Example |
| 701 | D-1 | " | 0.81 | This invention |

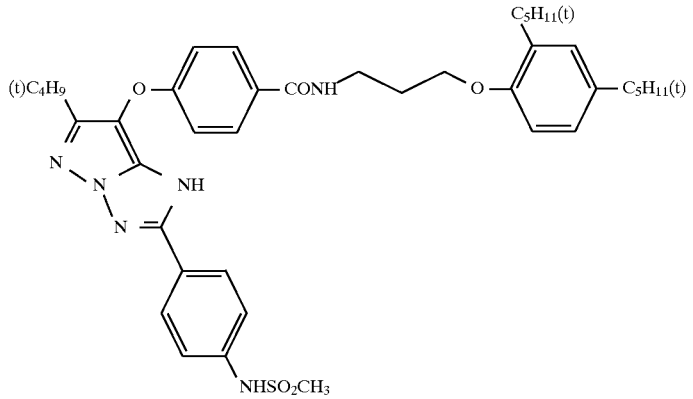

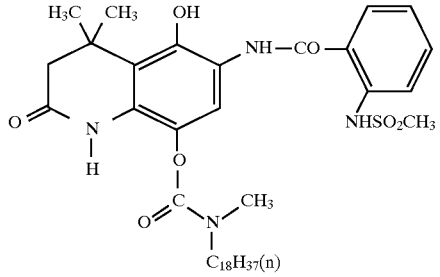

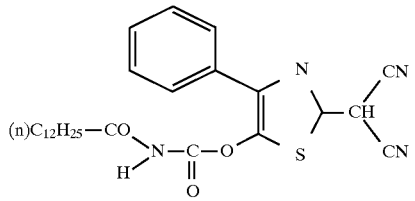

As is apparent from the results in Table 6, it can be understood that, by using the color-forming reducing agent of the present invention, even if mordant was contained in a light-sensitive material, remarkably high color density was obtained.

Example 4

<Method of preparing light-sensitive silver halide emulsion>

To a well-stirred aqueous gelatin solution (containing 30 g of inert gelatin and 2 g of potassium bromide in 1,000 ml of water), were added ammonia -ammonium nitrate as a solvent for silver halide, the temperature was kept at 75° C., and then 1000 ml of an aqueous solution containing 1 mol of silver nitrate, and 1,000 ml of an aqueous solution containing 1 mol of potassium bromide and 0.03 mol of potassium iodide, were simultaneously added thereto, over 78 min. After washing with water and desalting, inert gelatin was added, for redispersion, thereby preparing a silver iodobromide emulsion having a diameter of the grain volume equivalent to a sphere, of 0.76 $\mu$m, and an iodine content of 3 mol %. The diameter of the grain volume equivalent to a sphere was measured by a Model TA-II, manufactured by Coulter Counter Co.

To the above emulsion were added potassium thiocyanate, chloroauric acid, and sodium thiosulfate, at 56° C., to achieve optimal chamical sensitization. To this emulsion, each sensitizing dye corresponding to each of the spectral sensitivities was added at the time of preparation of the coating solution, to provide color sensitivities.

<Preparation Method of Zinc Hydroxide Dispersion>

31 g of zinc hydroxide powder, whose primary particles had a grain size of 0.2 $\mu$m, 1.6 g of carboxylmethyl cellulose and 0.4 g of sodium polyacrylate, as a dispersant, 8.5 g of lime-processed ossein gelatin, and 158.5 ml of water were mixed together, and the mixture was dispersed by a mill containing glass beads for 1 hour. After the dispersion, the glass beads were filtered off, to obtain 188 g of a dispersion of zinc hydroxide.

<Preparation Method of Emulsified Dispersion of Coupler>

The oil-phase components and the aqueous-phase components of each composition shown in Table 7 were dissolved, respectively, to obtain uniform solutions at 60° C. The oil-phase components and the aqueous-phase components were combined together and were dispersed in a 1-liter stainless steel vessel, by a dissolver equipped with a disperser having a diameter of 5 cm, at 10,000 rpm for 20 min. Warm water (as an additional water) was added thereto in the amount shown in Table 7, followed by stirring at 2,000 rpm for 10 min. Thus, emulsified dispersions containing three couplers, that is, cyan, magenta, and yellow couplers, were prepared.

TABLE 7

| | | Cyan | Magenta | Yellow |
|---|---|---|---|---|
| Oil phase | Cyan coupler (1) | 5.63 g | — | — |
| | Magenta coupler (2) | — | 10.68 g | — |
| | Yellow couper (3) | — | — | 7.86 g |
| | Developing agent (4) | 5.11 g | 5.11 g | 5.11 g |

TABLE 7-continued

| | | Cyan | Magenta | Yellow |
|---|---|---|---|---|
| | Antifoggant (5) | 3.0 mg | 1.0 mg | 10.0 mg |
| | High-boiling solvent (6) | 5.37 g | 7.90 g | 6.49 g |
| | Ethyl acetate | 24.0 ml | 24.0 ml | 24.0 ml |
| Aqueous phase | Lime-processed gelatin | 12.0 g | 12.0 g | 12.0 g |
| | Surface-active agent (7) | 0.60 g | 0.60 g | 0.60 g |
| | Water | 138.0 ml | 138.0 ml | 138.0 ml |
| | Additional water | 180.0 ml | 180.0 ml | 180.0 ml |

Cyan coupler (1)

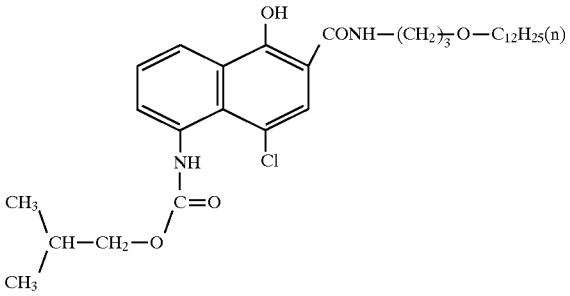

Magenta coupler (2)

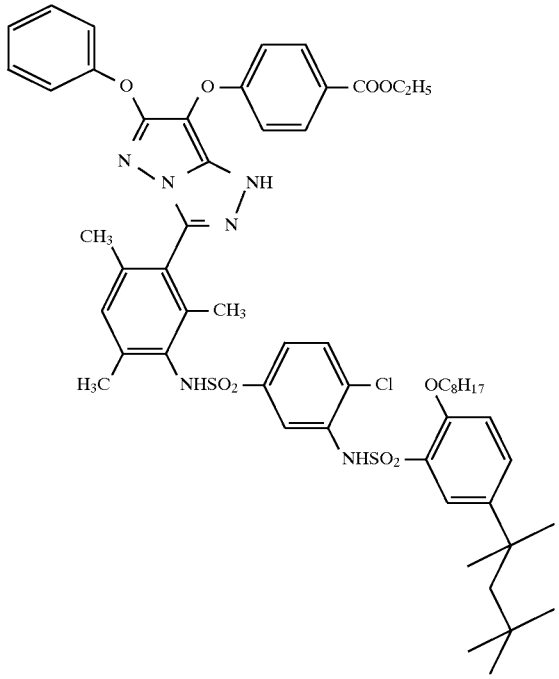

-continued

Yellow coupler (3)

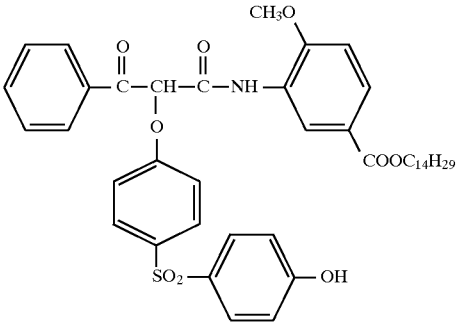

Developing agent (4)

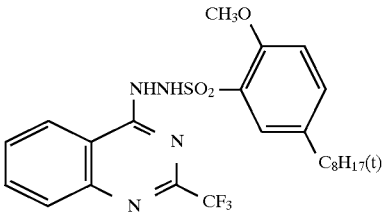

Antifoggant (5)

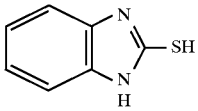

High-boiling solvent (6)

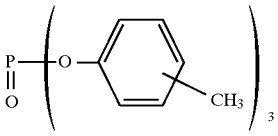

Surface-active agent (7)

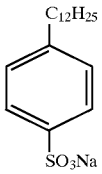

By using the thus obtained material, a heat-development color light-sensitive material 801, having the multi-layer constitution shown in Table 8, was produced.

TABLE 8

Constitution of light-sensitive material 801

| Layer constitution | Additive | Added amount ($mg/m^2$) |
|---|---|---|
| Seventh layer | Lime-processed gelatin | 1000 |
| Protective layer | Matting agent (silica) | 50 |
| | Surface-active agent (8) | 100 |
| | Surface-active agent (9) | 300 |
| | Water-soluble polymer (10) | 15 |
| Sixth layer | Lime-processed gelatin | 375 |
| Interlayer | Surface-active agent (9) | 15 |
| | Zinc hydroxide | 1130 |

TABLE 8-continued

Constitution of light-sensitive material 801

| Layer constitution | Additive | Added amount ($mg/m^2$) |
|---|---|---|
| | Water-soluble polymer (10) | 15 |
| Fifth layer yellow color-forming layer | Lime-processed gelatin | 1450 |
| | Light-sensitive silver halide emulsion | 692 (in terms of silver) |
| | Sensitizing dye (12) | 3.65 |
| | Yellow coupler (3) | 629 |
| | Color-developing agent (4) | 409 |
| | Antifoggant (5) | 0.8 |
| | High-boiling solvent (6) | 519 |
| | Surface-active agent (7) | 48 |
| | Water-soluble polymer (10) | 20 |
| Forth layer Interlayer | Lime-processed gelatin | 1000 |
| | Surface-active agent (9) | 8 |
| | Water-soluble polymer (10) | 5 |
| | Hardner (11) | 65 |
| Third layer Magenta color-forming layer | Lime-processed gelatin | 993 |
| | Light-sensitive silver halide emulsion | 475 (in terms of silver) |
| | Sensitizing dye (13) | 0.07 |
| | Sensitizing dye (14) | 0.71 |
| | Sensitizing dye (15) | 0.19 |
| | Magenta coupler (2) | 587 |
| | Color-developing agent (4) | 281 |

TABLE 8-continued

Constitution of light-sensitive material 801

| Layer constitution | Additive | Added amount ($mg/m^2$) |
|---|---|---|
| | Antifoggant (5) | 0.06 |
| | High-boiling solvent (6) | 434 |
| | Surface-active agent (7) | 33 |
| | Water-soluble polymer (10) | 14 |
| Second layer Interlayer | Lime-processed gelatin | 1000 |
| | Surface-active agent (9) | 8 |
| | Zinc hydroxide | 1130 |
| | Water-soluble polymer (10) | 5 |
| First layer Cyan color-forming layer | Lime-processed gelatin | 720 |
| | Light-sensitive silver halide emulsion | 346 (in terms of silver) |
| | Sensitizing dye (16) | 1.52 |
| | Sensitizing dye (17) | 1.03 |
| | Sensitizing dye (18) | 0.05 |
| | Cyan coupler (1) | 225 |
| | Color-developing agent (4) | 204 |
| | Antifoggant (5) | 0.12 |
| | High-boiling solvent (6) | 215 |
| | Surface-active agent (7) | 24 |
| | Water-soluble polymer (10) | 10 |
| | Transparent PET base (102 $\mu$m) | |

Surface-active agent (8)

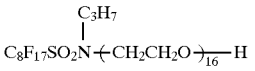

Surface-active agent (9)

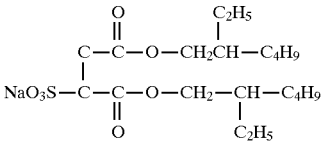

Water-soluble polymer (10)

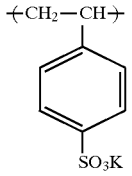

Hardner (11)

$CH_2=CH-SO_2-CH_2-SO_2-CH=CH_2$

Sensitizing dye (12)

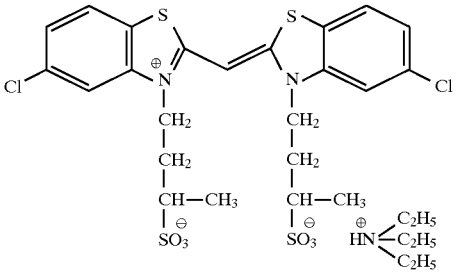

-continued
Sensitizing dye (13)
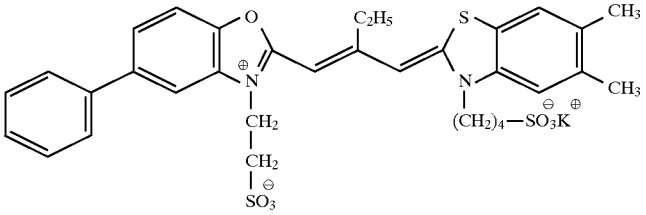
Sensitizing dye (14)
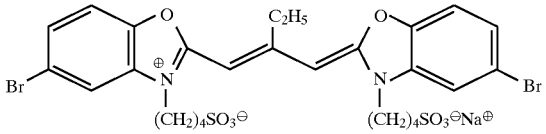
Sensitizing dye (15)
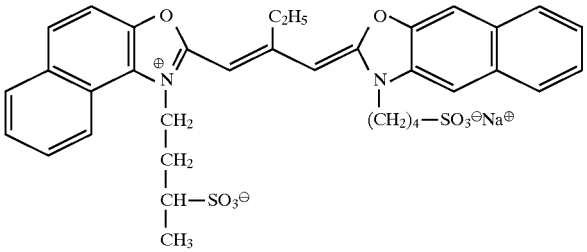
Sensitizing dye (16)
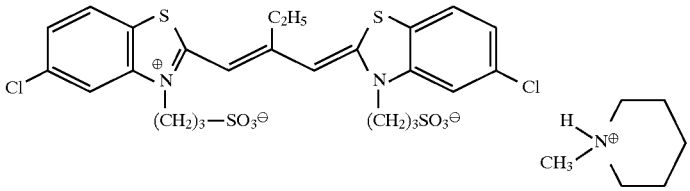
Sensitizing dye (17)
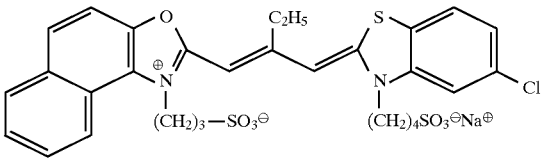
Sensitizing dye (18)
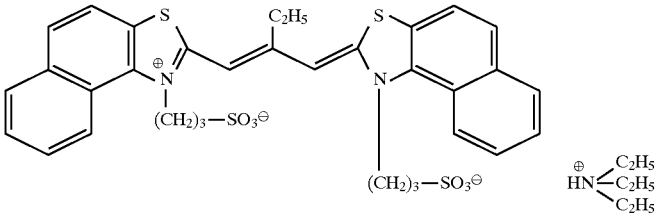

TABLE 9

Constitution of processing material R-1

| Layer constitution | Additive | Added amount ($mg/m^2$) |
|---|---|---|
| Forth layer | Acid-processed gelatin | 220 |
| Protective layer | Water-soluble polymer (19) | 60 |
| | Water-soluble polymer (20) | 200 |
| | Additive (21) | 80 |
| | Palladium sulfide | 3 |
| | Potassium nitrate | 12 |
| | Matting agent (22) | 10 |
| | Surface-active agent (9) | 7 |
| | Surface-active agent (23) | 7 |
| | Surface-active agent (24) | 10 |
| Third layer | Lime-processed gelatin | 240 |
| Interlayer | Water-soluble polymer (20) | 24 |
| | Hardner (25) | 180 |
| | Surface-active agent (7) | 9 |
| Second layer | Lime-processed gelatin | 2400 |
| Base-producing layer | Water-soluble polymer (20) | 360 |
| | Water-soluble polymer (26) | 700 |
| | Water-soluble polymer (27) | 600 |
| | High-boiling solvent (28) | 2000 |
| | Additive (29) | 20 |
| | Potassium hydantoinate | 260 |
| | Guanidine picolinate | 2910 |
| | Potassium quinolinate | 225 |
| | Sodium quinolinate | 180 |
| | Surface-active agent (7) | 24 |
| First layer | Lime-processed gelatin | 280 |
| Undercoat layer | Water-soluble polymer (19) | 12 |
| | Surface-active agent (9) | 14 |
| | Hardner (25) | 185 |
| | Transparent base A (63 μm) | |

TABLE 10

Constitution of Base A

| Name of layer | Composition | Weight ($mg/m^2$) |
|---|---|---|
| Undercoat layer of surface | Gelatin | 100 |
| Polymer layer | polyethylene terephthalate | 62500 |
| Undercoat layer of back surface | Methyl methacrylate/styrene/2-ethylhexyl acrylate/methacrylic acid copolymer | 1000 |
| | PMMA latex (average grain diameter 12 μm) | 120 |
| | | 63720 |

Water-soluble polymer (19) (kappa) κ-Carrageenan

Water-soluble polymer (20) Sumikagel L-5H (trade name: manufactured by Sumitomo Kagaku Co.)

Additive (21)

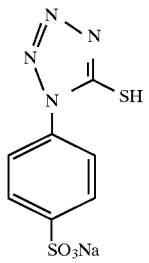

Matting agent (22) SYLOID79 (trade name: manufactured by Fuji Davisson Co.)

Surface-active agent (23)

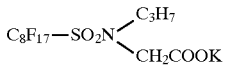

Surface-active agent (24)

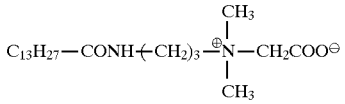

Hardner (25)

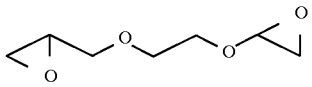

Water-soluble polymer (26) Dextran (molecular weight 70,000)

Water-soluble polymer (27) MP polymer MP102 (trade name: manufactured by Kurare Co.)

High-boiling solvent (28) EMPARA 40 (trade name: manufactured by Ajinomoto K.K.)

Additive (29)

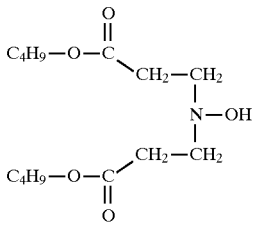

Then, Light-Sensitive Materials 802 to 806 were prepared in the same manner as in Light-Sensitive Material 801, except that the developing agent was changed as shown in Table 11. The thus prepared Light-Sensitive Materials 801 to 806 were exposed to light at 2,500 lux for 0.01 sec through B, G, or R filter, whose density was respectively changed continuously. Warm water at 40° C. was applied to the surface of the thus exposed light-sensitive materials, in an amount of 15 $ml/m^2$, and then after each processing sheet and each film surface were brought together, they were heat-developed at 83° C. for 30 sec using a heat dram. After the processing, when the image-receiving material was removed, cyan, magenta, and yellow color images were obtained clearly on the side of the light-sensitive material corresponding to the filters used for the exposure. Immediately after the processing, for each Samples, the maximum density part (Dmax) and the minimum density part (Dmin) that was non-exposed part were measured by an X-rite densitometer. The results are shown in Table 12.

TABLE 11

| Light-sensitive material No. | | Used developing agent | | |
|---|---|---|---|---|
| | | First layer | Third layer | Fifth layer |
| 801 | (Comparative Example) | (4) | (4) | (A) |

TABLE 11-continued

| Light-sensitive material No. | | Used developing agent First layer | Third layer | Fifth layer |
|---|---|---|---|---|
| 802 | (Comparative Example) | ⓐ | ⓐ | ⓐ |
| 803 | (Comparative Example) | ⓑ | ⓑ | ⓑ |
| 804 | (Comparative Example) | ⓒ | ⓒ | ⓒ |
| 805 | (This invention) | D-1 D-16 | D-1 D-16 | D-1 D-16 |
| 806 | (This invention) | | | |

Added amount of developing agent was the same molar amount as 801, respectively.

TABLE 12

| Light-sensitive material No. | Dmax C | M | Y | Dmin C | M | Y |
|---|---|---|---|---|---|---|
| 801 | 0.31 | 0.35 | 0.32 | 0.03 | 0.04 | 0.06 |
| 802 | 0.32 | 0.34 | 0.33 | 0.04 | 0.05 | 0.07 |
| 803 | 0.31 | 0.33 | 0.33 | 0.03 | 0.04 | 0.06 |
| 804 | 0.33 | 0.31 | 0.33 | 0.04 | 0.05 | 0.07 |
| 805 | 1.32 | 1.40 | 1.20 | 0.19 | 0.20 | 0.23 |
| 806 | 1.31 | 1.41 | 1.21 | 0.18 | 0.21 | 0.23 |

Color-developing agent ⓐ

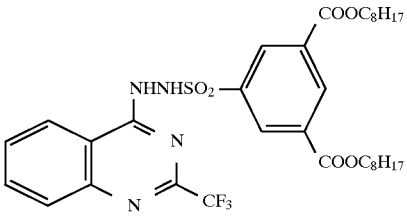

Color-developing agent ⓑ

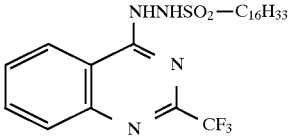

Color-developing agent ⓒ

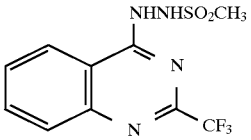

Summarizing the results of Table 12, Samples (801 to 804), which used developing agents of Comparative Examples, should give almost no dye images. In contrast, it can be understood that Samples (805 to 806), which used the developing agents of the present invention, gave images excellent in discrimination. Thus, from the above, the effects of the present invention are evident.

Further, the results in this example show that the images obtained from the light-sensitive materials of the present invention were excellent in hue and image stability.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic light-sensitive material, comprising a compound represented by formula (I) that is contained in at least one hydrophilic colloid layer provided on a base:

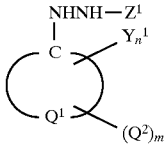

Formula (I)

wherein $Z^1$ represents a carbamoyl group, $Q^1$ represents a group of nonmetal atoms required to form a 5- or 6-membered aromatic ring together with the C, $Q^2$ represents a heterocyclic residue, $Y^1$ represents a group capable of substitution onto the aromatic ring, m is 1 or 2, and n is an integer of 0 to 3.

2. The silver halide photographic light-sensitive material as claimed in claim 1, wherein the formula (I) is represented by formula (III):

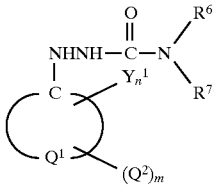

Formula (III)

wherein $R^6$ and $R^7$ each represent a hydrogen atom or a substituent, and $Q^1$, $Q^2$, $Y^1$, m, and n each have the same meanings as defined in formula (I).

3. The silver halide photographic light-sensitive material as claimed in claim 2, wherein $R^6$ and $R^7$ in formula (III) each represent a hydrogen atom, an alkyl group, an aryl group, or a heterocyclic group.

4. The silver halide photographic light-sensitive material as claimed in claim 1, comprising at least one coupler having a substituent at the coupling-reactive position.

5. The silver halide photographic light-sensitive material as claimed in claim 1, comprising at least one coupler having a hydrogen atom at the coupling-reactive position.

6. The silver halide photographic light-sensitive material as claimed in claim 1, wherein $Q^2$ is a benzothiazole group, a benzoxazole group, a benzoimidazole group, a thiazole group, an imidazole group, or an oxazolo[4,5-b]pyridine group.

7. A silver halide photographic light-sensitive material, comprising a compound represented by formula (I) that is contained in at least one hydrophilic colloid layer provided on a base:

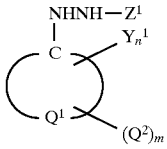

Formula (I)

wherein $Z^1$ represents a carbamoyl group, $Q^1$ represents a group of nonmetal atoms required to form a 5- or 6-membered aromatic ring together with the C, $Q^2$ represents an aromatic heterocyclic residue, $Y^1$ represents a group capable of substitution onto the aromatic ring, m is 1 or 2, and n is an integer of 0 to 3.

8. The silver halide photographic light-sensitive material as claimed in claim 14, wherein the formula (I) is represented by formula (III):

Formula (III)

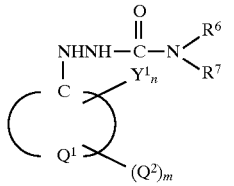

wherein $R^6$ and $R^7$ each represent a hydrogen atom or a substituent, and $Q^1$, $Q^2$, $Y^1$, m, and n each have the same meanings as defined in formula (I).

9. The silver halide photographic light-sensitive material as claimed in claim 7, wherein $Q^2$ is a benzothiazole group, a benzoxazole group, a benzoimidazole group, a thiazole group, an imidazole group, or an oxazolo[4,5-b]pyridine group.

10. An image-forming method, comprising the steps of subjecting a silver halide photographic light-sensitive material to exposure to light image-wise, and developing the silver halide photographic light-sensitive material in the presence of a color-developing agent represented by the formula (I):

Formula (I)

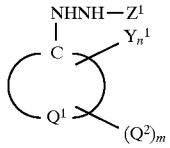

wherein $Z^1$ represents a carbamoyl group, $Q^1$ represents a group of nonmetal atoms required to form a 5- or 6-membered aromatic ring together with the C, $Q^2$ represents a heterocyclic residue, $Y^1$ represents a group capable of substitution onto the aromatic ring, m is 1 or 2, and n is an integer of 0 to 3.

11. The image-forming method as claimed in claim 10, wherein the formula (I) is represented by formula (III):

Formula (III)

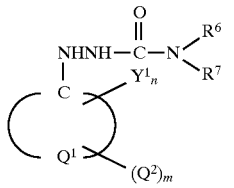

wherein $R^6$ and $R^7$ each represent a hydrogen atom or a substituent, and $Q^1$, $Q^2$, $Y^1$, m, and n each have the same meanings as defined in formula (I).

12. The image-forming method as claimed in claim 11, wherein $R^6$ and $R^7$ in formula (III) each represent a hydrogen atom, an alkyl group, an aryl group, or a heterocyclic group.

13. The image-forming method as claimed in claim 10, wherein the color-developing agent represented by formula (I) is contained in at least one hydrophilic colloid layer that is provided on a base of the silver halide photographic light-sensitive material.

14. The image-forming method as claimed in claim 13, wherein the development is carried out by heating the silver halide photographic light-sensitive material at 50° C. or higher, but 200° C. or lower.

15. The image-forming method as claimed in claim 13, wherein the development of the silver halide photographic light-sensitive material is carried out in a solution.

16. The image-forming method as claimed in claim 10, wherein the development of the silver halide photgraphic light-sensitive material is carried out by using a processing solution containing the color-developing agent represented by formula (I).

17. The image-forming method as claimed in claim 10, wherein the silver halide photographic light-sensitive material comprises at least one couper having a substituent at the coupling reaction position.

18. The image-forming method as claimed in claim 10, wherein the silver halide photographic light-sensitive material comprises at least one couper having a hydrogen atom at the coupling reaction position.

19. The image-forming method as claimed in claim 10, wherein $Q^2$ is a benzothiazole group, a benzoxazole group, a benzoimidazole group, a thiazole group, an imidazole group, or an oxazolo[4,5-b]pyridine group.

20. An image-forming method, comprising the steps of subjecting a silver halide photographic light-sensitive material to exposure to light image-wise, and developing the silver halide photographic light-sensitive material in the presence of a color-developing agent represented by the formula (I):

Formula (I)

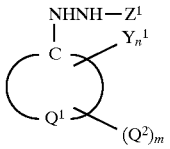

wherein $Z^1$ represents a carbamoyl group, $Q^1$ represents a group of nonmetal atoms required to form a 5- or 6-membered aromatic ring together with the C, $Q^2$ represents an aromatic heterocyclic residue, $Y^1$ represents a group capable of substitution onto the aromatic ring, m is 1 or 2, and n is an integer of 0 to 3.

21. The image-forming method as claimed in claim 20, wherein the formula (I) is represented by formula (III):

Formula (III)

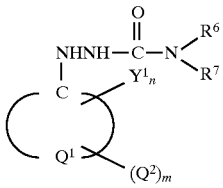

wherein $R^6$ and $R^7$ each represent a hydrogen atom or a substituent, and $Q^1$, $Q^2$, $Y^1$, m, and n each have the same meanings as defined in formula (I).

22. The image-forming method as claimed in claim 20, wherein the color-developing agent represented by formula (I) is contained in at least one hydrophilic colloid layer that is provided on a base of the silver halide photographic light-sensitive material.

23. The image-forming method as claimed in claim 22, wherein the development is carried out by heating the silver halide photographic light-sensitive material at 50° C. or higher, but 200° C. or lower.

24. The image-forming method as claimed in claim 22, wherein the development of the silver halide photographic light-sensitive material is carried out in a solution.

25. The image-forming method as claimed in claim 20, wherein the development of the silver halide photgraphic light-sensitive material is carried out by using a processing solution containing the color-developing agent represented by formula (I).

26. The image-forming method as claimed in claim 20, wherein $Q^2$ is a benzothiazole group, a benzoxazole group, a benzoimidazole group, a thiazole group, an imidazole group, or an oxazolo[4,5-b]pyridine group.

* * * * *